US007039555B2

(12) United States Patent
Lang

(10) Patent No.: US 7,039,555 B2
(45) **Date of Patent: *May 2, 2006**

(54) METHOD FOR DETECTING HEAT EXCHANGER TUBE FAILURES AND THEIR LOCATION WHEN USING INPUT/LOSS PERFORMANCE MONITORING OF A RECOVERY BOILER

(75) Inventor: Fred D. Lang, San Rafael, CA (US)

(73) Assignee: Exergetic Systems LLC, San Rafael, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/715,319

(22) Filed: Nov. 17, 2003

(65) Prior Publication Data

US 2004/0128111 A1 Jul. 1, 2004

Related U.S. Application Data

(63) Continuation-in-part of application No. 10/268,466, filed on Oct. 9, 2002, now Pat. No. 6,651,035, which is a continuation-in-part of application No. 10/131,932, filed on Apr. 24, 2002, now Pat. No. 6,745,152, which is a continuation-in-part of application No. 09/273,711, filed on Mar. 22, 1999, now Pat. No. 6,522,994, which is a continuation-in-part of application No. 09/047,198, filed on Mar. 24, 1998, now abandoned, said application No. 10/131,932 is a continuation-in-part of application No. 09/630,853, filed on Aug. 2, 2000, now Pat. No. 6,584,429, said application No. 10/131,932 is a continuation-in-part of application No. 10/087,879, filed on Mar. 1, 2002, now Pat. No. 6,714,877, which is a continuation-in-part of application No. 09/273,711, said application No. 10/087,879 is a continuation-in-part of application No. 09/630,853, said application No. 10/087,879 is a continuation-in-part of application No. 09/827,956, filed on Apr. 4, 2001, now Pat. No. 6,560,563, which is a continuation-in-part of application No. 09/759,061, filed on Jan. 11, 2001, now abandoned, which is a continuation-in-part of application No. 09/273,711, said application No. 10/087,879 is a continuation-in-part of application No. 09/971,527, filed on Oct. 5, 2001, now Pat. No. 6,873,933, which is a continuation-in-part of application No. 09/273,711, said application No. 09/971,527 is a continuation-in-part of application No. 09/630,853, which is a continuation-in-part of application No. 09/827,956.

(60) Provisional application No. 60/147,717.

(51) Int. Cl.
*G06F 11/30* (2006.01)

(52) U.S. Cl. ..... 702/183; 702/22; 702/51; 165/11.1; 431/16

(58) Field of Classification Search ..... None
See application file for complete search history.

(56) References Cited

U.S. PATENT DOCUMENTS

| | | | | |
|---|---|---|---|---|
| 3,522,008 | A | 7/1970 | Defabaugh | |
| 5,320,967 | A | 6/1994 | Avallone | |
| 5,367,470 | A | 11/1994 | Lang | |
| 5,790,420 | A | 8/1998 | Lang | |
| 5,847,266 | A * | 12/1998 | Nevruz | 73/40.5 R |
| 6,192,352 | B1 | 2/2001 | Alouani | |
| 6,484,108 | B1 | 11/2002 | Burgmayer et al. | |
| 6,522,994 | B1 * | 2/2003 | Lang | 702/183 |
| 6,651,035 | B1 * | 11/2003 | Lang | 702/183 |

FOREIGN PATENT DOCUMENTS

| | | |
|---|---|---|
| AU | 762836 | 10/2003 |
| CA | 2325929 | 6/2004 |

OTHER PUBLICATIONS

"Performance Test Procedure: Sodium Based Recovery Units", CA Report No. 84041601, Mar. 1995, TAPPI Press, Atlanta Georgia.*

Chapter 18, "Failure Analysis and In-Service Experience—Fossil Boilers and Other Heat Transfer Surfaces" of The ASME Handbook on Water Technology for Thermal Power Systems, P. Cohen, Editor, The American Society of Mechanical Engineers, New York, NY, 1989.
J. Gommi, "Root Causes of Recovery Boiler Leaks", 1997 Engineering and Papermakers Conference, TAPPI Proceedings, available from TAPPI Press as product code ENG97509, Atlanta, Georgia.
D.G. Bauer and W.B.A. Sharp, "The Inspection of Recovery Boilers to Detect Factors That Cause Critical Leaks", TAPPI Journal, Sep. 1991, TAPPI Press, Atlanta, Georgia.
"Performance Test Procedure Sodium Based Recovery Units", CA Report No. 84041601, Mar. 1996, TAPPI Press, Atlanta Georgia.
"Steam, Its Generation and Use", 40th Edition, Edited by S.C. Stultz and J.B. Kitto, published 1992 by The Babcock & Wilcox Company, Barberton, Ohio (see Chapter 26, p. 26-5).
A.B. Gill, Power Plant Performance, Butterworths: London, 1984; Chapter 2, pp. 70-77.
German standard, Acceptance Testing of Steam Generators, DIN 1942, DIN Deutsches Institut Fur Normung E.V., Feb. 1994.
European standard (draft) prEN 12952-15:1999 (also cited as: CEN/TC 269/WG 3 N 337), "Water-Tube Boilers and Auxiliary Installations—Part 15: Acceptance Tests", Nov. 1999, European Committee for Standardization, Central Secretariat, rue de Stassart, 36, Brussels.
British Standard "Code for Acceptance Tests on Stationary Steam Generators of the Power Station Type", BS 2885: 1974, ISBN: 0 580 08136 2.
D.F. Shanno and K.H. Phua, "Algorithm 500, Minimization of Unconstrained Multivariate Functions", ACM Transactions on Mathematical Software, vol. 2, No. 1, Mar. 1976, pp. 87-94.
D.F. Shanno and K.H. Phua, "Remark on Algorithm 500, Minimization of Unconstrained Multivariate Functions", ACM Transactions on Mathematical Software, vol. 6, No. 2, Dec. 1980, pp. 618-622.
W.L. Goffe, G.D. Ferrier and J. Rogers, "Global Optimization of Statistical Functions with Simulated Annealing", Journal of Econometrics, vol. 60, No. 1/2, pp. 65-100, Jan./Feb. 1994.
A. Corana, M. Marchesi, C. Martin and S. Ridella, "Minimizing Multimodal Functions of Continuous Variables with the 'Simulated Annealing' Algorithm", ACM Transactions on Mathematical Software, vol. 13, No. 3, pp. 262-280, Sep. 1987.
F. James, "A Review of Pseudorandom Number Generators", Computer Physics Communications, vol. 60, pp. 329-344, 1990.
W.H. Press, S.A. Teukolsky, W.T. Vettering & B.P. Flannery, Numerical Recipes in FORTRAN 77, The Art of Scientific Computing, Cambridge University Press, Cambridge and New York (1992), Chapter 9.6 on Newton-Raphson Method for Nonlinear Systems of Equations, and Chapter 9.7 on Globally Convergent Methods for Nonlinear Systems of Equations.
FD Lang, "Fuel Consumption Index for Proper Monitoring of Power Plants—Revisited", Am. Society of Mech. Engrs., 2002 International Joint Power Generation Conference, Scottsdale, AZ, IJPGC2002-26097.
American Society of Mechanical Engineers' (ASME) Performance Test Code (PTC) 4.1.
American Society of Mechanical Engineers' (ASME) Performance Test Code (PTC) 4.

* cited by examiner

*Primary Examiner*—Marc S. Hoff
*Assistant Examiner*—Manuel L. Barbee

(57) ABSTRACT

This invention relates to a recovery boiler as used by the pulp and paper industry burning black liquor, and, more particularly, to a method for rapid detection of tube failures and the location of the affect heat exchanger within the recovery boiler, without need for direct instrumentation, thereby preventing more serious equipment damage, preventing boiler explosion, preventing injury to operators and minimizing repair time on the affected heat exchanger. This method is applicable to Input/Loss methods of monitoring recovery boilers.

74 Claims, 5 Drawing Sheets

METHOD FOR DETECTING HEAT EXCHANGER TUBE FAILURES AND THEIR LOCATION WHEN USING INPUT/LOSS PERFORMANCE MONITORING OF A RECOVERY BOILER

This application is a Continuation-In-Part of U.S. patent application Ser. No. 10/268,466 filed Oct. 9, 2002, which issued on Nov. 18, 2003 as U.S. Pat. No. 6,651,035 for which priority is claimed and is incorporated herein by reference in its entirety. application Ser. No. 10/268,466 which, in turn, is a Continuation-In-Part of U.S. patent application Ser. No. 10/131,932 filed Apr. 24, 2002, which issued on Jun. 1, 2004 as U.S. Pat. No. 6,745,152 for which priority is claimed and is incorporated herein by reference in its entirety. application Ser. No. 10/131,932 which, in turn, is a Continuation-In-Part of U.S. patent application Ser. No. 09/273,711 filed Mar. 22, 1999, which issued on Feb. 18, 2003 as U.S. Pat. No. 6,522,994 and is incorporated herein by reference in its entirety; application Ser. No. 09/273,711 which, in turn, is a Continuation-In-Part of U.S. patent application Ser. No. 09/047,198 filed Mar. 24, 1998 now abandoned.

application Ser. No. 10/131,932 is also a Continuation-In-Part of U.S. patent application Ser. No. 09/630,853 filed Aug. 2, 2000, which issued on Jun. 24, 2003 as U.S. Pat. No. 6,584,429 and is incorporated herein by reference in its entirety; application Ser. No. 09/630,853 claims the benefit of U.S. Provisional Patent Application Ser. No. 60/147,717 filed Aug. 6, 1999.

application Ser. No. 10/131,932 is also a Continuation-In-Part of U.S. patent application Ser. No. 10/087,879 filed Mar. 1, 2002, which issued on Mar. 30, 2004 as U.S. Pat. No. 6,714,877 and is incorporated herein by reference in its entirety; application Ser. No. 10/087,879 which, in turn, is a Continuation-In-Part of U.S. patent application Ser. No. 09/273,711 now U.S. Pat. No. 6,522,994; application Ser. No. 09/273,711 which, in turn, is a Continuation-In-Part of U.S. patent application Ser. No. 09/047,198 now abandoned. application Ser. No. 10/087,879 is also a Continuation-In-Part of U.S. patent application Ser. No. 09/630,853 now U.S. Pat. No. 6,584,429; application Ser. No. 09/630,853 claims the benefit of U.S. Provisional Patent Application Ser. No. 60/147,717. application Ser. No. 10/087,879 is also a Continuation-In-Part of U.S. patent application Ser. No. 09/827,956 filed Apr. 4, 2001, which issued on May 6, 2003 as U.S. Pat. No. 6,560,563 and is incorporated herein by reference in its entirety; application Ser. No. 09/827,956 which, in turn, is a Continuation-In-Part of U.S. patent application Ser. No. 09/759,061 filed Jan. 11, 2001 now abandoned; application Ser. No. 09/759,061 which, in turn, is a Continuation-In-Part of U.S. patent application No. 09/273,711 now U.S. Pat. No. 6,522,994; application Ser. No. 09/273,711 which, in turn, is a Continuation-In-Part of U.S. patent application Ser. No. 09/047,198 now abandoned. application Ser. No. 10/087,879 is also a Continuation-In-Part of U.S. patent application Ser. No. 09/971,527 filed Oct. 5, 2001, which issued on Mar. 29, 2005 as U.S. Pat. No. 6,873,933; application Ser. No. 09/971,527 which, in turn, is a Continuation-In-Part of U.S. patent application Ser. No. 09/273,711 now U.S. Pat. No. 6,522,994; application Ser. No. 09/273,711 which, in turn, is a Continuation-In-Part of U.S. patent application Ser. No. 09/047,198 now abandoned; application Ser. No. 09/971,527 is also a Continuation-In-Part of U.S. patent application Ser. No. 09/630,853 now U.S. Pat. No. 6,584,429; application Ser. No. 09/971,527 is also a Continuation-In-Part of U.S. patent application Ser. No. 09/827,956 now U.S. Pat. No. 6,560,563; application Ser. No. 09/827,956 which, in turn, is a Continuation-In-Part of U.S. patent application Ser. No. 09/759,061 now abandoned; application Ser. No. 09/759,061 which, in turn, is a Continuation-In-Part of U.S. patent application Ser. No. 09/273,711 now U.S. Pat. No. 6,522,994; application Ser. No. 09/273,711 which, in turn, is a Continuation-In-Part of U.S. patent application Ser. No. 09/047,198 now abandoned.

This invention relates to a recovery boiler as used by the pulp and paper industry burning black liquor, and, more particularly, to a method for rapid detection of tube failures and the location of the affect heat exchanger within the recovery boiler, without need for direct instrumentation, thereby preventing serious equipment damage, preventing boiler explosion, preventing injury to operators and minimizing repair time on the effected heat exchanger.

BACKGROUND OF THE INVENTION

Although especially applicable to "The Input/Loss Method" as installed at recovery boilers burning black liquor, this invention may also be applied to any other of the "Input/Loss methods" installed at any thermal system burning a fossil fuel. The teachings of this invention may be implemented for monitoring of any thermal system burning a fossil-fuel, or a thermal system burning a mix of fossil fuels and inorganic fuels. Such monitoring is assumed to be conducted in a continuous manner (i.e., on-line), processing one monitoring cycle after another, each cycle includes determining stoichiometric balances of the combustion process and, specifically, the fuel's chemistry, heating value, boiler efficiency, system efficiency and evaluation for possible tube failures. Specifically, The Input/Loss Method and its associated technologies are described in the following U.S. Patents (cited above): U.S. Pat. No. 6,522,994 (hereinafter termed '994), U.S. Pat. No. 6,584,429 (hereinafter termed '429), U.S. Pat. No. 6,560,563 (hereinafter termed '563), U.S. Pat. No. 6,714,877 (hereinafter termed '879 after its application Ser. No. 10/087,879), U.S. Pat. No. 6,651,035 (hereinafter termed '035) and U.S. Pat. No. 6,745,152 (hereinafter termed '932 after its application Ser. No. 10/131,932). One of the Input/Loss methods, a rudimentary method, is described in U.S. Pat. No. 5,367,470 issued Nov. 22, 1994 (hereinafter termed '470), and in U.S. Pat. No. 5,790,420 issued Aug. 4, 1998 (hereinafter termed '420).

Conventional steam generators and recovery boilers having gas-to-working fluid heat exchangers, may be prone to tube leaks of their working fluid (typically water as liquid or steam). These tube leaks represent a potential for serious physical damage to heat exchangers due to pipe whip (i.e., mechanical movement) and/or steam cutting of metal given high leakages flowing at critical velocities. In some recovery boilers, pressures of the working fluid may exceed 2300 psia. Given failure of a heat exchanger tube, such fluid will experience many times critical pressure ratio as it expands into the combustion gases; that is, mixing with the products of combustion at essentially atmospheric pressure. When undetected, the damage from such tube failures may range from $2 to $10 million/leak forcing the system down for major repairs. If detected early, tube failures may be repaired before catastrophic damage, such repairs lasting only several days and costing a fraction of the cost associated with late detection and catastrophic damage. Repair times may be further reduced if the location of the heat exchanger which has the leak is identified before repairs are initiated.

However, an unique situation found with recovery boilers is associated with the pulp producing process to which they are integrated. This process involves first de-barking and chipping wood; then digesting the wood in an aqueous solution of NaOH and $Na_2SO_4$ (or other sodium-based compounds), forming a "white liquor"; then heating the brew; then separating the pulp from the spent liquor, the spent liquor is termed "black liquor" which consists of organics, water and inorganics (mostly sodium); and then the black liquor is burned in a recovery boiler. The essential function of a recovery boiler is the reduction in the furnace of sodium sulfate ($Na_2SO_4$, present in the black liquor) to sodium sulfide ($Na_2S$). The efficiency of this sulfur reduction process is gauged by a "Reduction Efficiency" parameter. Heat from combustion of the fired organics, originating from the wood digesting process, generates steam. Black liquor inorganics, after reduction, are collected at the bottom of the furnace as a molten smelt, removed and recycled to recover sodium. Given a high Reduction Efficiency, smelt principally consists of $Na_2CO_3$, $Na_2S$, inerts and free carbon.

The problem of tube failures in recovery boilers, in addition to the conventional problems cited above, is when water comes in contact with the molten smelt (typically at over 1400 F, having a heavy concentration of sodium); explosion is likely and may occur within minutes after tube failure. Recovery boiler explosions have dogged the pulp and paper industry since inception of the pulp producing process (i.e., called the Kraft process). Recovery boiler explosions injure and kill people every year. From 1948 through 1990 the industry recorded 140 recovery boiler explosions, three-quarters of which were smelt-water explosions. To place emphasis on the problem, the industry ranks explosions by severity: by definition just a "moderate explosion" keeps the plant off-line from 10 to 50 days; whereas a severe explosion keeps the plant off-line more than 50 days (typically lasting more than 120 days).

As common with conventional steam generators, tube failures in recovery boilers are typically caused by one the following general categories:

- Weld failure of heat exchanger tubes;
- Metallurgical damage caused by hydrogen absorption in the metal resulting in either embrittlement or the formation of non-protective magnetite;
- Caustic gouging caused by the presence of free hydroxide in the water;
- Corrosion-fatigue damage from the water-side of the tube, compounded by stress;
- Corrosion damage caused by impacts from solid ash particles;
- Fatigue failure caused by oxidation and/or mechanical movement, compounded by stress;
- Overheating (e.g., from tube blockage) causing local creep; and
- Physical damage from steam cutting and/or mechanical movement associated with another failed tube in the same locale.

Commonly, the physical leak initiates as a relatively small penetration, although initial breaks may also occur. For reference and further discussion see: Chapter 18, "Failure Analysis and In-Service Experience—Fossil Boilers and Other Heat Transfer Surfaces" of *The ASME Handbook on Water Technology for Thermal Power Systems*, P. Cohen, Editor, The American Society of Mechanical Engineers, New York, N.Y., 1989; and J. Gommi, "Root Causes of Recovery Boiler Leaks", 1997 Engineering and Papermakers Conference, TAPPI Proceedings, available from TAPPI Press as product code ENG97509, Atlanta, Ga.

Present industrial art associated with conventional steam generators and recovery boilers have practiced the detection of tube failures using one or more of six general methods: 1) operator interface; 2) acoustic monitoring; 3) water balance testing; 4) monitoring of effluent moisture using instrumentation located at the system's effluent boundary (i.e., Stack); 5) monitoring the concentration of chemicals added to the working fluid whose change is sensitive to leakage; and 6) through use of artificial neural network technologies. Operator interface involves the use of his/her knowledge, experience, listening skills, and visual skills using remote cameras. However, all operators do not have the same high skill-set required. Acoustic devices detect the unique noise created by fluids at high velocities. However, acoustic devices rarely work in large steam generators, are expensive and require benchmarking with known acoustical signatures. Water balance testing may be conducted periodically on the entire system through which large water losses due to tube failures might be discovered. However, water balance testing is expensive, insensitive to small leaks, and typically may not be conducted at sufficient frequency to prevent serious damage. The use of an effluent moisture instrument has been shown to be sensitive to tube failures. Effluent moisture instrumentation may not differentiate between originating sources of water (e.g., between high humidity in the combustion air, or high fuel water, or changing fuel water, or a tube leakage). However, it might be practical to detect tube leakage by monitoring the difference in signals, or the rate of change of the difference in signals, between an effluent moisture instrument and one monitoring ambient air. Note that typical black liquor fuels contain up to 35% fuel water (approximately the same amount of water as found in some Powder River Basin (PRB) coals); thus changes in effluent moisture, even referenced to an ambient measurement, may be insensitive to small tube failures.

Monitoring the concentration of chemicals added to the working fluid operates by making a chemical mass balance on the working fluid based on a combination of flow measurements and chemical concentration measurements. Computed is a mass balance of a specific stable and non-volatile species (such as phosphate or molybdate) which has been uniquely added to the working fluid of the boiler. Basically a foreign chemical is injected into the working fluid; when a tube leak occurs the concentration of the chemical will change, thus detection. This method, developed by Burgmayer, Hong and Gunther, is described in U.S. Pat. No. 6,484,108 issued Nov. 19, 2002. A similar method is described in U.S. Pat. No. 3,522,008 issued Jul. 28, 1970. A similar method is also described in U.S. Pat. No. 5,320,967 issued Jun. 14, 1994. None of these methods involve combustion gases nor any stoichiometric balance involving the combustion process. The most serious limitation of these methods is their lack of sensitivity. Burgmayer's, Table 4 presents results of actual tests indicating that for a boiler producing 500,000 lb/hr of steam, detection of a 0.76% leakage (3,800 lb/hr) took 45 minutes, while a 2.8% leakage (14,000 lb/hr) took 15 min. to detect. Such sensitivities are not adequate to safeguard operators and equipment.

U.S. Pat. No. 6,192,352 by Alouani issued Feb. 20, 2001 (and his U.S. Patent Application Publication 2001/0001149 of May 10, 2001) discloses a method to detect tube failures using artificial neural network and fuzzy logic technology (ANN). No where in Alouani's patent is explicit thermodynamic modeling taught. Alouani's patent teaches that ANN technology may learn to predict tube failures through recognition of patterns in raw data. Such raw data may include coal pulverizer flow (fuel flow), boiler drum pressure, reheat temperature, burner tilt positions, etc. The disadvantage to this method is that it requires a database from which it may learn. Such a database, as must be associated with an actual tube leak, is not frequent, inconvenient and could not contain a defined tube leakage flow rate (explicit system mass balances are not mentioned nor inferred by Alouani). In addition, Alouani's patent FIG. 5 indicates that a number of days is required for his system to detect a tube leak. In a survey of critical tube leaks in recovery boilers, it was found that approximately half of those leaks for which the time between leak initiation and explosion was known, the explosion occurred within 15 minutes after leak initiation; approximately 75% of the recorded explosions occurred within 30 minutes. This survey's reference is: D. G. Bauer and W. B. A. Sharp, "The Inspection of Recovery Boilers to Detect Factors That Cause Critical Leaks", TAPPI Journal, September 1991, TAPPI Press, Atlanta, Ga. Although there are more than a half-dozen vendors offering one or more of the six tube leak detection methods, in practice all known methods suffer serious short-comings and are not reliable in detecting early tube failures.

The patents '470 and '420 make no mention of heat exchanger tube failures nor their detection. Although the technologies of Patents '994, '429 and '563 generally support this invention, they make no mention of tube failure detection nor their location. Applications '879, '035 and '932 support this invention directly. Although the methods of '879, '035 and '932 are useful, the present invention further improves these methods and applies them to recovery boilers. There is no established art directly related to this invention; there is clear need for early detection of tube failures and to determine their location within the recovery boiler system.

SUMMARY OF THE INVENTION

This invention relates to a recovery boiler as used by the pulp and paper industry burning black liquor, and, more particularly, to a method for rapid detection of tube failures and the location of the affect heat exchanger within the recovery boiler, without need for direct instrumentation. Tube failures are detected through use of combustion stoichiometrics, in combination with an ability to correct effluent data through use of optimization procedures. The location of the failure within a recovery boiler is determined through energy balances, high accuracy boiler efficiency and iterative techniques. Further, this invention teaches how the stoichiometric mechanism of tube failure may be identified and reported to the system operator. This invention addresses the deficiencies found in all present detection methods.

Effluent water concentration (at the Stack) may consist of any one or all of the following sources of working fluid (assuming the working fluid is water): heat exchanger tube leaks; water added at the point of combustion (e.g., steam used to atomize fuel); pollutant control processes resulting in the net in-flow of water; and/or soot blowing processes using water to clean heat exchanger surfaces (commonly used in coal-fired systems). These sources of working fluid are in addition to: water formed from the combustion of hydrocarbon fuels; free water born by the fuel; and moisture carried by combustion air including air leakage. All such sources of effluent water are addressed by this invention through combustion stoichiometrics in combination with an ability to correct effluent data through use of optimization procedures.

This invention adds to the technology associated with Input/Loss methods. Specifically The Input/Loss Method has been applied through computer software, installable on a personal computer termed a "Calculational Engine", and has been demonstrated as being highly useful to the operators of fossil-fired systems. The Calculational Engine receives data from the system's data acquisition devices. The Calculational Engine's software consists of the EX-FOSS, FUEL and HEATRATE programs described in '994 and '429, and in FIG. 2 herein, and the ERR-CALC program described in '879 (also described in '035 and '932) and in FIG. 3 herein. ERR-CALC now incorporates the teachings of this invention. The Calculational Engine continuously monitors system efficiency on-line, i.e., in essentially real-time, as long as the thermal system is burning fuel. The application of this invention to The Input/Loss Method significantly enhances the system operator's ability to predict tube failures and reduce outage time required for repair.

The present invention provides a procedure for determining tube leaks in a recovery boiler using combustion stoichiometrics in combination with an ability to correct effluent data such that consistent fuel chemistry is computed.

The present invention teaches the mechanism of how a tube failure has been detected stoichiometrically, such detection being important to the system operator. Also, the present invention teaches how the location of a failed tube may be determined.

Other objects and advantages of the present invention will become apparent when its general methods are considered in conjunction with the accompanying drawings and the related inventions of '994, '429, '563, '879, '035 and '932.

The principles of this invention have been reduced to practice and installed for demonstration at two conventional power plants to determine the operability and functionality of this invention. These demonstrations have produced outstanding results demonstrating several identified tube failures. Furthermore, testing at a power plant burning PRB fuel similar to black liquor in its fuel water content, in which water soot blowing flow was removed from the Calculational Engine's input ($b_Z$=0.0) which then computed an emulated tube leakage ($b_T$>0.0) with outstanding agreement to the measured soot blowing flow; see FIG. 4.

BRIEF DESCRIPTION OF THE DRAWINGS

FIG. 2 illustrates the "Fuel Iterations" involving FUEL, EX-FOSS and HEATRATE.

FIG. 2 and FIG. 3 relate the interactions of the computer programs which implement this invention. The majority of the teachings of this invention are implemented in the ERR-CALC program. The FUEL, EX-FOSS and HEATRATE programs are used to implement both the teachings of '994 and '429, and the sodium-based stoichiometrics as taught herein. The FUEL, EX-FOSS and HEATRATE programs employ results from ERR-CALC, including its calculated tube leakage flow rate, and thus assess the impact such leakage has on the thermal system in terms of boiler efficiency, fuel flow and system efficiency. Further, through energy balances on the steam generator's working fluid, and use of iterative procedures involving these programs, determination is then made within HEATRATE as to which heat exchanger within the steam generator contains the failed tube.

DESCRIPTION OF THE PREFERRED EMBODIMENT

Figure 1:
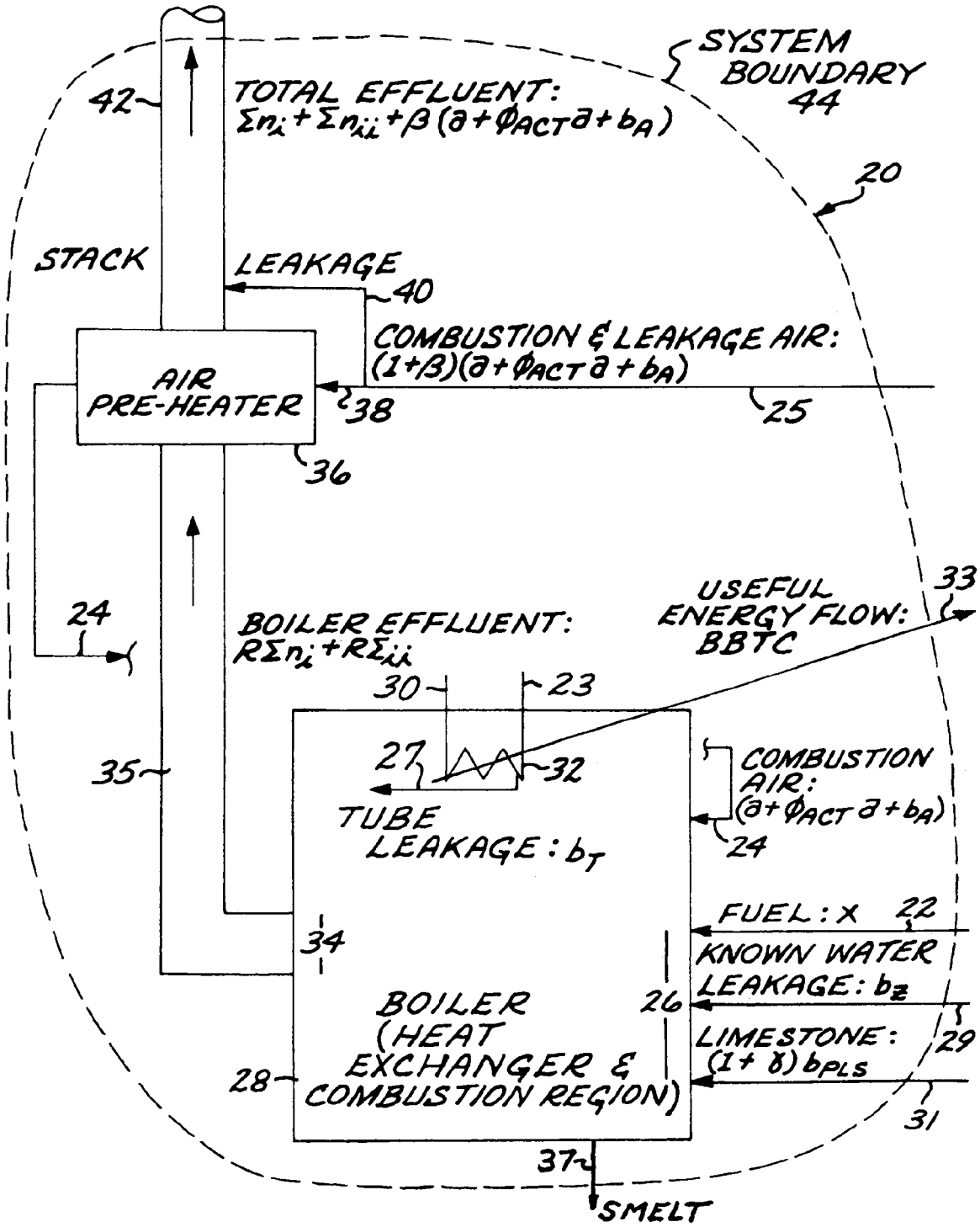
FIG. 1 is a schematic representation of a recovery boiler illustrating the application of stoichiometric relationships, and also contains definitions of some of the important terms used herein.

To assure an appropriate teaching of this invention, its description is divided by sub-sections. The first two present nomenclature, definitions of equation terms, typical units of measure, and meaning of terms used herein (such as Choice Operating Parameters and System Effect Parameters), encompassing the following seventeen paragraphs. The remaining sub-sections, representing the bulk of the teachings, are divided into four general groups:

1) the first group presents system stoichiometrics applied to recovery boilers and the determination of fuel chemistry based on effluents, these teachings support all subsequent disclosures herein (encompassing the sub-section entitled "System Stoichiometrics", employing equations numbered less than one-hundred);
2) the next group presents the determination of boiler efficiency for a black liquor-fired boiler as it influences both tube failure flow rate and determining tube failure location (encompassing the sub-section entitled "Boiler Efficiency for Recovery Boilers", employing equations numbered in the one-hundreds);
3) the next group teaches how a tube failure may be detected based on an ability to correct Choice Operating Parameters using multidimensional minimization techniques, this ability being dependent, in part, on system stoichiometrics, the computed fuel chemistry and boiler efficiency (encompassing five sub-sections starting with "Tube Failure Detection Methods" and ending with "Objective Function and Choice Operating Parameters", employing equations numbered in the two-hundreds); and
4) the last group teaches how both the tube leakage flow rate and its location in the steam generator are determined using, as a foundation, the preceding teachings (encompassing sub-sections entitled "Tube Leakage Flow Rate Computations" and "Tube Leak Location", employing equations numbered in the three-hundreds).

The remaining paragraphs present a conclusion, THE DRAWINGS and related teachings. Teachings of multidimensional minimization techniques, as directly applicable to this invention are also presented in '879, '035 and '932. The present invention expands the utility of Input/Loss methods to recovery boilers, and specifically builds upon and expands the utility of The Input/Loss Method described herein and in '994, '429, '879, '035 and '932, and in '563 as it teaches the L Factor. The methods described in '563 teach the foundations of the L Factor used in multidimensional minimization techniques; the L Factor is further expanded as taught herein to encompass black liquor fuels used in recovery boilers.

Definitions of Equation Terms with Typical Units of Measure

Stoichiometric Terms:

a=Moles of combustion $O_2$ input to the system; moles/base.

$a\beta$=$O_2$ entering with system air leakage (typically via the air pre-heater); mole/base.

$a_{DRY\text{-}theor}$=Moles of combustion $O_2$ input to the system required for theoretical combustion associated with Dry (water free) fuel; moles/base.

$A_{Act}$=Concentration of $O_2$ in combustion air local to (and entering) the system; molar fraction.

$b_A$=Moisture in the entering combustion air; directly proportional to the ambient air's specific humidity, ω (lb-water/lb-dry air); moles/base.
$=\omega a(1.0+\phi_{Act})N_{DRY\text{-}AIR}/N_{H2O}$ $b_A\beta$=Moisture entering with system air leakage; moles/base.

$b_T$=Moles of tube leakage; i.e., water in-leakage entering and mixing with the combustion gases from leaks in heat exchangers; moles/base.

$b_Z$=Moles of known water in-leakage entering and mixing with the combustion gases not related to heat exchanger leaks ($b_T$); moles/base.

$D_{Act}$=Total effluent $CO_2$ at the system's boundary (i.e., Stack); moles/base.
$=(d-\sigma_N k_{BL})$ g=Calculational effluent $O_2$ at the system's boundary associated with a hypothetically segregated organic component of the black liquor, without air leakage; moles/base.

$G_{Act}$=Total effluent oxygen at the system's boundary burning black liquor fuel; moles/base.
$=(g+2\sigma_N T_{NS}+\sigma_N k_{BL}/2)+a\beta$ j=Calculational effluent $H_2O$ at the system's boundary, without air leakage; moles/base.

$J_{Act}$=Total effluent water at the system's boundary ($j+b_A\beta$); moles/base.

$J_{theor}$=Total effluent water at the boundary based on theoretical combustion; moles/base.

$k_{BL}$=Effluent $SO_2$ at the system's boundary from the reaction of $Na_2SO_4$ with $CO_2$ obtained at the system boundary; moles/base.

$n_i$=Molar quantities of dry gaseous effluents of combustion at the system boundary without air leakage; specifically those products associated with the following quantities: $D_{Act}$, $(g+2\sigma_N T_{NS}+\sigma_N k_{BL}/2)$, h, $e_{Act}$, $m_{Act}$, $\sigma_N k_{BL}$ and $(1.0-\sigma_N)x\alpha_6$; note: $\Sigma n_i \equiv 100$ moles of dry gaseous effluent at the Stack is the assumed calculational "base" for Eq.(19BL), see FIG. 1; moles/base.

$n_{ii}$=Molar quantities of non-gas products of combustion at the system boundary without moisture associated with air leakage, specifically those products associated with the following quantities: j, $x\alpha_{10}$, $\sigma_N(T_{NO}+k_{BL})$, $\sigma_N T_{KO}$, $\sigma_N T_{NA}$, $\sigma_N T_{NS}$, $\sigma_N T_{NC}$, and v; see FIG. 1 and Eq. (19BL); moles/base.

$N_k$=Molecular weight of compound k.

$R_{Act}$=Ratio of moles of dry gas from the combustion process before entering the air pre-heater to the diluted gas leaving, typically: (Moles of $CO_2$ entering the air pre-heater)/(Moles of $CO_2$ leaving the air pre-heater), defined as the Air Pre-Heater Leakage Factor; molar fraction.

$R'_{Act}$=(Moles of $O_2$ entering the air pre-heater)/(Moles of $O_2$ leaving the air pre-heater).

$T_{KO}$=Moles of effluent $K_2CO_3$ if burning black liquor ($\sigma_N$=1.0); moles/base.

$T_{NA}$=Moles of effluent $Na_2SO_4$ if burning black liquor ($\sigma_N$=1.0); moles/base.

$T_{NC}$=Moles of effluent NaCl if burning black liquor ($\sigma_N$=1.0); moles/base.

$T_{NS}$=Moles of effluent $Na_2S$ if burning black liquor ($\sigma_N$=1.0); moles/base.

$(T_{NO}+k_{BL})$=Moles of effluent $Na_2CO_3$ if burning black liquor ($\sigma_N$=1.0); moles/base.

v=Moles of effluent free carbon, or its equivalence, typically found in the recovery boiler's smelt; moles/base.

x=Moles of As-fired fuel required per 100 moles of dry gaseous effluent; moles/base.

$x_{theor}$=Moles of As-Fired fuel associated with theoretical combustion; moles/base.

$x_{DRY\text{-}theor}$=Moles of Dry fuel associated with theoretical combustion; moles/base.

$x_{MAF\text{-}theor}$=Moles of Moisture-Ash-Free fuel associated with theoretical combustion; moles/base.

$x\alpha_{10}$=Inert matter in As-Fired fuel, the terms "inert" and "ash" are used interchangeably; mole-inert/base.

$\alpha_k$=As-Fired (wet-base) fuel chemistry constituent k per mole of fuel; $\Sigma\alpha_k$=1.0, where: k=1,2,3,4,5,6,10,14,15,16; see Eq.(19BL) therein for terms; mole-k/mole-fuel.

$\alpha_{MAF\text{-}k}$=Moisture-Ash-Free (MAF) fuel constituent k per mole of MAF fuel; $\Sigma\alpha_{MAF\text{-}k}$=1.0, where: k=1,3,4,5,6,14,15,16; see Eq.(19BL) therein for terms; mole-k/mole-fuel.

β=Air Pre-Heater Dilution Factor (ratio of air leakage to true combustion air); molar fraction $\beta \equiv 100(R_{Act}-1.0)/[aR_{Act}(1.0+\phi_{Act})]$ $\sigma_N$=Kronecker function: unity if black liquor (bearing at least sodium) is being employed in the fuel, otherwise zero; unitless.

$\phi_{Act}$=Ratio of non-oxygen gases ($N_2$ and Ar) to oxygen in the combustion air; molar ratio.

$\phi_{Act} \equiv (1.0-A_{Act})/A_{Act}$ $\phi_{Ref}$=Reference ratio of non-oxygen gases (principally $N_2$ and Ar) to oxygen in the combustion air, taken as 3.7737245; molar ratio.

$\Phi_R$=Reduction Efficiency; see Eq.(19BL); molar ratio.

$\equiv T_{NS}/(T_{NA}+T_{NS})$ $\Phi_S$=Sulfur to Smelt ratio; see Eq.(19BL); molar ratio.

$\equiv (T_{NA}+T_{NS})/[\sigma_N x\alpha_{10}+\sigma_N(T_{NO}+k_{BL})+\sigma_N(T_{KO}+T_{NA}+T_{NS}+T_{NC})+v]$ $\Phi_N$=Sodium to Carbon ratio in the fuel; see Eq.(19BL); molar ratio.

$\equiv \alpha_{MAF\text{-}14}/\alpha_{MAF\text{-}4}$

Multidimensional Minimization Terms:

$F(\vec{x})$=Objective function, a functional relationship using the independent variables $\vec{x}$; unitless.

$f(\ )$=>Indicates a general functional relationship; for example, the expression:

$HHV_{k3}=f[\text{fuel chemistry}(\vec{\Lambda})]$, means that $HHV_{k3}$ is a function of fuel chemistry (which in-turn is a function of the vector $\vec{\Lambda}$).

$C_i$=Correction factor to be applied to an initial Choice Operating Parameter i; see Eqs.(211S) through (220) for nomenclature, e.g., $C_{1S}$ is the correction factor for Stack $CO_2$ as referring to Eq.(211S), etc.; unitless.

$HHV_{k3}$=Higher heating value as used by the minimization techniques as a System Effect Parameter, here subscript k3 refers to either an uncorrected As-Fired ($HHV_{AF}$), Dry or MAF heating value; $Btu/lbm_{AF}$, $Btu/lbm_{DRY}$ or $Btu/lbm_{MAF}$.

$HHV_{k3\text{-}Ref}$=Higher heating value used as a Reference System Effect Parameter; $Btu/lbm_{AF}$, $Btu/lbm_{DRY}$ or $Btu/lbm_{MAF}$.

$J_0$=Bessel function of the first kind of order zero.

$J_1$=Bessel function of the first kind of order one.

$L_{CO2}$=L Factor for dry effluent $CO_2$ used by the minimization techniques as a System Effect Parameter; (lbm effluent $CO_2$)/million-$Btu_{Fuel}$.

$L'_{Fuel}$=L Factor for dry gaseous effluents used by the minimization techniques as a System Effect Parameter; (lbm dry gaseous effluent)/million-$Btu_{Fuel}$.

$L_{k1}$=Generic L Factor, here subscript k1 refers to either $L'_{Fuel}$ or $L_{CO2}$.

$L_{CO2\text{-}Ref}$=L Factor for dry effluent $CO_2$ used as a Reference System Effect Parameter; (lbm effluent $CO_2$)/million-$Btu_{Fuel}$.

$L'_{Fuel\text{-}Ref}$=L Factor for dry gaseous effluents used as a Reference System Effect Parameter; (lbm dry gaseous effluent)/million-$Btu_{Fuel}$.

$m_{AF}$=Fuel flow rate, an As-Fired mass flow quantity (i.e., wet with water and fuel mineral matter), as may be computed by Input/Loss methods; also may be used by minimization techniques as a System Effect Parameter; $lbm_{AF}$/hour.

$m_{AF\text{-}PLT}$=The system's measured fuel flow, an As-Fired quantity (i.e., wet with water and fuel mineral matter), also termed the system's "indicated fuel flow"; also may be used as a Reference System Effect Parameter; $lbm_{AF}$/hour.

$m_T$=Tube leakage flow rate; i.e., mass flow rate of water in-leakage entering the combustion gas path from leaks in a heat exchanger, a Choice Operating Parameter; lbm/hour.

$M_L$=Dilution Factor applied to System Effect Parameter $L_{k1}$; $M_L$>0.0; unitless.

$M_W$=Dilution Factor applied to System Effect Parameter $m_{AF}$; $M_W$>0.0; unitless.

$M_H$=Dilution Factor applied to System Effect Parameter $HHV_{k3}$; $M_H$>0.0; unitless.

$M_T$=Dilution Factor applied to System Effect Parameter $WF_{H2O}$; $M_T$>0.0; unitless.

$S_i$=Scaling factor for the independent variable $x_i$; reciprocal units of measure of $\Lambda_i$.

$s_i$=Pre-scaling factor used to adjust $S_i$; unitless.

$WF_j$=As-Fired fuel mass fraction of substance j; fraction.

$WF_{H2O}$=As-Fired fuel water mass fraction (also termed $WF_2$), used as a System Effect Parameter; fraction.

$WF_{H2O\text{-}Ref}$=Reference As-Fired fuel water mass fraction used by the minimization techniques as a Reference System Effect Parameter; fraction.

$\vec{x}$=Vector of independent variables, $\vec{x}=(x_1, x_2, x_3, \ldots)$, as based on scaled Choice Operating Parameters (not to be confused with the term for moles of As-fired fuel, x); unitless.

$\Lambda_i$=Choice Operating Parameter i, see the specific parameter for units of measure, and Eqs.(211S) through (220) for definitions.

$\vec{\Lambda}$=Vector of Choice Operating Parameters, which is user selected; for example, one selection might include: $\vec{\Lambda}=(\Lambda_{1S}, \Lambda_{2S}, \Lambda_3, \Lambda_6, \Lambda_{7B}, \Lambda_9)$; see Eqs.(211S) thru (220).

$\Lambda_{0-i}$=Initial Choice Operating Parameter i, before application of a minimization technique and based on the system's raw instrumentation signal, a previous converged solution, an estimate, and/or as otherwise obtained.

$\Lambda_{F-i}$=Converged (final) Choice Operating Parameter i, after application of a minimization technique to $\Lambda_{0-i}$; and, thus corrected and applicable to all system thermal analyses.

Quantities Related to System Terms:

AF=Air/Fuel ratio defined by indicated air flow and $m_{AF-PLT}$; unitless mass ratio.

BBTC=Energy flow to the working fluid from combustion gases (w/o tube leakage); Btu/hr.

$C_p$=Heat capacity; Btu/lbm-R.

$h_j$=Specific enthalpy of substance j; Btu/lbm.

HBC≡Firing Correction; Btu/$lbm_{AF}$.

HHVP=As-Fired higher heating value, based on $HHV_{AF}$ and used in system evaluations as corrected for a constant pressure process; Btu/$lbm_{AF}$.

HNSL≡Non-Chemistry & Sensible Heat Losses; Btu/$lbm_{AF}$.

$HPR_{Act}$≡Enthalpy of Products from actual combustion (HHV- or LHV-based); Btu/$lbm_{AF}$.

$HPR_{Ideal}$≡Enthalpy of Products from ideal combustion associated with an obtained heating value at $T_{Cal}$ (HHV- or LHV-based); Btu/$lbm_{AF}$.

$HRX_{Act}$≡Enthalpy of Reactants associated with actual firing conditions (HHV- or LHV-based); Btu/$lbm_{AF}$.

$HRX_{Cal}$≡Enthalpy of Reactants associated with an obtained heating value at $T_{Cal}$ (HHV- or LHV-based); Btu/$lbm_{AF}$.

HR=System heat rate (HHV-based, $HR_{HHV}$; or LHV-based, $HR_{LHV}$); Btu/kWh.

HSL≡Stack Losses (HHV- or LHV-based); Btu/$lbm_{AF}$.

$LHV_{AF}$=Lower heating value based on the measured or calculated higher heating value ($HHV_{AF}$); Btu/$lbm_{AF}$.

LHVP=As-Fired lower heating value, based on $LHV_{AF}$ and used in system evaluations as corrected for a constant pressure process; Btu/$lbm_{AF}$.

$m_T\Delta h$=Energy flow from tube leakage; Δh is the enthalpy difference between the last heat exchanger effected by the leakage (typically the Final Superheater or Reheater) and the heat exchanger producing the leakage; Btu/hr.

$P_{Amb}$≡Ambient pressure local to the system, psiA.

$Q_{SAH}$=Energy flow delivered to steam/air heaters, Btu/hr.

T=Temperature; F.

$T_{Amb}$≡Ambient temperature local to the system, F.

$T_{Cal}$≡Calorimetric temperature to which heating value is referenced, F.

$T_{Stack}$≡Boundary temperature of the system effluents, defines the "Stack"; F.

$W_{FD}$=Brake power associated with in-flow stream fans (e.g., Forced Draft fans); Btu/hr.

$W_{ID}$=Brake power associated with out-flow stream fans (e.g., Induced Draft fans); Btu/hr.

$W_{output}$=Gross power generated from a power plant; kWe.

$\eta_{SYS}$=System efficiency (HHV-based, $\eta_{SYS-HHV}$; or LHV-based, $\eta_{SYS-LHV}$); unitless $\eta_B$=Boiler efficiency (HHV-based, $\eta_{B-HHV}$; or LHV-based, $\eta_{B-LHV}$); unitless.

$\eta_C$=Combustion efficiency (HHV-based, $\eta_{C-HHV}$; or LHV-based, $\eta_{C-LHV}$); unitless.

$\eta_A$=Boiler absorption efficiency; unitless.

Subscripts and Abbreviations:

Act=Actual value obtained from the operating thermal system.

AF=As-Fired fuel at the thermodynamic boundary (i.e., wet with water and inert matter).

BL=Black liquor fuel.

DRY=Dry chemical base (i.e., free of water).

MAF=Moisture-Ash-Free chemical base (i.e., free of water and free of inert matter).

Ref=Reference value.

T=Tube failure associated with a heat exchanger leakage.

theor=Refers to conditions associated with theoretical combustion.

Meaning of Terms

The words "Operating Parameters", as taken within the general scope and spirit of the present invention, mean common data obtained from a thermal system applicable to the thermodynamic understanding of that system. The following quantities may be included in the definition of Operating Parameters, they are not encompassing but considered typical of a minimum set of data required for such thermodynamic understanding: effluent $CO_2$, $O_2$, and $SO_2$ concentrations determined at the Stack, or before the air pre-heater (Boiler side of the air pre-heater); the mass, wet-base ratio of the indicated combustion air flow at the system's fuel combustors, to the system's indicated fuel flow, termed $AF_{Act}$ (note that $AF_{Act}$ is obtained only for the determination of inerts as taught in '994); effluent $H_2O$ concentration measurement, or assumptions made (or as otherwise may be determined); effluent temperature measurement, that is the average temperature associated with the combustion gases at the system boundary (caution must be exercised in measuring non-stratified gas flows); the inlet/outlet ratio of $CO_2$ (producing $R_{Act}$ as is preferred), CO or $O_2$ (producing $R'_{Act}$) across the air pre-heater where these ratios could be obtained on-line, off-line, based on periodic testing or judgement which are used for the determination of air pre-heater leakage; determination of fuel temperature at an appropriate system boundary; air psychrometric measurements, or as otherwise determined, at the system boundary (e.g., dry and wet bulb temperatures, or dry bulb and relative humidity, or dry bulb and dew point temperatures); quantities comprising the system's Firing Correction term, HBC; the discharge temperatures of the air as it exits each air heating or cooling device but before it reacts with the fuel (for example, such devices might include the air pre-heater, forced-draft fan, steam-to-air heater, etc.); the total energy flow deposition to the working fluid from the combustion gases (in typical units of measure of Btu/hr); and similar quantities. Regards the total energy flow deposition, for a typical recovery boiler, such measurements typically include feedwater flow to the steam generator, feedwater pressure and temperature, determination of the steam flow from the steam generator if different than the feedwater flow, steam pressure, steam temperature or quality (or assumed quality), and, if applicable, reheat flows, and reheat inlet and outlet pressures and temperatures. If employing a Reheater heat exchanger, determination of accurate reheat flows generally requires understanding of steam turbine flow distributions (involving high pressure turbine shaft seals, steam flows to feedwater heaters, turbine bypass leakages, attemperation spray flows and the like). The total realizable energy flow (BBTC−$m_T\Delta h$) includes the effects of tube leakage flow rate, determined by this invention, as assigned to a particular heat exchanger. Specifically, when having determined there is a tube leak, the leaking heat exchanger's outlet flow of working fluid is reduced by the tube leakage, thus reducing the energy flow BBTC by $m_T\Delta h$.

The words "Choice Operating Parameters", as taken within the general scope and spirit of the present invention, mean any sub-set of Operating Parameters which directly impact system stoichiometrics, and thus may impact the determination of fuel chemistry. This invention assumes that Choice Operating Parameters may have error, said error may adversely effect the determination of fuel chemistry, but said error may be corrected as taught herein through optimization methods. In the Preferred Embodiment Choice Operating Parameters are selected by the user of this invention from an available set. This available set of Choice Operating Parameters includes the following ten: 1) effluent $CO_2$ concentration measured at the Stack or Boiler; 2) $H_2O$ concentration measured, or as otherwise may be determined, at the Stack or Boiler; 3) the mass, wet-base ratio of the indicated combustion air flow at the system's fuel combustors, to the system's indicated fuel flow, the Air/Fuel ratio termed $AF_{Act}$; 4) the Air Pre-Heater Leakage Factor, termed $R_{Act}$; 5) the concentration of $O_2$ in the combustion air local to the system, or as otherwise determined, termed $A_{Act}$ (leading to the determination of $\phi_{Act}$); 6) the system's indicated limestone mass flow rate, termed $m_{LS}$; 7) effluent $O_2$ concentration measured at the Stack or Boiler; 8) mass flow rate associated with a heat exchanger tube leakage flow rate, termed $m_T$; 9) Sodium to Carbon ratio found in the fuel ($\Phi_N$); and 10) the Reduction Efficiency ($\Phi_R$).

The words "Reference Fuel Characteristics", as taken within the general scope and spirit of the present invention, mean the identification and development of intrinsic chemical relationships which allow resolution of fuel chemistry. Discussions of Reference Fuel Characteristics are presented in Paragraphs 0048 through 0058. For the Preferred Embodiment, Reference Fuel Characteristics include an average or typical fuel chemistry and associated MAF heating value, preferably based on historical data collections of ultimate analyses of the fuel's elemental composition, with fuel water and fuel inerts (typically reported as weight fractions summing to unity, leading to $\alpha_k$ molar fractions), herein termed fuel chemistry constituents. If ultimate analyses are not available they may be approximated from proximate analyses as taught in Gill's text (cited below, not preferred). Reference Fuel Characteristics typically include a fuel hydrogen versus fuel carbon relationship, typically a MAF relationship; a relationship based on historical data. Reference Fuel Characteristics may also include relationships of: MAF oxygen versus MAF carbon; MAF sulfur versus MAF carbon; MAF potassium versus MAF sodium; and MAF chlorine versus MAF sodium. Reference Fuel Characteristics may also include the computed values of $L'_{Fuel\text{-}Ref}$ and $L_{CO2\text{-}Ref}$, computed using the reference fuel chemistry. For black liquor fuel Reference Fuel Characteristics may also include the variables $\Phi_R$, $\Phi_S$ and $\Phi_N$. Reference Fuel Characteristics may also include whether the variability of fuel water and fuel inert fractions in the As-Fired condition is predictable, or not. For any given fuel: fuel water may be held constant (including zero); fuel inerts may be held constant (including zero); functionalities may be observed and applied, for example, $\alpha_{MAF\text{-}10}=f(HHV_{MAF})$, and/or fuel water and/or fuel inerts may be treated as unknowns). The Preferred Embodiment for black liquor fuels is to treat fuel water as an unknown, and fuel inerts as a constant. All of these possible variations for the treatment of fuel carbon, fuel sodium, water and inerts may be included as a portion of Reference Fuel Characteristics. Reference Fuel Characteristics may also contain fitting constants associated with all correlations relating dependent fuel quantities to independent fuel quantities, typically the principle independent fuel quantity is fuel carbon. When applying the Preferred Embodiment of this invention, Reference Fuel Characteristics also contain reasonability limits (i.e., numerical minimum and maximum limits) of the following: computed fuel elemental constituents; fuel water fraction; fuel inert fraction; the correction factors being applied to initial Choice Operating Parameters; the maximum rates of change of these parameters; and the maximum rates of change of any or all of the selected Choice Operating Parameters. Such minimum and maximum limits are preferably based on engineering judgement supported by historical data collections of ultimate analyses of the fuel, historical experience of instrumentation on which the selected Choice Operating Parameters are based, and historical records of computed correction factors to the initial Choice Operating Parameters, termed $\Lambda_{0\text{-}i}$.

The words "System Effect Parameters", as taken within the general scope and spirit of the present invention, mean any parameter of the thermal system or its fuel which directly impact the determination of system efficiency. In the most general sense System Effect Parameters include any parameter used in Eq.(331A), (331B), (332A) or (332B) which compute system heat rate and thus system efficiency. For the Preferred Embodiment, System Effect Parameters include the following four types of quantities: the L Factor (either $L'_{Fuel}$ or $L_{CO2}$); the computed As-Fired fuel flow rate ($m_{AF}$); the higher heating value (either $HHV_{AF}$, $HHV_{DRY}$ or $HHV_{MAF}$); and the As-Fired fuel water faction ($WF_{H2O}$) which may be used to convert $HHV_{DRY}$ to $HHV_{AF}$. The computed L Factor effects fuel chemistry which effects heating value and boiler efficiency, thus has an immediate impact on system efficiency. "Reference System Effect Parameters" are constant and targeted (i.e., desired) System Effect Parameters to which the System Effect Parameters are numerically driven by the minimization techniques through optimizing a selection of Choice Operating Parameters.

The words "Input/Loss methods", as taken within the general scope and spirit of the present invention, mean any method or combination of methods in which one or more of the following parameters is determined based on Operating Parameters and a selection of Choice Operating Parameters: fuel flow, effluent flow, emission rates, fuel chemistry, fuel heating value, boiler efficiency, and/or system efficiency. In addition to '994, '429, '563, '879, '035 and '932, and their related provisional patent applications and Continuation-In-Parts, Input/Loss methods include the methods of '470 and '420. The words "The Input/Loss Method" refers specifically to the collection of technologies described in '994, '429, '879, '035 and '932, and in '563 as it teaches the L Factor, and to any relevant provisional patent applications and Continuation-In-Parts, in addition to the teachings disclosed herein.

As used herein, the words "Calculational Engine" refers to a computer in which software descriptive of The Input/Loss Method is installed.

As used herein, if used, the words "obtain", "obtained", "obtaining", "determine", "determined", "determining", "determination", "establish", "established" or "establishing" are defined as measuring, calculating, computing, assuming, estimating or gathering from a database.

As used herein, the words "monitoring" or "monitored" are meant to encompass both on-line monitoring (i.e., processing system data in real time) and off-line monitoring (i.e., computations involving static data). A "monitoring cycle" is meant one execution of the processes described in FIG. 2, which encompasses FIG. 3.

As used herein, the meaning of the words "smoke Stack" or "Stack" or "system boundary" are defined as the physical boundary of the thermal system where gaseous combustion effluents exit, entering the local environment; refer to 42 in FIG. 1, further discussed within THE DRAWINGS. Solid effluents not leaving the Stack (e.g., molten smelt 37) are referenced to the generic system's boundary 44 in FIG. 1.

As used herein, the meaning of the words "Boiler" or "Boiler Effluent" are defined as the region 35 in FIG. 1, or generically between the physical exit of the system's region 34 in FIG. 1 and entrance to its air pre-heater 36 in FIG. 1; see THE DRAWINGS.

Figure 2A:
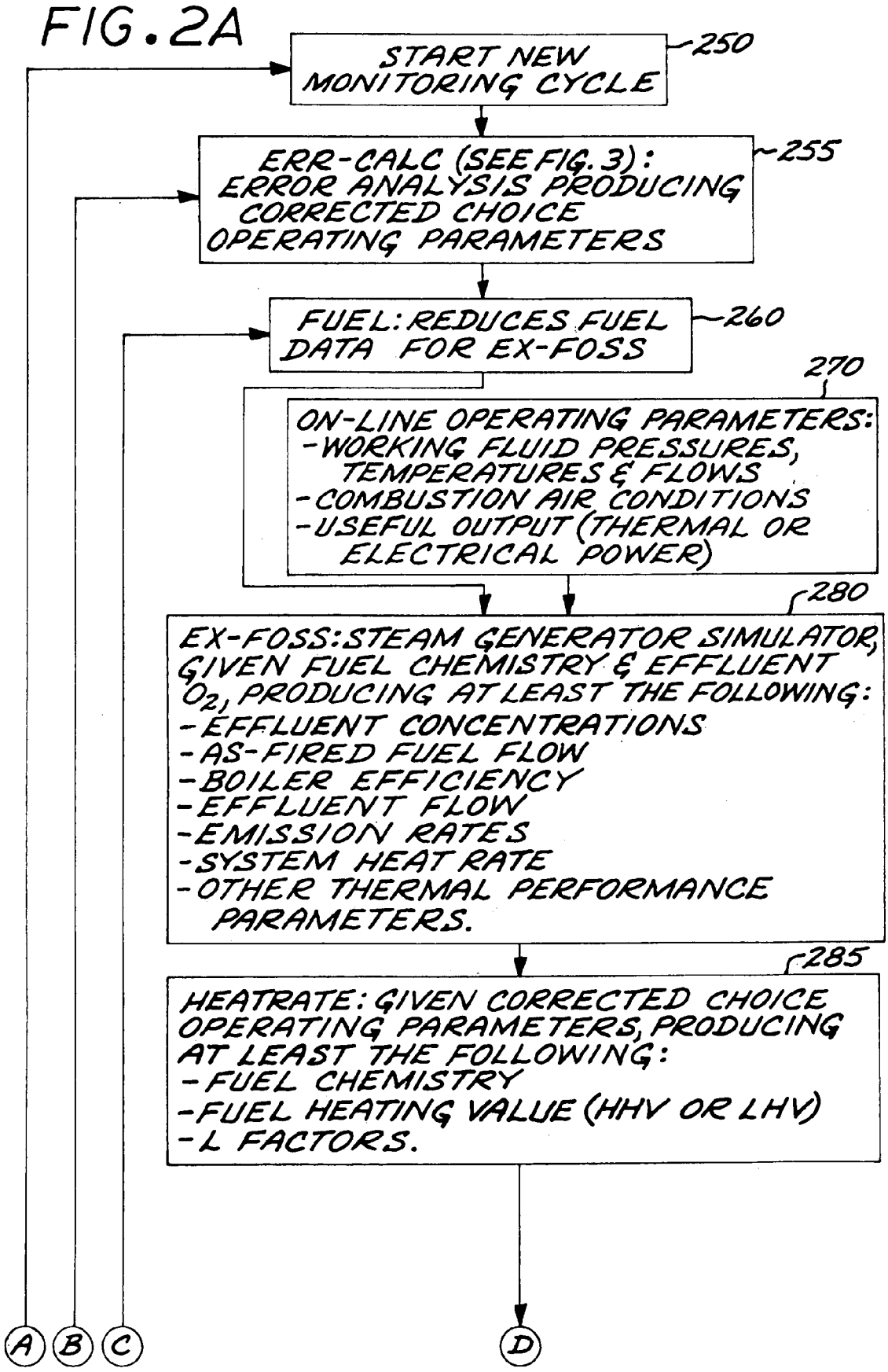
FIGS. 2A and 2B is a block diagram of the general interactions and functions of the computer programs ERR-CALC, FUEL, EX-FOSS and HEATRATE used to implement this invention; herein collectively referred to as FIG. 2.
Figure 2B:
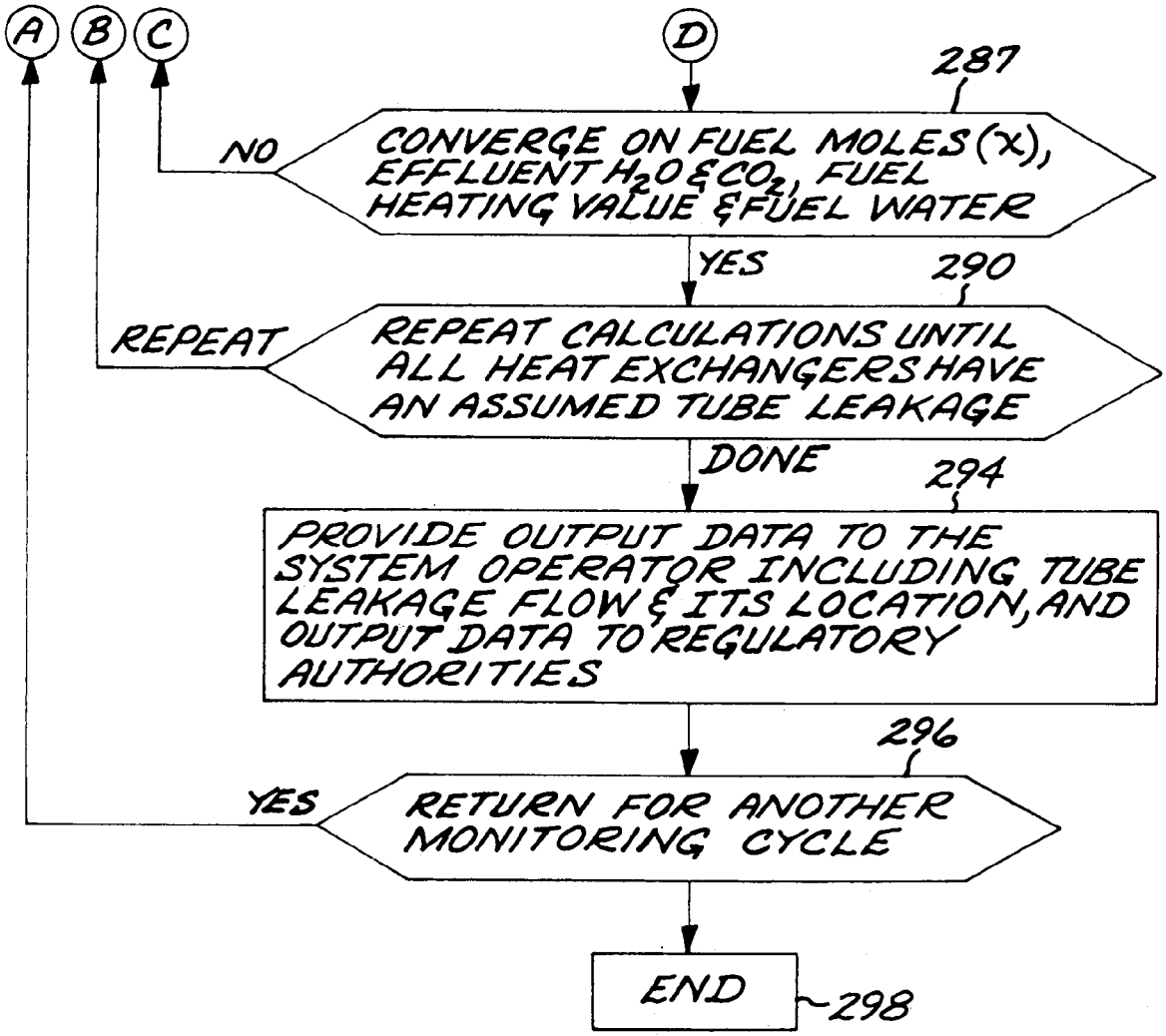

As used herein, the meaning of the words "Fuel Iterations", are defined in conjunction with a detailed description of FIG. 2 found within THE DRAWINGS, said Fuel Iterations specifically refers to items 260, 270, 280, 285 and 287 of FIG. 2.

As used herein, the meaning of the word "indicated" when used in the context of data originating from the thermal system is defined as the system's actual and uncorrected measurements of a physical process (e.g., pressure, temperature, mass flow, volumetric flow, density, and the like) whose accuracy or inaccuracy is not assumed. As examples, a system's "indicated fuel flow" or its "indicated limestone flow" denote system measurements the accuracy of which is unknown (they are "as-is", with no judgement applied). Such indicated measurements are said to be either correctable or not. If not correctable, it may be that the associated computed value from Input/Loss methods tracks the indicated value over time (the indicated not being corrected per se). In the case of indicated limestone flow when used as a Choice Operating Parameter ($\Lambda_6$), it is directly corrected as taught by this invention. In the case of indicated fuel flow when used as a System Effect Parameter, it may be shown that the computed fuel flow, $m_{AF}$, tracks the indicated fuel flow, $m_{AF\text{-}PLT}$, through adjustment of the Dilution Factor $M_W$.

As used herein, the meaning of the words "Reduction Efficiency" is defined by the variable $\Phi_R$; the meaning of "Sulfur to Smelt ratio" is defined by the variable $\Phi_S$; and the meaning of "Sodium to Carbon ratio" in the fuel by the variable $\Phi_N$.

System Stoichiometrics

Any study of the combustion of fossil fuels necessitates the formulation and use of a combustion equation. Combustion equations used by several Input/Loss methods are described in '470, '420 and '994 by their designated Eq.(29), in '429 by its Eq.(19), in '879 by its Eq.(19-corr), and in '035 and '932 by their Eq.(19B). This invention's methods are taught through a combustion equation defined by Eq.(19BL) herein. Through Eq.(19BL) stoichiometric terms are self-defined, including the use of the $b_T$ term important to this invention and inclusion of fuel components typically found in recovery boilers (hydrocarbons, sodium, potassium and chlorine). Eq.(19BL)'s nomenclature is unique in that brackets are used for clarity: for example, the expression "$x\alpha_2[H_2O]$" means the moles of fuel water/base, algebraically simply $x\alpha_2$; the expression "$\sigma_N x\alpha_{14}[Na_2]$" means the moles of fuel diatomic sodium/base, algebraically simply $\sigma_N x\alpha_{14}$; the expression "$(d-\sigma_N k_{BL})_{Act}[CO_2]$" means the effluent moles of carbon dioxide/base, algebraically simply $(d-\sigma_N k_{BL})_{Act}$ which defines the term $D_{Act}$; etc. The stoichiometric base of Eq.(19BL) is 100 moles of dry Stack gas (i.e., at the thermodynamic boundary). Also, note that in combustion equations such as Eq.(19BL) describing commercial recovery boilers, that the assumption is typically made of possible extraneous water leakage into, and mixing with, the products of combustion. The flow of such water is assumed known (either measured or otherwise reasonably estimated) and is denoted by the symbol $b_Z$. It is common industrial practice in the United States to use this symbol, $b_Z$, to denote the quantity of known water in-leakage such as steam used to atomize fuel, water used for soot blowing, etc. Such $b_Z$ in-leakage is apart from water formed from combustion of hydrocarbon fuels, the $x\alpha_5$ term; apart from free water born by the fuel, $x\alpha_2$; apart from moisture carried by the combustion air and air pre-heater leakage, $(1.0+\beta)b_A$; and apart from tube leakage, the $b_T$ term.

$$
\begin{aligned}
&x[\alpha_1[N_2]+\alpha_2[H_2O]+\alpha_3[O_2]+\alpha_4[C]+ \qquad (19BL)\\
&\quad \alpha_5[H_2]+\alpha_6[S]+\alpha_{10}[\text{Inert}]+\sigma_N\alpha_{14}[Na_2]+\\
&\quad \sigma_N\alpha_{15}[K_2]+\sigma_N\alpha_{16}[Cl]]_{As-Fired\ Fuel}+\\
&\quad b_Z[H_2O]_{In-Leakage}+b_T[H_2O]_{Tube-Leakage}+\\
&\quad [(1.0+\beta)(a[O_2]+a\phi_{Act}[N_2]+b_A[H_2O])]_{Air}=\\
&(d-\sigma_N k_{BL})[CO_2]+(g+2\sigma_N T_{NS}+\sigma_N k_{BL}/2)[O_2]+\\
&\quad h[N_2]+j[H_2O]+x\alpha_{10}[\text{Inert}]+e_{Act}[CO]+m_{Act}[NO]+\\
&\quad \sigma_N(T_{NO}+k_{BL})(Na_2CO_3]+\sigma_N T_{KO}[K_2CO_3]+\\
&\quad \sigma_N T_{NA}[Na_2SO_4]+\sigma_N T_{NS}[Na_2S]+\sigma_N T_{NC}[NaCl]+\\
&\quad \sigma_N k_{BL}[SO_2]+(1.0-\sigma_N)x\alpha_6[SO_2]+v[C_{Refuse}]+\\
&\quad [\beta(a[O_2]+a\phi_{Act}[N_2]+b_A[H_2O])]_{Ait\ Leakage}
\end{aligned}
$$

Resolution of Eq.(19BL) is had when all $n_i$ and $n_{ii}$ quantities have been determined. Minor component terms of Eq.(19BL) are typically resolved either through direct measurement (e.g., for CO and NO), or assume zero values, or through obtained relationships. All Minor Components typically have only low parts-per-million concentrations thus have little impact. An exception to this is the v term describing refuse carbon found in the smelt. The true importance and functionality of Eq.(19BL) to The Input/Loss Method lies in the fact that consistency of molar balances is needed for successful system understanding, for conservation of mass flows and for resolution of fuel chemistry, these needed for detection of tube failures. For clarity the following major terms are associated with system stoichiometrics:

Total effluent (boundary) water$\equiv J_{Act}=j+b_A\beta$

Boiler oxygen before air leakage $(g'_{Act})\equiv R_{Act}(g+2\sigma_N T_{NS}+\sigma_N k_{BL}/2)$ Total effluent (boundary) oxygen$\equiv G_{Act}=(g+2\sigma_N T_{NS}+\sigma_N k_{BL}/2)+a\beta$ Total effluent (boundary) carbon dioxide$\equiv D_{Act}=(d-\sigma_N k_{BL})$ Total effluents referenced to the boundary$=\Sigma n_i+\Sigma n_{ii}+\beta(a+a\phi_{Act}+b_A)$ Total effluents before air leakage, referenced upstream of the air pre-heater$=R_{Act}\Sigma n_i+R_{Act}\Sigma n_{ii}$ Dry combustion air without air leakage referenced to the boundary$=(a+a\phi_{Act})$ Wet combustion air without air leakage referenced to the boundary$=(a+a\phi_{Act}+b_A)$ Dry air from air leakage found at the boundary=$\beta(a+a\phi_{Act})$ Total wet combustion air and air leakage found at the boundary=$(1.0+\beta)(a+a\phi_{Act}+b_A)$.

Eq.(19BL) is unique in describing at least three features of critical importance when determining fuel chemistry using one of the Input/Loss methods. The critical features include: 1) its ability to address air pre-heater leakage through application of the Air Pre-Heater Leakage Factor, $R_{Act}$, and through the Air Pre-Heater Dilution Factor, $\beta$; 2) the ability to describe effluent concentrations on either side of the air pre-heater, again through application of $R_{Act}$; and 3) the use of an explicit $\phi_{Act}$ term allowing for variable $O_2$ concentration in the system's local combustion air. Air pre-heater leakage dilutes all combustion effluents with moist air from the local environment, thus all important effluents $H_2O$, $CO_2$ and $O_2$ used for this invention are altered. Furthermore, many times, although not always, a power plant's more precise effluent measurements may be found on the air pre-heater's inlet (economizer outlet or Boiler), and not at the air heater outlet (or Stack); refer to FIG. 1. Although most environmental regulation requires effluent measurements at the system's boundary, translation between the air heater inlet and outlet measurements is many times essential. Eq.(19BL) allows for such translation through the $R_{Act}$ term, defined above such that 100 moles of dry gas are computed both at the upstream and downstream locations of the air pre-heater; see "Boiler" of FIG. 1. Thus effluents may be used by the present invention either upstream or downstream of the air pre-heater; refer to the $G_{Act}$ and $J_{Act}$ terms defined above, allowing conversion between measurements with and without air leakage. For example, combustion gas conditions for oxygen and water upstream of the air pre-heater and after exiting the heat exchangers and combustion region, see FIG. 1, would employ the terms: $(g+2\sigma_N T_{NS}+\sigma_N k_{BL}/2)R_{Act}$ and $jR_{Act}$. That is, one would actually measure $(g+2\sigma_N T_{NS}+\sigma_N k_{BL}/2)R_{Act}$ moles of dry $O_2$ upstream of the air pre-heater and after exiting the heat exchangers and combustion region as based on 100 moles of dry gas found at that location. As a further example, the moles of dry air found upstream of the air pre-heater is given by: $R_{Act}a(1.0+\phi_{Act})$. Combustion gases downstream of the air pre-heater typically exit the system to the environment (i.e., Stack), in other words the gaseous effluent boundary of the system (100 moles of dry gas at the Stack includes air leakage). If limestone is injected into the combustion process to control effluent $SO_2$ it will create additional effluent $CO_2$; further, it could decrease the effluent $H_2O$ if the sulfate product is matrixed with water, $CaSO_4.zH_2O$. Thus such effects must be considered, and are taught in '994 referenced herein. Although the specific use of limestone is taught in '994 it is not included herein for clarity of presentation. Of course $CO_2$ and $H_2O$ are two important effluents to the present invention. In addition to the basic stoichiometrics afforded, Eq.(19BL) allows numerous and obvious determinations of molar and mass ratios.

Based on these teachings and those presented in '994, the following further explains the importance of the Air Pre-Heater Leakage Factor, $R_{Act}$, and the Air Pre-Heater Dilution Factor, $\beta$, their definitions and developments. Consider that air in-leakage associated with a fossil-fired system, and as commonly associated with in-leakage at the system's air pre-heater, is defined by the American Society of Mechanical Engineers' Performance Test Code 4.3 (1974) as the moist air leakage divided by the wet combustion gas. Typically the wet combustion gas is taken at the gas inlet of the air pre-heater (i.e., Boiler, or economizer outlet before the air pre-heater). That is, as defined herein using Eq. (19BL) nomenclature, noting that 100 moles of dry gas is the bases at the Boiler, is given by:

$$\text{Wet } APH \text{ Leakage} \equiv \frac{R_{Act}\beta(a+a\phi_{Act}+b_A)N_{MoistAir}}{(100+R_{Act}j)N_{WetGas}} \tag{20}$$

where, as defined above:

$R_{Act}$=(Moles of $CO_2$ entering the air pre-heater)/(Moles of $CO_2$ leaving the air pre-heater).

The expression for $R_{Act}$ is equivalent to [Moles of Boiler $CO_2$] divided by [Moles of Stack $CO_2$]. The Air Pre-Heater Dilution Factor is then developed by performing a total dry gaseous effluent molar balance at the Stack:

$$100 \text{ moles dry gaseous effluent at Stack}=\Sigma n_i+\beta(a+a\phi_{Act}) \tag{21}$$

then solving for $\beta$: $\beta=(100-\Sigma n_i)/(a+a\phi_{Act})$. The stoichiometric base of Eq.(19BL) implies that 100 moles of dry gaseous effluent upstream of the air pre-heater (Boiler) is given by $R_{Act}\Sigma n_i$, see FIG. 1; therefore:

$$\begin{aligned}\beta &= (100-100/R_{Act})/[a(1.0+\phi_{Act})] \\ &\equiv 100(R_{Act}-1.0)/[R_{Act}a(1.0+\phi_{Act})].\end{aligned} \tag{22}$$

If, instead of obtaining the ratio of $CO_2$ across the air pre-heater, the ratio of $O_2$ is obtained and, following the teachings herein and those of '994, the following may then be developed:

$R'_{Act}$=(Moles of $O_2$ entering the air pre-heater)/(Moles of $O_2$ leaving the air pre-heater).

where, converting from $R'_{Act}$ to $R_{Act}$, using algebraic manipulations results in, when measuring Stack $O_2$:

$$R_{Act} \equiv \frac{100-R'_{Act}G_{Act}(1.0+\phi_{Act})}{100-G_{Act}(1.0+\phi_{Act})} \tag{23}$$

If measuring Boiler $O_2$ (for Eq.(24) termed $g'_{Act}$):

$$R_{Act} \equiv \frac{100R'_{Act}-R'_{Act}g'_{Act}(1.0+\phi_{Act})}{100R'_{Act}-g'_{Act}(1.0+\phi_{Act})} \tag{24}$$

There are, of course, a number of variations to these formulations, such as employing 100 moles of wet effluents at the Stack, thus replacing Eq.(21) with:

$$100 \text{ moles wet effluent at Stack}=(\Sigma n_i+j)+\beta(a+a\phi_{Act}+b_A) \tag{25}$$

or using an oxygen base for the wet effluents at the Stack, thus: $(\Sigma n_i+J_{Act})/a+\beta(1.0+\phi_{Act})$; or using a combustion equation which is based on a mole of fuel carbon ($x\alpha_4$); etc. What is important to this invention, important to The Input/Loss Method, and important to any of the Input/Loss methods, is that the Air Pre-Heater Leakage Factor ($R_{Act}$) allows gaseous measurements to be employed on either side of the system air in-leakage. Typically, but not always, $O_2$ is measured in the combustion gas stream inlet to the air pre-heater (Boiler), while $CO_2$ is measured at the Stack (downstream from the air pre-heater).

Operators of recovery boilers will commonly determine certain intrinsic fuel and effluent ratios which assist in understanding the performance of the combustion process, i.e., performance ratios. Such ratios are determined through periodic fuel analysis, and analysis of the combustion residuals (also termed "smelt" for recovery boilers). Smelt is defined as the molten inorganic compounds leaving the furnace after combustion; using Eq.(19BL) nomenclature it consists of: $x\alpha_{10}$, $\sigma_N(T_{NO}+k_{BL})$, $\sigma_N T_{KO}$, $\sigma_N T_{NA}$, $\sigma_N T_{NS}$, $\sigma_N T_{NC}$ and v. Common performance ratios include: the Reduction Efficiency ($\Phi_R$); the Sulfur to Smelt ratio ($\Phi_S$); and the Sodium to Carbon ratio in the fuel ($\Phi_N$). Reduction Efficiency judges the ability of the combustion process to further reduce $Na_2SO_4$. For theoretical combustion, $\Phi_R$=0.0; for complete reduction of $Na_2SO_4$, $\Phi_R$=1.0. The Sulfur to Smelt ratio is employed in the Preferred Embodiment of this invention. The Sodium to Carbon ratio in the fuel is a key parameter, determined periodically by laboratory analysis, as it allows stoichiometric inter-dependency between the organic and inorganic fuel components. Other such parameters may be formed which are similar to the $\Phi_N$ ratio. As taught herein, what is required is some defined or otherwise obtained dependency between the organic and inorganic fuel compounds if fuel chemistry is to be determined based on gaseous effluent and smelt measurements. Although the Preferred Embodiment of this invention employs the $\Phi_N$ ratio, on-line measurements of the As-Fired fuel and/or on-line measurements of the smelt could prove as useful as the $\Phi_N$ ratio, and/or otherwise aid in its determination.

After establishing system stoichiometrics, the next stage of the process involves the recognition that a given fuel has an unique chemical composition, thus when burned will yield unique concentrations in its gaseous effluent. The gaseous effluent concentrations are used to compute fuel chemistry, with this chemistry heating value and boiler efficiency are computed, in turn this information allows the detection of tube failures and their location. However, key to this invention is that its methods recognize that gaseous effluent concentrations are not accurate and require correction to achieve stoichiometric consistency. The gaseous effluents from any fossil combustion process, including black liquor combustion, are $N_2$, $CO_2$, $H_2O$, $O_2$ and $SO_2$. $H_2O$, when effluent from combustion, is in its superheated phase, thus acting as a gas. The source of $N_2$ is principally the air used to burn the fuel and has little chemical reactiveness, thus its sensitivity to the fuel's chemical composition is not significant. $SO_2$ effluent concentrations are generally in the parts per million thus its impact has minor importance. $SO_2$ effluent is formed from either $Na_2SO_4$ reduction or, if burning a pure hydrocarbon, directly from fuel sulfur $(1.0-\sigma_N)x\alpha_6$.

As an intrinsic chemical relationship, the relative concentrations of carbon, $\alpha_4$, and hydrogen, $\alpha_5$, found in any fossil fuel will have significant impact on the relative concentrations of $CO_2$ and $H_2O$ found in the effluent. In addition, these effluents will be influenced by the following: $O_2$ used to burn the fuel (i.e., the Air/Fuel ratio); fuel water, $\alpha_2$; in-leakage of water including tube leaks; and water in the combustion air. This implies that the molar fractions of $CO_2$, $H_2O$ and $O_2$ present in the effluent (the system's boundary, i.e., its smoke stack or translated from air pre-heater inlet data) must be unique relative to the supplied fuel and supplied combustion air.

The following elemental molar balances may be derived from the combustion equation, Eq.(19BL). The $\Gamma_k$ expressions are simply convenient groupings of quantities, principally comprising measured effluents (known values) which have the greatest influence on the individual elements of interest. Minor fuel terms, $\alpha_{MAF\text{-}j}$, carried within $\Gamma_k$ expressions are multiplied, initially, by an estimated fuel moles, $x_{MAF}$. These minor terms are quickly resolved when converging on $x_{MAF}$. Given these groupings, the $\Gamma_k$ expressions of Eqs.(36) through (41), with solution of the moles of combustion oxygen (the term "a") as discussed below, may be treated as known quantities. The elemental wet fuel components typically associated with black liquor fuels are considered unknowns, as are the fuel moles, these include the following: $\alpha_1$, $\alpha_2$, $\alpha_3$, $\alpha_4$, $\alpha_5$, $\alpha_6$, $\alpha_{10}$, $\alpha_{14}$, $\alpha_{15}$, $\alpha_{16}$ and x. Many recovery boilers use supplementary firing with gaseous fuel such as methane or fuel oil. Inclusion of such fuels is taught in '994 being described by the combustion equation term: $x\alpha_0[C_{YR}H_{ZR}]$ of that patent. Note that The Input/Loss Method accounts for all non-black liquor fuels, such as methane or fuel oil, but they are assumed to have known chemistries with known fuel flows. Mixed fuels are input to the system simulator (e.g., EX-FOSS) as a composite, combining them by using the FUEL program, although the resultant computed fuel chemistry, after proper weighting, is assigned to the black liquor by assuming the other fuels have fixed or predictable, and known, chemistries. Alternatively, such assignment may be made to a combined subset of fuels.

$$x\alpha_1=\Gamma_{N2}-a\phi_{Act} \tag{30}$$

$$x(\alpha_5+\alpha_2)/2=\Gamma_{H2O}/2 \tag{31}$$

$$x(\alpha_3+\alpha_2/2)=\Gamma_{O2}+3(x_{MAF}\Gamma_{NA}+\sigma_N k_{BL})/2+x_{MAF}\alpha_{MAF-6}(\sigma_N-2\sigma_N\varphi_R+1.0) \tag{32}$$

$$x\alpha_4=\Gamma_{CO2}+x_{MAF}\Gamma_{NA}+\sigma_N k_{BL} \tag{33}$$

$$x\alpha_6=\Gamma_{SO2} \tag{34}$$

$$x\alpha_{14}=\sigma_N(T_{NO}+k_{BL})+\sigma_N(T_{NA}+T_{NS}+T_{NC}/2) \tag{35}$$

where:

$$\Gamma_{N2}=100-[D_{Act}+G_{Act}+e_{Act}+m_{Act}/2+\sigma_N k_{BL}+(1.0-\sigma_N)x_{MAF}\alpha_{MAF-6}]-100\phi_{Act}(R_{Act}-1.0)/[R_{Act}(\phi_{Act}+1.0)] \tag{36}$$

$$\Gamma_{H2O}=J_{Act}-b_Z-b_T b_A(1.0+\beta) \tag{37}$$

$$\Gamma_{O2}=D_{Act}+G_{Act}+J_{Act}/2-b_Z/2-b_T/2-(1.0+\beta)(a+b_A/2)+e_{Act}/2+m_{Act}/2+\sigma_N k_{BL}(2\varphi_R-1.0) \tag{38}$$

$$\Gamma_{CO2}=D_{Act}+e_{Act}+v \tag{39}$$

$$\Gamma_{SO2}=\sigma_N(T_{NA}+T_{NS}+k_{BL})+(1.0-\sigma_N)x_{MAF}\alpha_{MAF\text{-}6} \tag{40}$$

$$\Gamma_{NA}=\sigma_N(\alpha_{MAF\text{-}14}+\alpha_{MAF\text{-}15}-\alpha_{MAF\text{-}16}/2-\alpha_{MAF\text{-}6}) \tag{41}$$

In these relationships the subscript "Act" means an effluent measurement or assumption (an "actual" value). The term $J_{Act}$ in Eqs.(37) and (38) relating to the moles of effluent $H_2O$ could be input as a constant value or measured. All other values in Eqs.(36) through (41) are either evaluated explicitly based on input data, internal models and/or have minor import but are carried in the formulations for consistency. The amount of inert matter ($x\alpha_{10}$) associated with black liquor fuels as used in recovery boilers is typically small, less than 5% by weight and may be held constant which is the Preferred Embodiment, or as may be determined using the Air/Fuel ratio as taught in '994, or as otherwise obtained.

As a group, these relationships are of critical importance for understanding The Input/Loss Method as applied to recovery boilers. If fuel chemistry is to be resolved, thus heating value, boiler efficiency and thus accurate fuel flow, etc., then stoichiometric relationships generally representing Eqs.(30) to (41) must be resolved. These equations are not unique in their grouping of terms, further reductions and/or complexities are possible. The grouping of terms adopted here principally follows from the right-side of Eq.(19BL).

For the following discussion, assume initially that tube leakage, fuel inerts and fuel inorganics ($b_T$, $\alpha_{10}$, $\alpha_{14}$, $\alpha_{15}$ and $\alpha_{16}$) have zero values. With this assumption, Eqs.(30) through (34) yield five equations with eight unknowns. For this situation, unknowns include $\alpha_1$ through $\alpha_6$, and the terms "a" and "x". The term "x" is a convenience term and could be divided through changing the base of Eq.(19BL) to unity moles of fuel, thus eliminating use of $x\alpha_j$ terms comprising two unknowns. However, if done, then the effluent's base becomes per mole of fuel, e.g., $D_{Act}/x$, adding a different complexity involving the normalization of effluent measurements. Although the requirement $\Sigma\alpha_{MAF\text{-}j}=1.00$ is a convenience, it affords another, and viable, equation. By making a molar nitrogen balance, and assuming 100 moles of dry gaseous effluent at the boundary, the "a" quantity (moles of combustion oxygen) may be resolved independent of Eq.(30), thus reducing the unknowns; detailed below. Again, the entire combustion equation, Eq.(19BL), could be divided through by $\alpha_4$, or $x\alpha_4$, setting a carbon base. Effluent $N_2$ could be resolved by difference assuming 100 moles of gaseous effluent ($CO_2$, $H_2O$, $O_2$, $SO_2$, the minor pollutants being measured or assumed), or $N_2$ could be measured directly. Or, further still, by assuming constant values for fuel nitrogen and sulfur, $\alpha_1$ & $\alpha_6$ (typically minor fuel constituents), with resolution of "a", and say: $\alpha_3=1.0-\Sigma\alpha_{MAF\text{-}j}$, $j\neq3$, the system is reduced to three equations with four unknowns; these include Eqs.(31) through (33), with $\alpha_2$, $\alpha_4$, $\alpha_5$ and "x". As another example, if $\alpha_3$, $\alpha_{14}$, $\alpha_{15}$ and $\alpha_{16}$ are assumed constant, then the combined Eqs.(31) and (32) (with cancellation of $x\alpha_2$) represents one equation with two unknowns, "x" and $\alpha_5$; however at least $\alpha_2$, $\alpha_3$ and $\alpha_{14}$ represent major and variable constituents of black liquor fuel. And, of course, further reductions and manipulations of unknowns and equations is entirely possible. However, close examination of the physical problem of combustion stoichiometrics, in which fuel chemistry is to be determined from Choice Operating Parameters, indicates that the mathematical system invokes a stiff matrix—and of course having further complexity if the black liquor's inorganic components are fully involved. In summary, these manipulations are discussed to emphasize that, as taught by this invention, algebraic manipulations must address the physical reality of the thermal system, this means the fuel's intrinsic chemical relationships. Such intrinsic chemical relationships must recognize for example that black liquor is a highly wet fuel consisting of both hydrocarbons and inorganics, and must also recognize the influences played by the fuel on the smelt measurements $\Phi_R$ and $\Phi_S$ by the principal gaseous effluent measurements $D_{Act}$, $J_{Act}$ and $G_{Act}$. Invoking such intrinsic chemical relationships reduces The Input/Loss Method's sensitivity to instrumentation errors and enhances the accuracy of the applied minimization techniques which correct such measurements. The solution problem is to employ intrinsic chemical relationships within the resolution of the combustion equation.

To address the solution problem, the Preferred Embodiment capitalizes on the intrinsic chemical relationships found in organic fuels between MAF hydrogen and MAF carbon, and, for black liquor fuel, relates stoichiometrically the organic to the inorganic compounds through the Sodium to Carbon ratio ($\Phi_N$). Further, the fuel mole term, x, is used in the Preferred Embodiment for this single variable appears in all stoichiometric conversions to mass flows (the consistent determination and conservation of which is an object of this invention); and represents an iterative parameter for Eq.(19BL). Further, the Preferred Embodiment does not require that the minor fuel constituents be assumed constant. Further, as will become apparent, the Preferred Embodiment allows use of multidimensional minimization techniques which addresses instrumentation errors.

Returning to the solution problem as posed by Eq.(19BL), if fuel chemistry is to be resolved then fundamental problems require solution—independent of algebraic manipulations. These problems include the following: 1) the black liquor's inorganic components; and 2) for any set of unknown fuel quantities, $\alpha_j$, there is always, at least, additional unknowns: in the combustion air term, "a"; in the fuel mole term, "x"; and in the unknown tube leakage ($b_T$) a subject of this invention. The first of these problems is resolved through the Sodium to Carbon ratio $\Phi_N$, and obtaining correlations of molar MAF fractions of fuel potassium and chlorine as a function of sodium:

$$\alpha_{MAF\text{-}15}=A_{15}+B_{15}\alpha_{MAF\text{-}14} \tag{42}$$

$$\alpha_{MAF\text{-}16}=A_{16}+B_{16}\alpha_{MAF\text{-}14} \tag{43}$$

The second of these problems is solved, in part, by reducing $\alpha_j$ quantities to a molar MAF bases, eliminating the influence of the two components not chemically involved in the hydrocarbon nor inorganic portions of black liquor's make-up, water and inerts, and then solving for the remaining $\alpha_{MAF\text{-}j}$ terms. Dependent $\alpha_{MAF\text{-}j}$ terms may be algebraically resolved by obtaining correlations of molar MAF fractions of fuel hydrogen, nitrogen and oxygen to molar MAF fuel carbon, Eqs.(48), (49) & (50), and molar MAF fuel potassium and chlorine to molar MAF fuel sodium, Eqs.(42) & (43); thus establishing intrinsic chemical relationships. Fuel carbon is then resolved explicitly by: converting the left-side of Eqs.(31), (32) & (33) to a MAF base; then subtracting Eq.(31) from (32) to eliminate the water term $x_{MAF}\alpha_{MAF\text{-}2}$; then converting inorganic compounds associated with $\Gamma_{NA}$, using Eqs.(42) & (43) and the $\Phi_N$ ratio, to MAF carbon terms; substituting Eqs.(49) & (50); resulting in two functional equations, the combined Eqs.(31) & (32) and Eq.(33), with two unknowns, $x_{MAF}$ and $\alpha_{MAF\text{-}4}$; solving produces:

$$\alpha_{MAF\text{-}4}=[-\Gamma_{CO2}(\xi_{C7}+\xi_{C5})+\xi_{C4}\xi_{C2}]/[\Gamma_{CO2}(\xi_{C8}+\xi_{C6})+\xi_{C4}(1.0-\xi_{C3})] \tag{44}$$

$$x_{MAF}=\Gamma_{CO2}/[\alpha_{MAF\text{-}4}-\alpha_{MAF\text{-}4}\xi_{C3}-\xi_{C2}] \tag{45}$$

However, before solving Eqs.(44) & (45), the "a" quantity (moles of combustion oxygen) used in $\Gamma_{O2}$ and $b_A$, and thus in $\xi_{C4}$, $\xi_{C9}$ & $\Gamma_{H2O}$, is resolved via Eq.(46) by recognizing: 1) the bases of Eq.(19BL) is that, at the boundary: 100 dry gaseous moles$\equiv D_{Act}+G_{Act}+(h+\beta a\phi_{Act})+e_{Act}+m_{Act}+\sigma_N k_{BL}+(1.0-\sigma_N)x_{MAF}\alpha_{MAF\text{-}6}$, and is used to substitute for "h" in a nitrogen molar balance simplifying with $\Gamma_{N2}$; and 2) that: $\beta a=100(R_{Act}-1.0)/[R_{Act}(1.0+\phi_{Act})]$.

$$a=(\Gamma_{N2}-x_{MAF}\alpha_{MAF\text{-}1})/\phi_{Act} \tag{46}$$

In these equations the following terms are developed from algebraic manipulations and simplifications. Furthermore, these equations example the process of establishing intrinsic chemical relationships as developed with the objective of establishing functionality between Choice Operating Parameters (e.g., effluent data) and fuel chemistry.

$$\xi_{C2}=\sigma_N[A_{15}-A_{16}/2-\varphi_S(\alpha_{MAF-10}+A_{15}+A_{16}/2+v/x_{MAF})] \tag{47A}$$

$$\xi_{C3}=\sigma_N\varphi_N[1.0+B_{15}-B_{16}/2-\varphi_S(1.0+B_{15}+B_{16}/2)] \tag{47B}$$

$$\xi_{C4}=-\Gamma_{H2O}/2+\Gamma_{O2}+2\sigma_N k_{BL}(1.0-\varphi_R)+(1.0-\sigma_N)x_{MAF}\alpha_{MAF-6} \tag{47C}$$

$$\xi_{C5}=\sigma_N[1.5(A_{15}-A_{16}/2)+(0.5-2\varphi_R)\varphi_S(\alpha_{MAF-10}+A_{15}+A_{16}/2+v/x_{MAF})] \tag{47D}$$

$$\xi_{C6}=\sigma_N[1.5\varphi_N(1.0+B_{15}-B_{16}/2)+(0.5-2\varphi_R)\varphi_S\varphi_N(1.0+B_{15}+B_{16}/2)] \tag{47E}$$

$$\xi_{C7}=-A_3+A_5 \tag{47F}$$

$$\xi_{C8}=-B_3+B_5 \tag{47G}$$

$$\xi_{C9}=\Gamma_{O2}+3(x_{MAF}\Gamma_{NA}+\sigma_N k_{BL})/2+x_{MAF}\alpha_{MAF-6}(\sigma_N-2\sigma_N\varphi_R+1.0) \tag{47H}$$

Note that the v term of Eqs.(19BL) & (39), relating free carbon found in the smelt, may be assumed constant or may be expanded as a function of $\alpha_{MAF\text{-}4}$ or $\alpha_{MAF\text{-}14}$ if its magnitude effects the accuracy of the computed $\alpha_{MAF\text{-}4}$. Given $\alpha_{MAF\text{-}4}$, $x_{MAF}$ is then resolved via Eq.(45), based on Eq. (33). Given $\alpha_{MAF\text{-}4}$, sodium, $\alpha_{MAF\text{-}14}$, is then resolved from $(\Phi_N\alpha_{MAF\text{-}4})$. Note that a system carbon balance involves all major stoichiometric terms including $x_{MAF}$, $\alpha_{MAF\text{-}4}$, $D_{Act}$, $R_{Act}$ and $\beta$. In Eqs.(42) & (43) the constants $A_j$ and $B_j$ may be developed as part of the Reference Fuel Characteristics associated with a specific black liquor taken from the actual As-Fired, or obtained from generic specification of a black liquor fuel, or otherwise obtained. Such data may also be collected, or otherwise obtained, for fuel nitrogen, oxygen and hydrogen. Note that if ultimate analyses are not available for the fuel, for potential used in developing $A_j$ and $B_j$, and especially $A_5$ and $B_5$ for MAF hydrogen, then determination of elemental (ultimate) analyses may be had from so-called proximate data. Such conversions from proximate to ultimate analyses is well established art, four such conversion methods are described in A. B. Gill, *Power Plant Performance*, Butterworths: London, 1984, Chapter 2, pages 70–77. And although such proximate to ultimate conversions are not the Preferred Embodiment, it affords another example of establishing intrinsic chemical relationships required of Reference Fuel Characteristics.

$$\alpha_{MAF\text{-}1}=A_1+B_1\alpha_{MAF\text{-}4} \tag{48}$$

$$\alpha_{MAF\text{-}3}=A_3+B_3\alpha_{MAF\text{-}4} \tag{49}$$

$$\alpha_{MAF\text{-}5}=A_5+B_5\alpha_{MAF\text{-}4} \tag{50}$$

Fuel MAF sulfur is resolved explicitly by solving Eq.(34) and applying Eqs.(42) & (43) and the ratios $\Phi_S$ and $\Phi_N$:

$$\alpha_{MAF-6}=\Gamma_{SO2}/x_{MAF} \tag{51}$$

$$=\sigma_N\varphi_S[\alpha_{MAF-10}+A_{15}+A_{16}/2+v/x_{MAF}]+\sigma_N\varphi_S\varphi_N\alpha_{MAF-4}[1.0+B_{15}+B_{16}/2+v/x_{MAF}]+\sigma_N k_{BL}/x_{MAF} \tag{52}$$

where the inorganic terms comprising $\Gamma_{SO2}$, and whose compounds describing the inorganics produced from black liquor combustion, see Eq.(19BL), are determined as follows:

$$\sigma_N T_{KO}=\sigma_N x_{MAF}\alpha_{MAF\text{-}15} \tag{53}$$

$$\sigma_N T_{NC}=\sigma_N x_{MAF}\alpha_{MAF\text{-}16} \tag{54}$$

$$\sigma_N T_{NS}=\sigma_N\Phi_R(x_{MAF}\alpha_{MAF\text{-}6}-k_{BL}) \tag{55}$$

$$\sigma_N T_{NA}=\sigma_N(1.0-\Phi_R)(x_{MAF}\alpha_{MAF\text{-}6}-k_{BL}) \tag{56}$$

$$\sigma_N(T_{NO}+k_{BL})=x_{MAF}\Gamma_{NA}+\sigma_N k_{BL}-\sigma_N x_{MAF}\alpha_{MAF\text{-}15} \tag{57}$$

After Eqs.(44), (49) & (50) are resolved, fuel MAF water is resolved explicitly by employing Eq.(31), or by adding Eqs.(31) & (32) for numerical over-check, through substitution of $x_{MAF}$:

$$\alpha_{MAF-2}=(\Gamma_{H20}-x_{MAF}\alpha_{MAF-5})/x_{MAF} \tag{58A}$$

$$=(-\alpha_{MAF-5}\xi_{C9}+\alpha_{MAF-3}\Gamma_{H2O})/(\xi_{C9}-\Gamma_{H2O}/2) \tag{58B}$$

Fuel MAF nitrogen concentration is small, and typically may be fixed as a constant. Fuel oxygen may be described by Eq.(49). The MAF sulfur concentration may be computed assuming: $\alpha_{MAF\text{-}6}=A_6+B_6\alpha_{MAF\text{-}4}$, as opposed to Eq.(52), if the effluent $SO_2$ measurement is questionable (or if limestone is injected and its conversion rate is questionable). As another alternative, either the oxygen or sulfur could be used to assure that $\Sigma\alpha_{MAF\text{-}j}=1.0$, where: j=1,3,4,5,6,14,15,16. The sole criteria in deciding the exact methodology is the reliability and availability of effluent data and its relative impact on MAF fuel terms. The Preferred Embodiment is to solve $\alpha_{MAF\text{-}3}$ using Eq.(49), $\alpha_{MAF\text{-}6}$ using Eq.(52), and $\alpha_{MAF\text{-}1}$ by balance. For example, although nitrogen is a major combustion effluent, using Eq.(30) to solve for fuel nitrogen, typically a very minor component of the fuel's makeup, would invite even slight errors made in determining effluent $N_2$ (made either by direct measurement or determined by difference suggested in Eq.(36)) will greatly amplify the uncertainty in $\alpha_{MAF\text{-}1}$. Indeed, the $\Gamma_{N2}$ term is used to resolve the combustion $O_2$ term via Eq. (46), wherein the term $x_{MAF}\alpha_{MAF\text{-}1}$ is resolved by balance and iteration on $x_{MAF}$. Besides carbon, an important term is the fuel MAF hydrogen concentration which represents an intrinsic chemical relationship with carbon. Experience has shown that a valid relationship may be achieved since the hydrogen: carbon chemical bond is predominant with carbon:carbon. With an established MAF hydrogen to carbon relationship, the variability of a specific black liquor fuel then lies with its water, inorganics and inerts.

To this point in the process, resolution of fuel chemistry has been possible by assuming a Moisture-Ash-Free (MAF) basis. In carrying this out, it is not critical to the invention that carbon be computed as the independent quantity; nor is it critical to use a MAF basis as the inert fraction is typically small in black liquors, thus a dry basis may serve equally well. Hydrogen, or any other MAF fuel element could be considered as the independent variable. For example, if solving for hydrogen first, then $\alpha_{MAF\text{-}4}=f(\alpha_{MAF\text{-}5})$. However, the Preferred Embodiment is to place independence with carbon, where of course the greatest accuracy and sensitivity may be found in the effluent measurements. $CO_2$ does not exist in the combustion air to any appreciable concentration; it does not leak into the system; it is generated only from combustion and as a major effluent has obvious sensitivity to resolution of $\alpha_{MAF\text{-}4}$ of Eq.(44).

Thus all fuel constituents are therefore determined on a MAF bases. From these values, the wet base molar fuel fractions are then determined, as are the wet base moles of fuel (x) and the wet base (As-Fired) weight fractions ($WF_j$) of all fuel components j:

$$\alpha_j=\alpha_{MAF\text{-}j}/(1.0+\alpha_{MAF\text{-}2}+\alpha_{MAF\text{-}10}) \tag{59}$$

$$x=x_{MAF}(1.0+\alpha_{MAF\text{-}2}+\alpha_{MAF\text{-}10}) \tag{60}$$

$$x\alpha_j=x_{MAF}\alpha_{MAF\text{-}j} \tag{61}$$

$$WF_j=\alpha_j N_j/(\Sigma\alpha_j N_j) \tag{62}$$

$$WF_{DRY\text{-}j}=WF_j/(1.0-WF_2) \tag{63}$$

As taught in '879 the sensitivity of computed fuel chemistries to an effluent $H_2O$ measurement is substantial. When employing any of the Input/Loss methods which compute fuel chemistry, fuel chemistry will effect the computed fuel heating value, boiler efficiency and thus system efficiency. With such Input/Loss methods, computed fuel chemistries are generally sensitive to combustion gaseous effluents, including $CO_2$, $H_2O$ and $O_2$. The effluent $H_2O$ measurement (or its assumption), as well as effluent $CO_2$ and $O_2$, may be corrected through methods taught by '879; however, such measurements will be impacted by tube leaks, and tube leaks of even moderate flows. Both '879 and this invention discuss the optimization of certain parameters, such parameters include an assumed flow of water in-leakage into and mixing with the combustion gases; thus the modeling of tube leaks using a combination of combustion stoichiometrics, Eq. (19BL), etc., and optimization methods.

Having computed black liquor's fuel chemistry, the heating value of black liquor is next computed. Following the teachings of '994, black liquor heating value is determined base on a differential analysis. Note that the term $N_{MAF}$ is the molecular weight of the MAF-base fuel (without water and inerts).

$$\Delta HHV_{MAF-delta} = HHV_{MAF-Ref} - (-178387.18\,\alpha_{MAF-3} + 183591.92\,\alpha_{MAF-4} + 78143.68\,\alpha_{MAF-5} - \Delta H^0_{C-Cal/BL})_{Ref} / N_{MAF-Ref} \tag{64}$$

$$HHV_{MAF-uncorr} = (-178387.18\,\alpha_{MAF-3} + 183591.92\,\alpha_{MAF-4} + 78143.68\,\alpha_{MAF-5} - \Delta H^0_{C-Cal/BL})_{Actual} / N_{MAF-Actual} \tag{65}$$

-continued $$\Delta H^0_{C-Cal/BL} = \sigma_N \alpha_{MAF-6}[N_{Na2SO4}\Delta H^0_{f-Cal/Na2SO4} + N_{H2S}\Delta H^0_{f-Cal/H2S} - 2N_{NaHS}\Delta H^0_{f-Cal/NaHS}] \tag{66}$$

$$HHV_{MAF}=HHV_{MAF\text{-}uncorr}+\Delta HHV_{MAF\text{-}delta} \tag{67}$$

$$HHV_{DRY}=HHV_{MAF}(1.0-WF_{DRY\text{-}10}) \tag{68}$$

$$HHV_{AF}=HHV_{DRY}(1.0-WF_2) \tag{69}$$

Eq.(66) illustrates, for example, that black liquor may contain only $Na_2CO_3$ and $K_2CO_3$ (which are assumed to appear as products), and NaHS which reacts to produce $Na_2SO_4$ and $H_2S$, thus requiring a ΔHeat of Combustion correction, $\Delta H_{C\text{-}Cal/BL}{}^0$. In Eq.(66) MAF sulfur is first taken as the reference value, $\alpha_{MAF\text{-}6\text{-}Ref}$, wherein $\Delta H_{C\text{-}Cal/BL}{}^0$ is then used in Eq.(64); then it is taken as the actual, $\alpha_{MAF\text{-}6}$ via Eq.(52), wherein $\Delta H_{C\text{-}Cal/BL}{}^0$ is then used in Eq.(65).

Boiler Efficiency for Recovery Boilers

Boiler efficiency computations are a vital portion of any of the Input/Loss methods, and especially so when resolving tube failure leakage flow. Methods presented in '429 describe how to compute a high accuracy boiler efficiency applicable for conventional steam generators burning common hydrocarbon fuels. However, as applied to recovery boilers, given black liquor fuel contains reactive inorganic compounds subjected to reduction, the methods of '429 require modification. Methods presented herein describe how to compute a high accuracy boiler efficiency applicable for black liquor fuels.

Notably The Input/Loss Method emphasizes computational consistency, consistency principally achieved through boiler efficiency and its computation of heating value as dependent on the calorimetric temperature, $T_{Cal}$. The calorimetric temperature must be consistently employed in all energy terms and Heats of Formation. For recovery boilers is it common industrial practice to correct the measured heating value for Heats of Formation associated with reactions particular to recovery boilers, and commonly the chemical reduction of $Na_2SO_4$. Such industrial corrections are taught in the following documents: "Performance Test Procedure Sodium Based Recovery Units", CA Report No. 84041601, March 1996, TAPPI Press, Atlanta Ga. (see paragraphs 5.2.2.5, 7.2.2.8 and 7.2.2.9, and Appendix B); and *Steam, Its Generation and Use*, 40th Edition, Edited by S. C. Stultz and J. B. Kitto, published 1992 by The Babcock & Wilcox Company, Barberton, Ohio (see Chapter 26, page 26-5). Such common industrial corrections address the difference between ideal combustion products associated with a bomb calorimeter versus actual products associated with further reducing black liquor compounds. However, as taught herein such industrial corrections are thermodynamically inconsistent, and simply wrong. Industrial corrections reduce the higher heating value with a computed $\Delta H_R$ term: HHVP−$\Delta H_R$; this term effecting the denominator in common boiler efficiency formulations. Given the teachings of '429 the $\Delta H_R$ term is an intrinsic portion of the numerator of boiler efficiency; an affect of describing ideal versus actual products of combustion bound in the $HPR_{Act}$ and $HRX_{Act}$ terms. Further, the principles taught about the use and computation of L Factors, an important System Effect Parameter concept, are fundamentally based on the as-measured heating value combusted under theoretical conditions with dried fuel (not a HHVP−$\Delta H_R$ concept); see the section on "System Effect Parameters" and its Eqs.(272) & (273) below. '429 teaches, for a HHV-based efficiency, that:

$$\eta_{B-HHV} = \frac{BBTC}{m_{AF}(HHVP + HBC)} \tag{121}$$

$$= \frac{HHVP + HBC - \sum Losses/m_{AF}}{HHVP + HBC} \tag{122}$$

$$= \frac{HHVP + HBC - (HSL + HNSL)}{HHVP + HBC} \tag{123}$$

where the numerator of Eq.(123), if considering only HSL losses for clarity (i.e., ignoring Non-Chemistry & Sensible Heat Losses, $\eta_A$=1.0), may be expanded as:

$$=HHVP+HBC-HSL$$

$$=-HPR_{Act\text{-}HHV}+HRX_{Act\text{-}HHV}$$

$$=-HPR_{Act\text{-}HHV}+HRX_{Cal\text{-}HHV}+HBC$$

$$=-HPR_{Act\text{-}HHV}+HPR_{Ideal\text{-}HHV}+HHVP+HBC$$

where this last expression illustrates that actual product compounds (e.g., as effected by the process' Reduction Efficiency) are net of ideal combustion products (found in a bomb calorimeter producing the measured $HHV_{AF}$). Heats of Formation, and sensible heats associated with the Firing Correction term HBC, are all thermodynamically consistent. When reducing $Na_2SO_4$ in a recovery boiler via the reactions:

$$Na_2SO_4 \text{->} Na_2S+2O_2 \tag{124}$$

$$CO_2+Na_2SO_4 \text{->} SO_2+Na_2CO_3+O_2/2 \tag{125}$$

the Heats of Formation of the non-ideal product compounds $Na_2S$, $SO_2$ and $Na_2CO_3$ are addressed through $HPR_{Act}$ and its Eq.(133), whereas the ideal—and the measurement base for all heating values—are addressed through $HPR_{Ideal}$. Note that $Na_2CO_3$ as produced from reducing $Na_2SO_4$ is governed by the effluent measurement of $SO_2$ ($k_{BL}$), and although may be inaccurately measured, the measurement may be corrected or otherwise obtained. The quantity BBTC/(HHVP+HBC) of Eq.(121) must be constant for a given in-situ system burning a defined fuel; thus any changes in its combustion process (e.g., changes in Reduction Efficiency, $\Phi_R$) which will of course affect fuel flow, must also affect $\eta_B$ (through $HPR_{Act}$) in proportion, maintaining BBTC/(HHVP+HBC) constant. A (HHVP−$\Delta H_R$) procedure is inconsistent since the term: BBTC/(HHVP−$\Delta H_R$+HBC) would not remain constant since $\Delta H_R = f(\Phi_R)$; the term would produce a variable fuel flow.

Non-Chemistry and Sensible Heat Loss term (HNSL) is computed as taught in '429. With its determination, only the three major terms $HPR_{Act}$, $HRX_{Act}$ & HBC remain to be defined to complete boiler efficiency. These are taught in the following paragraphs. To fully understand the formulations comprising $HPR_{Act}$, $HRX_{Act}$ and HBC, take note of the subscripts associated with the individual terms. As example, when considering water product created from combustion, $n_{Comb\text{-}H2O}$ of Eq.(131), its Heat of Formation (saturated liquid phase) at $T_{Cal}$ must be corrected for boundary (Stack) conditions, thus, $h_{Stack}-h_{f\text{-}Cal}$. The Enthalpies of Reactants of Eqs.(135) & (136) are determined from ideal products at $T_{Cal}$, the Firing Correction then applied.

Differences in formulations required for higher or lower heating values should also be carefully reviewed, as recovery boilers are evaluated using either. Higher heating values require use of the saturated liquid enthalpy evaluated at $T_{Cal}$; lower heating values require the use of the saturated vapor at $T_{Cal}$. The quantities which are not so corrected are the last three terms in Eqs.(131) & (132): water born by air; known in-leakages ($b_Z$); and tube leakage ($b_T$). These terms undergo no transformations since they have non-fuel origins. Heating values and energies used in Eqs.(131) through (137) are always associated with the system boundary, specifically defined by: the entry point of the As-Fired fuel (or the "supplied" fuel in the case of fuel rejects); the ambient air conditions; the Stack location including gaseous effluent temperature and the Continuous Emission Monitoring System (typically measuring $CO_2$).

Boiler efficiency is defined as either HHV- or LHV-based, being composed of a combustion efficiency and a boiler absorption efficiency:

$$\eta_{B\text{-}HHV}=\eta_{C\text{-}HHV}\eta_A \tag{126}$$

$$\eta_{B\text{-}LHV}=\eta_{C\text{-}LHV}\eta_A \tag{127}$$

The boiler absorption is determined from the Non-Chemistry & Sensible Heat Losses term (HBC) as fully discussed in '429. It is an important teaching herein that fuel flow compute identically from either efficiency base; thus, assuming no tube leakage:

$$m_{AF} = \frac{BBTC}{\eta_{B-HHV}(HHVP + HBC)} = \frac{BBTC}{\eta_{B-LHV}(LHVP + HBC)} \tag{128}$$

Such computations of fuel flow using either efficiency, at a defined $T_{Cal}$, is an important numerical overcheck of this invention.

Combustion efficiency is determined by the following, as either a HHV-based or a LHV-based efficiency:

$$\eta_{C-HHV} = \frac{-HPR_{Act-HHV} + HRX_{Act-HHV}}{HHVP + HBC} \tag{129}$$

$$\eta_{C-LHV} = \frac{-HPR_{Act-LHV} + HRX_{Act-LHV}}{LHVP + HBC} \tag{130}$$

The development of the combustion efficiency term, as computed based on $HPR_{Act}$ & $HRX_{Act}$ and involving systematic use of a combustion equation, such as Eq.(19BL), is believed an improved approach versus the primary use of individual "stack loss" terms. Mis-application of terms is greatly reduced, while numerical accuracy is increased. Most importantly, valid system mass and energy balances are assured.

The Enthalpy of Products ($HPR_{Act}$) term is as follows. For higher heating value calculations:

$$HPR_{Act-HHV} \equiv \tag{131}$$

$$\sum HPR_i + [n_{Comb-H2O}(\Delta H^0_{f-Cal/liq} + h_{Stack} - h_{f-Cal}) +$$

$$n_{Fuel-H2O}(h_{Stack}\, h_{f-Cal}) + n_{CAir-H2O}(h_{Stack}\, h_{g-Cal}) +$$

-continued $$b_Z(h_{Stack}h_{SteamZ}) + b_T(h_{Stack} - h_{SteamT})]_{H2O}N_{H2O}/(xN_{AF})$$

For lower heating value calculations:

$$HPR_{Act-LHV} \equiv \sum HPR_i + [n_{Comb-H2O}(\Delta H^0_{f-Cal/vap} + h_{Stack} - h_{g-Cal}) + n_{Fuel-H2O}(h_{Stack}h_{g-Cal}) + n_{CAir-H2O}(h_{Stack}h_{g-Cal}) + b_Z(h_{Stack}h_{SteamZ}) + b_T(h_{Stack} - h_{SteamT})]_{H2O}N_{H2O}/(xN_{AF}) \quad (132)$$

where:

$HPR_i$ = Enthalpy of non-water product $i$ at the boundary; refer to the right side of Eq.(19BL); for example, if product $i$ is $Na_2S$ then: $n_{Na2S} = \sigma_N T_{NS} = \sigma_N \varphi_R(x_{MAF}\alpha_{MAF-6} - k_{BL})$.

$$HPR_i \equiv \left[\Delta H^0_{f-Cal/i} + \int_{T_{Cal}}^{T_{Stack}} dh_i\right] n_i N_i/(xN_{AF}) \quad (133)$$

$n_{Comb-H2O}$=Molar water found at the boundary formed directly from combustion of a hydrocarbon ($x\alpha_5$).

$n_{Fuel-H2O}$ = Molar water found at the boundary born by As–Firedfuel (as total inherent and surface moisture).

$$\equiv J_{Act} - [b_A(1.0+\beta) + b_Z + b_T + x\alpha_5] = x\alpha_2$$

$n_{CAir-H2O}$ = Molar water found at the boundary born by combustion air and air in–leakage $$\equiv b_A(1.0+\beta)$$

$h_{Stack-H2O}=f(P_{Stack-H2O}, T_{Stack})$, where $P_{Stack-H2O}$ is water's partial pressure per total wet molar and is given by:

$$P_{Stack-H2O}=P_{Amb}(J_{Act}+\beta b_A)/(100+J_{Act}+\beta b_A).$$

$h_{SteamZ}$=Weighted specific enthalpy of $b_Z$ in-leakage.

$h_{SteamT}$=Specific enthalpy of tube leakage ($b_T$).

$\Delta H_{f-Cal/i}{}^0$=Heat of Formation of compound i evaluated at the calorimetric temperature, $T_{Cal}$.

$$\Delta H^0_{f-Cal/i} = \Delta H^0_{f-77/i} + \int_{77}^{T-Cal} dh_{Compound/i} - \sum \int_{77}^{T-Cal} dh_{Elements}$$

The Enthalpy of Reactants ($HRX_{Act}$) term is as follows. Note that although $SO_2$ is a common gaseous product of ideal combustion of conventional fossil fuels, it is not assumed to be produced from the ideal combustion of black liquor. For higher heating value calculations:

$$HRX_{Act-HHV} \equiv HHVP + HBC + HPR_{CO2-Ideal} + HPR_{H2O-Ideal-HHV} + HPR_{Na2CO3-Ideal} + HPR_{Na2SO4-Ideal} + HPR_{NaCl-Ideal} + HPR_{K2CO3-Ideal} \quad (135)$$

For lower heating value calculations:

$$HRX_{Act-LHV} \equiv LHVP + HBC + HPR_{CO2-Ideal} + HPR_{H2O-Ideal-LHV} + HPR_{Na2CO3-Ideal} + HPR_{Na2SO4-Ideal} + HPR_{NaCl-Ideal} + HPR_{K2CO3-Ideal} \quad (136)$$

where: $HPR_{CO2-Ideal}$=Energy of $CO_2$ ideal product from complete combustion at the calibration temperature. $\equiv \Delta H_{f-Cal/CO2}{}^0\alpha_4 N_{CO2}/N_{AF}$ $HPR_{H2O-Ideal-HHV}$=Energy of $H_2O$ ideal product from complete combustion, ending with condensed water, at the calibration temperature. $\equiv(\Delta H_{f-Cal/liq}{}^0 N)_{H2O}\alpha_5/N_{AF}$ $HPR_{H2O-Ideal-LHV}$=Energy of $H_2O$ ideal product from complete combustion, ending with water vapor, at the calibration temperature. $\equiv(\Delta H_{f-Cal/vap}{}^0 N)_{H2O}\alpha_5/N_{AF}$ $HPR_{Na2CO3-Ideal}$=Energy of $Na_2CO_3$ ideal product from complete combustion at the calibration temperature. $\equiv\Delta H_{f-Cal/Na2CO3}{}^0\sigma_N T_{NO} N_{Na2CO3}/(xN_{AF})$ $HPR_{Na2SO4-Ideal}$=Energy of $Na_2SO_4$ ideal product from complete combustion at the calibration temperature. $\equiv\Delta H_{f-Cal/Na2SO4}{}^0\sigma_N T_{NA} N_{Na2SO4}/(xN_{AF})$ $HPR_{NaCl-Ideal}$=Energy of NaCl ideal product from complete combustion at the calibration temperature. $\equiv\Delta H_{f-Cal/NaCl}{}^0\sigma_N T_{NC} N_{NaCl}/(xN_{AF})$ $HPR_{K2CO3-Ideal}$=Energy of $K_2CO_3$ ideal product from complete combustion at the calibration temperature. $\equiv\Delta H_{f-Cal/K2CO3}{}^0\sigma_N T_{KO} N_{K2CO3}/(xN_{AF})$ It should be noted that in this and in the preceding paragraph the fuel's calorimetric temperature, established when determining the fuel's heating value, is used as the thermodynamic reference energy level for the Enthalpy of Products and for the Enthalpy of Reactants: these two enthalpies employ a corrected Heat of Formation term, $\Delta H_{f-Cal/i}{}^0$, taught by Eq.(134), as used in Eqs.(131), (132), (133), (135) and (136). As seen in Eq.(134), $\Delta H_{f-Cal/i}{}^0$ is corrected relative to a standard Heat of Formation for substance i, taken at 77 F (25 C) and denoted by $\Delta H_{f-77/i}{}^0$.

The Firing Correction (HBC) term is given by the following.

$$HBC \equiv C_P(T_{AF} - T_{Cal})_{Fuel} + (Q_{SAH} + W_{FD})/m_{AF} + [(h_{Amb} - h_{Cal})_{Air}a(1.0+\beta)(1.0+\phi_{Act})N_{Air} + (h_{g-Amb} - h_{g-Cal})_{H2O}b_A(1.0+\beta)N_{H2O} + (h_{SteamZ} - h_{f-Cal})_{H2O} b_Z N_{H2O} + (h_{SteamT} - h_{f-Cal})_{H2O} b_T N_{H2O}]/(xN_{AF}) \quad (137)$$

where:

$h_{g-Amb-H2O}$=Saturated water vapor enthalpy at ambient dry bulb, $T_{Amb}$.

$C_p(T_{AF}-T_{Cal})_{Fuel}$=Sensible heat in the As-Fired fuel relative to $T_{Cal}$.

$(h_{Amb}-h_{Cal})_{Air}$=ΔEnthalpy of combustion dry air relative to $T_{Cal}$.

$(h_{g-Amb}-h_{g-Cal})_{H2O}$=ΔEnthalpy of moisture in combustion air relative to saturated water vapor at $T_{Cal}$.

$(h_{SteamZ}-h_{f-Cal})_{H2O}$=ΔEnthalpy of $b_Z$ known water in-leakages (at an average $h_{SteamZ}$) relative to saturated liquid water at $T_{Cal}$.

$(h_{SteamZ}-h_{f-Cal})_{H2O}$=ΔEnthalpy of tube leakage (at $h_{SteamT}$) relative to saturated liquid water at $T_{Cal}$.

The above equations are dependent on common system parameters. Common system parameters are defined following their respective equations, Eqs.(131) through (137). The BBTC term, comprising common system parameters, is determined from commonly measured or determined working fluid mass flow rates, pressures and temperatures (or qualities). Further, supporting terms such as thermodynamic properties, radiation & convection loss curves, guidelines for estimating Non-Chemistry & Sensible Heat Losses, sodium compound effects, miscellaneous terms, etc. are discussed in the following codes, standards and patents: the American Society of Mechanical Engineers' (ASME) Performance Test Codes (PTC) 4.1 and 4; the "Performance Test Procedure Sodium Based Recovery Units", CA Report No. 84041601, March 1996, TAPPI Press, Atlanta Ga.; the German standard "Acceptance Testing of Steam Generators", DIN 1942, DIN DEUTSCHES Institut Fur Normung E.V., February 1994; the European standard (draft) prEN 12952-15:1999 (also: CEN/TC 269/WG 3 N 337), "Water-Tube Boilers and Auxiliary Installations—Part 15: Acceptance Tests", November 1999, European Committee for Standardization, Central Secretariat, rue de Stassart, 36, Brussels; the British Standard "Code for Acceptance Tests on Stationary Steam Generators of the Power Station Type", BS 2885:1974, ISBN: 0 580 08136 2; and throughout US Patents '420, '470, '994 and '429. If conflicts arise between any method or procedure of these codes, standards or patents, this disclosure's methods, procedures and invention shall prevail.

It is interesting that the German standard DIN 1942 states that its reference temperature ($t_b$) for boiler efficiency is 25 C (77 F). However, in its paragraph 6.2, DIN 1942 allows that "other temperatures may be agreed upon" specifying in its Eq.(1b) how to correct heating value for a ($t_b$−25) effect. DIN 1942's Eq.(1b) not only corrects heating value using sensible heats ($C_p\Delta T$), incorporating all terms described by the Firing Correction (HBC) taught herein, but also corrects heating value for flue gas sensible heat and thus the denominator of $\eta_B$. This flue gas correction is incorrect. As taught herein a flue gas sensible heat term appears in Eq.(133), integrating the (dh) energy of combustion products from $T_{Cal}$, to $T_{Stack}$ effecting the term ($-HPR_{Act\text{-}LHV}+HRX_{Act\text{-}LHV}$), and thus only the numerator of $\eta_B$. Further, DIN 1942 does not teach to correct the $\Delta H_{f\text{-}Cal/i}^{0}$ term of Eq.(133) for a reference temperature different from $T_{Cal}$, or $t_b$; the term is ignored in DIN 1942 but is taught herein through Eq.(134). DIN 1942 does not correct Heats of Formation to achieve consistency with calorimetric temperature as taught herein; indeed, nowhere in DIN 1942 does any Heat of Formation appear.

The draft European standard mimics DIN 1942; it also discusses "Input/Loss Calculations" in its Section 9.4.5.2, but these calculations are not related to "Input/Loss methods" as used herein as defined in paragraph 0035. The British Standard requires that "the standard reference temperature for the calorific value of solid, liquid and gaseous fuels shall be 25 C" (Clause 2), and offers no means to alter. The TAPPI performance test standard references energy flows to a constant 77 F, but offers no means to alter. TAPPI's Appendix B develops a "Heat of Reaction Correction", correcting heating values as ($HHVP-\Delta H_R$), however no $T_{Cal}$ correction or alternation to $\Delta H_f^0$ is assumed in this development nor could one be inferred as it is not mentioned. PTC 4.1 references energy flows to an arbitrary "reference air temperature", $T_{RA}$. PTC 4 references energy flows to a constant 77 F, but offers no means to alter. Neither DIN 1942, the draft European standard, the British standard, the TAPPI standard, PTC 4.1 nor PTC 4 mention how a reference temperature should be established, other than setting it constant. There is no mention of the fuel's calorimetric temperature in any of these standards, nor the correction of reference Heats of Formation to the calorimetric temperature, nor using the fuel's calorimetric temperature as the reference temperature. Note that Heats of Formation are normally cited in the literature as being referenced to 25 C and 1.0 bar pressure. The Preferred Embodiment of '429 and for this disclosure requires the reference temperature to be taken at the calorimetric temperature established when determining heating value, and that all energy terms, including those associated with Heats of Formation, $HPR_{Act}$, $HRX_{Act}$ and HBC, be consistently referenced to this same calorimetric temperature.

Several PTCs and "coal" textbooks employ simplifying assumptions regarding the conversion of heating values. For example, a constant is sometimes used to convert from a constant volume process $HHV_{AF}$ (i.e., bomb calorimeter), to a constant pressure process HHVP. The following is preferred for completeness, for solid and liquid fuels:

$$HHVP=HHV_{AF}+\Delta H_{V/P} \tag{138}$$

$$\Delta H_{V/P}\equiv R_{Gas}T_{Cal,Abs}(\alpha_5/2-\alpha_1)/(\xi_{REJ}J_{Mech}N_{AF}) \tag{139}$$

where, in US Customary Units: $T_{Cal,Abs}$ is absolute calorimetric temperature (deg-R); $R_{Gas}\equiv 1545.325$ ft-lbf/mole-R; and $J_{Mech}\equiv 778.169$ ft-lbf/Btu. For gaseous fuels, the only needed correction is the compressibility factor (Z) assuming ideally computed heating values at the specified $T_{Cal}$:

$$HHVP=HHV_{Ideal}Z \tag{140}$$

Z and $HHV_{Ideal}$ may be evaluated using American Gas Association procedures. To convert from a higher heating value (also termed gross or upper) to a lower heating value (also termed net) use of Eq.(142) is exact, where $\Delta h_{fg\text{-}Cal/H2O}$ is evaluated at $T_{Cal}$. The oxygen in the effluent water is assumed to derive from combustion air and not from fuel oxygen: thus $\alpha_3$ is not included as there is no molar change, fuel oxygen is taken as the diatomic in Eq.(19BL).

$$LHV_{AF}=HHV_{AF}-\Delta H_{L/H} \tag{141}$$

$$\Delta H_{L/H}\equiv\Delta h_{fg\text{-}Cal/H2O}(\alpha_2+\alpha_5)N_{H2O}/(\xi_{REJ}N_{AF}) \tag{142}$$

Within Eq.(142) the $\xi_{REJ}$ term accounting for rejected fuel is defined as: $\xi_{REJ}\equiv(1.0-WF'_{Ash\text{-}AF})/(1.0-WF_{Ash\text{-}Sup})$. $\xi_{REJ}$ also corrects Eq.(144). These same procedures are applicable for a fuel cleaning process where the fuel's mineral matter (inert) is removed.

$$LHVP=LHV_{AF}+\Delta H_{V/P}-\Delta H_{corr\text{-}LHV} \tag{143}$$

$$\Delta H_{corr\text{-}LHV}=\Delta H_{L/H}(\xi_{REJ}-1.0)/\xi_{REJ} \tag{144}$$

Tube Failure Detection Methods

This invention teaches to add, apart from $b_Z$, a term descriptive of tube leakage to the typical combustion equation; its symbol herein is $b_T$ whose units are moles of liquid water or steam in-leakage per 100 moles of dry gaseous effluent. A procedure is taught by which the flow of in-leakage associated with a tube failure and its location may be determined. This procedure relies on a hydrogen stoichiometric balance incorporating $b_T$, applying limit tests on fuel constituents and tests on the rate of change of certain parameters; which tests provide an indication of possible tube failure and its stoichiometric causality (termed a "Tube Failure Mechanism", indicated by a numerical identification). Once a Tube Failure Mechanism has been identified, a tube failure flow rate is determined, but determined using a separative analysis technique. In summary, the Preferred Embodiment relies on modification of a traditional combustion equation, employing the $b_T$ term, it relies on limits and rates testing, and it relies on successive optimizations of Choice Operating Parameters which minimize errors in System Effect Parameters. All of these topics are discussed in detail in this disclosure. Forming a hydrogen stoichiometric balance using Eq.(19BL), and solving for $b_T$, results in Eq.(200) and thus allows the determination of tube leakage in moles. Note that the effluent moisture (at the Stack), is defined as: $J_{Act}=j+\beta b_A$. Also note that Eq.(19BL) represents a mathematical model of the combustion process using a molar base. The manipulation of such a combustion equation when employing traditional fossil fuels (non-black liquor), is taught in '994; whereas methods required for black liquor fuels, considered novel, are as taught herein.

$$b_T=J_{Act}-x(\alpha_2+\alpha_5)-b_Z-b_A(1.0+\beta) \quad (200)$$

Eq.(200) illustrates that for $b_T$ to be positive, i.e., a tube leak being detected, that unique balance must be developed between the assumed (or measured) effluent water ($J_{Act}$) and the predominating negative terms: combustion water ($x\alpha_2+x\alpha_5$), $b_Z$, and moisture in the combustion air and in the air leakage $b_A(1.0+\beta)$. Eq.(200) demonstrates that use of an effluent $H_2O$ instrument, measuring $J_{Act}$, may not detect tube failures. For example, any unusual increase in $J_{Act}$ could be caused by off-setting effects from high fuel water, high moisture in the combustion air, high air pre-heater leakage (a high $\beta$) and/or periodic soot blowing flow and/or use of atomizing steam ($b_Z$). Further, a tube leak could exist when the $J_{Act}$ term is decreasing as caused, for example, by a large decrease in fuel water (when, at the same time, $b_T$ is increasing). To resolve such difficulties, this invention teaches the use of Eq.(200) in conjunction with one of the Input/Loss methods in which fuel chemistry, the $\alpha_j$ terms, are determined.

When Input/Loss methods compute fuel chemistry associated with black liquor, such chemistry will include at least the determination of fuel elemental carbon ($\alpha_4$), fuel elemental hydrogen ($\alpha_5$), fuel water ($\alpha_2$), and fuel elemental sodium ($\alpha_{14}$). Typical Input/Loss methods will determine such quantities, in part, based on Operating Parameters including principal effluent concentrations ($CO_2$, $O_2$ and $H_2O$), combustion air psychrometrics (leading to $b_A$), and any known water and steam flows such as soot blowing and atomizing of fuel ($b_Z$). Further, The Input/Loss Method teaches when applied to recovery boilers, as a portion of Reference Fuel Characteristics, is to obtain intrinsic chemical relationships between fuel MAF hydrogen and carbon, and fuel sodium and carbon, for example for hydrogen: $\alpha_{MAF\text{-}5}=A_5+B_5\alpha_{MAF\text{-}4}$; $\alpha_{MAF\text{-}5}=A_5+B_5\alpha_{MAF\text{-}4}+C_5(\alpha_{MAF\text{-}4})^2$; or in general: $\alpha_{MAF\text{-}5}=f(\alpha_{MAF\text{-}4})$; and for example for sodium: $\alpha_{MAF\text{-}14}=\Phi_N\alpha_{MAF\text{-}4}$; or in general: $\alpha_{MAF\text{-}14}=f(\alpha_{MAF\text{-}4})$ Such functional relationships have been found to be most useful for fossil fuels including black liquor fuels. It has been found that the constants $A_5$, $B_5$, $C_5$ and $\Phi_N$ are typically remarkably constant for a specific fuel. Such correlations then establish inter-dependency between fuel carbon, fuel sodium, and all principal effluents, and thus, through Eq.(200) and resolution of Eq.(19BL), between the effluent concentrations $CO_2$, $O_2$ and $H_2O$, and the important $b_T$ term. In this context resolution of inorganic stoichiometrics (i.e., sodium) is vitally important to resolution of the organics, and thus to resolution of the tube failure ($b_T$) term. Given such inter-dependencies, it is most likely that when assuming $b_T=0.0$, when in fact a tube is leaking, one or more fuel molar quantities ($\alpha_1, \alpha_2, \ldots \alpha_{14}, \alpha_{15}, \alpha_{16}$) will compute outside reasonability limits or even as negative values. Experience applying this invention has taught that fuel water will commonly compute as negative, even with a moderate leak when initially assuming $b_T=0.0$ in Eq.(200).

In like manner, and especially for small leaks (when assuming $b_T=0.0$), the fuel carbon, hydrogen and sodium terms could exceed reasonability limits; where for example, assuming that the constant $B_5$ is negative and $C_5$ is zero (which is typical for black liquor fuels): $\alpha_{MAF\text{-}5}<\alpha_{MAF\text{-}5/min}$ and/or $\alpha_{MAF\text{-}4}>\alpha_{MAF\text{-}4/max}$. Such behavior when using Eq.(200), when first assuming $b_T=0.0$ and then evaluating for reasonability limits, leads directly to an indication of tube leakage. This process is termed a possible Tube Failure Mechanism, that is an indication of possible tube leakage has been found by applying stoichiometric considerations (min/max checks); however further processing is called for to determine its validity and, if a valid leak, then to determine its mass flow rate and the location of the leak.

To fully expand the concept of Tube Failure Mechanisms, TABLE 1A and TABLE 1B teach 35 such mechanisms, identified by a number, of how a tube failure may be detected through stoichiometrics, knowledge of such detection mechanism being important to the system operator. TABLE 1A presents static trip mechanisms, while TABLE 1B presents dynamic trip mechanisms related to rates of change. Experience in demonstrating this invention at two large power plants has indicated that making assumptions as to "apparently" impossible Tube Failure Mechanisms is not advised. Thus both minimum and maximum trip mechanisms are demonstrated in TABLE 1A, as all are tested when monitoring a thermal system on-line when invoking the methods of this invention (i.e., invoking The Input/Loss Method's "Tube Failure Model"). For example, a cursory evaluation would suggest that a low fuel water concentration ($\alpha_{MAF\text{-}2}$ or $WF_{H2O}$) could not indicate a tube failure given the mechanics of Eq.(200). However, if the thermal system experiences a small but steadily increasing tube leakage The Input/Loss Method of '879 could steadily correct effluent water concentration downwards, causing failure mechanism #41 or #51; or water correction factors might exceed a lower bound causing failure mechanism ID #71. But also, unplanned scenarios of how The Input/Loss Method is correcting effluent water and other Choice Operating Parameters could create unexpected Tube Failure Mechanisms through complex stoichiometric relationships. Such considerations thus call for a blanket examination of all trip mechanisms, which is the Preferred Embodiment. TABLE 1A encompasses the most likely of stoichiometric mechanisms based on the experiences gained demonstrating this invention, while TABLE 1B encompasses likely rates of change of relevant parameters. Note that several of the rate mechanisms indicated in TABLE 1B were found by testing the methods of this invention at a power plant; specifically Tube Failure Mechanism #64, #121 and #131 were found unusually sensitive. However, in extending the teachings of this invention as taught through TABLE 1A and TABLE 1B, there are other Tube Failure Mechanisms which may become apparent without departing from the scope and spirit of the present invention.

TABLE 1A

Static Tube Failure Mechanisms

| Mech. ID | Trip Mechanism | Comments |
|---|---|---|
| 11 | $J_{Act} < J_{Act/min}$ | Effluent $H_2O$ concentration at Stack; min. $J_{Act}$ is not likely. |
| 12 | $J_{Act} > J_{Act/max}$ | Effluent $H_2O$ concentration at Stack. |
| 21 | $\alpha_{MAF-4} < \alpha_{MAF-4/min}$ | MAF molar fraction of carbon; min. $\alpha_{MAF-4}$ is not likely. |
| 22 | $\alpha_{MAF-4} > \alpha_{MAF-4/max}$ | MAF molar fraction of fuel carbon. |
| 23 | Negative square root. | Resolution of MAF carbon ($\alpha_{MAF-4}$) may require solving a second order equation, thus the possibility of tripping on a negative square root (or any mathematical indeterminate). |
| 31 | $\alpha_{MAF-5} < \alpha_{MAF-5/min}$ | MAF molar fraction of fuel hydrogen. |
| 32 | $\alpha_{MAF-5} > \alpha_{MAF-5/max}$ | MAF molar fraction of hydrogen; max. $\alpha_{MAF-5}$ is not likely. |
| 41 | $\alpha_{MAF-2} < \alpha_{MAF-2/min}$ | MAF molar fraction of fuel water. |
| 42 | $\alpha_{MAF-2} > \alpha_{MAF-2/max}$ | MAF molar fraction of fuel water. |
| 51 | $WF_{H2O} < WF_{H2O/min}$ | As-Fired weight fraction of fuel water. |
| 52 | $WF_{H2O} > WF_{H2O/max}$ | As-Fired weight fraction of fuel water. |
| 61 | $\alpha_{MAF-1} < \alpha_{MAF-1/min}$ | MAF molar fraction of nitrogen in fuel; nitrogen is computed by balance: $\alpha_{MAF-1} = 1.0 - \Sigma\alpha_{MAF-k,k=1,2,10.}$ |
| 62 | $\alpha_{MAF-1} > \alpha_{MAF-1/max}$ | MAF molar fraction of nitrogen in fuel; nitrogen is computed by balance: $\alpha_{MAF-1} = 1.0 - \Sigma\alpha_{MAF-k,k=1,2,10.}$ |
| 71 | $C_{2S} < C_{2S/min}$ | Correction factor for effluent $H_2O$. |
| 72 | $C_{2S} > C_{2S/max}$ | Correction factor for effluent $H_2O$. |
| 81 | $C_{1S} < C_{1S/min}$ | Correction factor for effluent $CO_2$. |
| 82 | $C_{1S} < C_{1S/max}$ | Correction factor for effluent $CO_2$. |
| 91 | $\alpha_{MAF-14} < \alpha_{MAF-14/min}$ | MAF molar fraction of sodium in fuel. |
| 92 | $\alpha_{MAF-14} < \alpha_{MAF-14/max}$ | MAF molar fraction of sodium in fuel. |
| 99 | $m_T > 0.0$ | Tube leakage found in previous monitoring cycle. |

TABLE 1B

Dynamic Tube Failure Mechanisms

| Mech. ID | Trip Mechanism | Comments |
|---|---|---|
| 14 | $d(J_{Act})/dt > Limit$ | Rate of change in uncorrected effluent $H_2O$. |
| 15 | $d(C_{2S}J_{Act})/dt > Limit$ | Rate of change in corrected effluent $H_2O$. |
| 24 | $d(D_{Act})/dt > Limit$ | Rate of change in uncorrected effluent $CO_2$. |
| 25 | $d(C_{1S}D_{Act})/dt > Limit$ | Rate of change in corrected effluent $CO_2$. |
| 64 | $d(G_{Act})/dt > Limit$ | Rate of change in uncorrected effluent $O_2$. |
| 66 | $d(C_{7S}G_{Act})/dt > Limit$ | Rate of change in corrected effluent $O_2$. |
| 67 | $d(C_{7S})/dt > Limit$ | Rate of change in the correction to effluent $O_2$. |
| 74 | $d(C_{2S})/dt > Limit$ | Rate of change in the correction to effluent $H_2O$. |
| 84 | $d(C_{1S})/dt > Limit$ | Rate of change in the correction to effluent $CO_2$. |
| 101 | $d(L'_{Fuel})/dt > Limit$ | Rate of change in the computed L-Factor. |
| 103 | $d(HHV_{AF})/dt > Limit$ | Rate of change in the computed heating value. |
| 109 | $d(m_{AF})/dt > Limit$ | Rate of change in the computed fuel flow. |
| 111 | $d(WF_{H2O})/dt > Limit$ | Rate of change in the computed fuel water fraction. |
| 121 | $d[C_{2S}J_{Act}/(C_{7S}G_{Act})]/dt > Limit$ | Rate of change in the parameter of corrected effluent $H_2O$ divided by the corrected effluent $O_2$. |
| 131 | $d[m_{AF}/HHV_{AF}]/dt > Limit$ | Rate of change in the parameter of computed fuel flow divided by computed fuel heating value. |

It is an important aspect of the present invention that it may be integrally involved with any of the Input/Loss methods which compute fuel chemistry. As seen with the use of TABLE 1A, without a determination of fuel chemistry, i.e., computing $\alpha_i$ quantities based on consistent stoichiometrics (with or without tube leakage), then the use of Eq.(200) as taught herein to detect tube leaks would become limited. More specifically, this invention is integrally involved with The Input/Loss Method of '994 and '879 as the determination of fuel chemistry is then based on a selection of Choice Operating Parameters which might well require corrections for stoichiometric consistencies. For example, if effluent water was being measured, but whose signal was not corrected for stoichiometric consistency as taught in '879, resolution of tube leaks (even with computed $\alpha_i$ quantities) would be hampered; especially so if fuel chemistry was assumed constant.

Minimization Techniques, Background

The following four paragraphs teach the use of multidimensional minimization techniques, including the use of System Effect Parameters and Choice Operating Parameters. Taught is how their use allows resolution of flow rates associated with tube failures. Although only the Simulated Annealing technique is the Preferred Embodiment for determining tube failure flow rate, discussion of all techniques, including neural networks, is made to present the full scope and spirit of this invention.

Any number of multidimensional minimization techniques may be used by this invention; to provide full teaching four are discussed in detail. All techniques seek to minimize the numerical value of an objective function. The techniques discussed include: Broyden-Fletcher-Goldfarb-Shanno (BFGS), generic Conjugate Gradient, Newton-Raphson and Simulated Annealing techniques; references cited below. These techniques, and, notably, their combinations, are designed to address all situations of bias in Choice Operating Parameters. All of these techniques, except Simulated Annealing, employ derivatives of the objective function with respect to the independent variable. These techniques all require input of initial values of Choice Operating Parameters ($\Lambda_{0-i}$). The BFGS, generic Conjugate Gradient and Newton-Raphson techniques employ unconstrained searches towards optima. Simulated Annealing employs a random but constrained search through which the Choice Operating Parameters are numerically bounded by lower and upper limits. From research and study conducted to develop this invention, the objective functions described below have proven to be superior for a wide variety of thermal systems burning any fossil fuels.

A common problem facing minimization techniques is the so-called shallow valley problem in which an appreciable change in an independent variable has a small effect on the objective function, even through that change is both real and appropriate to the physical system. This is especially true when applied to the determination of tube leakage flow rate in which a single and small tube failure of, say, 5000 lbm/hr in a large steam generator might represent ≈0.1% or less, of its feedwater flow. Study conducted for the development of this invention, and considered unique to it, has found that the Bessel function of the first kind is ideally suited to diminish the impact of the shallow valley problem. The Bessel function emulates the sensitivity that important Choice Operating Parameters have on both System Effect Parameters and on the descriptive thermal system in general. The Bessel function of the first kind of order zero ($J_0$) has a relatively flat (shallow) functionality as its argument approaches zero. Apart from this situation, the function offers non-linearity which is advantageous in converging out-lying arguments. Of great importance to those techniques employing derivatives, is that the derivative of $J_0$ is a Bessel function of the first kind of order one ($J_1$), having a high degree of sensitivity as its argument approaches zero. This derivative relationship addresses a significant number of shallow valley problems presented by Choice Operating Parameters associated with fossil-fired systems. Another technique addressing the shallow valley problem and involving use of the Bessel function is the formulation of its argument, termed either $\lambda_L$, $\lambda_W$, $\lambda_H$ or $\lambda_T$ [i.e., $J_0(\lambda_L)$, $J_0(\lambda_W)$, $J_0(\lambda_H)$ or $J_0(\lambda_T)$]; these arguments are fully discussed below, being defined by Eqs.(202A), (202B), (202C) and (202D).

The objective function, F, is a function of independent variables $\vec{x}$, i.e., $F(\vec{x})$. Of uniqueness to this invention, to address inter-dependencies of the Choice Operating Parameters, $x_i$ is defined as a scaled Choice Operating Parameter ($\Lambda_i$) using the scaling factor $S_i$; where, initially: $x_{0-i} \equiv S_i \Lambda_{0-i}$; further discussed in Paragraph 0102. By design, Choice Operating Parameters which directly effect system stoichiometrics are used by The Input/Loss Method to compute certain parameters which impact the determination of system efficiency. These certain parameters are termed System Effect Parameters and, for the Preferred Embodiment, include four general types and their associated reference values: the L Factor concept ($L_{k1}$); the As-Fired fuel flow ($m_{AF}$); the higher heating value ($HHV_{k3}$); and the As-Fired fuel water fraction ($WF_{H2O}$). Two L Factors are presented, $L'_{Fuel}$ and $L_{CO2}$ as defined by Eqs.(272) & (273). The higher heating value is chosen as either: an uncorrected As-Fired value, $HHV_{AF}$; a Dry value, $HHV_{DRY}$; and/or a MAF value, $HHV_{MAF}$. As the Preferred Embodiment, the As-Fired fuel water fraction is selected only when determining tube leakage flow rates. However, the system operator may select from any one or more or all of these System Effect Parameters (including any one or more or all of the heating values), whose differences with respect to reference values are minimized by altering the selected Choice Operating Parameters through minimization techniques. The minimization techniques are structured to minimize differences between a System Effect Parameter and its corresponding "Reference System Effect Parameter" (termed: $L'_{Fuel-Ref}$, $L_{CO2-Ref}$, $m_{AF-PLT}$, $HHV_{k3-Ref}$, and $WF_{H2O-Ref}$). System Effect Parameters are chosen such that they reflect influences on system efficiency through Choice Operating Parameters, and, at the same time, reflect inter-dependencies of the Choice Operating Parameters. For example: changes in the concentration of effluent $CO_2$ (defined as $\Lambda_{1S}$ or $\Lambda_{1B}$) if caused by changes in the fuel will effect computed fuel chemistry, computed heating value and computed boiler efficiency, all of which impact system efficiency. However a change in $CO_2$ (measured as a wet concentration) may be caused by a change in the concentration of effluent $H_2O$ (defined as $\Lambda_{2S}$ or $\Lambda_{2B}$), or a change in combustion air effecting effluent $O_2$ (defined as $\Lambda_{7B}$ or $\Lambda_{7S}$), or a change in the fuel's Sodium to Carbon Ratio (defined as $\Lambda_9$), where any of these changes themselves may directly effect computed fuel flow and fuel chemistry; thus the importance of inter-dependency of Choice Operating Parameters.

The following summarizes the objective functionalities for the Preferred Embodiment, demonstrating the aforementioned principles:

$$F(\vec{x}) = \Sigma_{i \in I} f[S_i, J_0(\lambda_L), J_0(\lambda_W), J_0(\lambda_H), J_0(\lambda_T)]$$
$$\Lambda_L = f[L_{k1}, L_{k1-Ref}, M_L]$$
$$\Lambda_W = f[m_{AF}, m_{AF-PLT}, \Delta m_{AF}, M_W]$$
$$\Lambda_H = f[HHV_{k3}, HHV_{k3-Ref}, M_H]$$
$$\Lambda_T = f[WF_{H2O}, WF_{H2O-Ref}, M_T]$$

The symbol $\Sigma_{i \in I}$ is defined following Eq.(203). Note that as $F(\vec{x})$ is minimized the quantities $\vec{\Lambda}$ are updated in turn ($\Lambda_i = x_i/S_i$), thus allowing System Effect Parameters to be computed leading directly to the computation of $\lambda_L$, $\lambda_W$, $\lambda_H$ and $\lambda_T$. System Effect Parameters have general dependency on Reference Fuel Characteristics, including the following important inter-relationships: computed fuel chemistry is dependent on several or all Choice Operating Parameters, $\vec{\Lambda}$; computed heating values ($HHV_{k3}$, LHVP and HHVP) are dependent on fuel chemistry, thus $\vec{\Lambda}$; and boiler efficiency ($\eta_B$) determined using the methods herein and those of '429, is dependent directly on $\Lambda_i$ effluents $CO_2$ and $O_2$, is also dependent on fuel chemistry, and is also dependent on heating value, thus $\vec{\Lambda}$. All of these quantities (fuel chemistry, heating values and boiler efficiency) are also dependent on in-leakage of working fluid into the combustion path, the terms $b_Z$ and $b_T$. Working fluid energy flow (BBTC), the Firing Correction HBC and the Δenthalpy term associated with tube failure energy flow ($m_T \Delta h$), are all dependent on Operating Parameters.

$$x_i \equiv S_i \Lambda_i$$
$$L_{k1} = f[\text{fuel chemistry}(\vec{\Lambda})]$$
$$m_{AF} = f[(BBTC - m_T \Delta h), \eta_B(\vec{\Lambda}), HHVP(\vec{\Lambda}), HBC]$$
$$HHV_{k3} = f[\text{fuel chemistry}(\vec{\Lambda})]$$

$WF_{H2O}$=f[tube leakage flow rate ($\Lambda_8$), fuel chemistry($\vec{\Lambda}$)].

System Effect Parameters

As discussed, System Effect Parameters include four general types of parameters and their associated reference values: the L Factor ($L_{k1}$); the As-Fired fuel flow ($m_{AF}$); the higher heating value ($HHV_{k3}$); and the As-Fired fuel water fraction ($WF_{H2O}$). The most important of these is the L Factor, used routinely for most situations. The higher heating value may be employed, for example, when the thermal system is operating under controlled conditions (e.g., under a testing program), in which its fuel is well characterized. Also, during initial installation of a Calculational Engine, heating value may be used for scoping the range of reasonable correction factors. Fuel flow is discussed below. The As-Fired fuel water fraction is typically used for the special case of computing the tube leakage mass flow rate, $m_T$.

The L Factor is important in reducing the impact of the shallow valley problem found with fossil-fired systems. An important reason for this is that both $L'_{Fuel}$ and $L_{CO2}$ have been demonstrated to have remarkably small standard deviations for fossil fuels, including black liquor fuels. For example, some Ranks of coal have $L'_{Fuel}$ standard deviations as low as ±0.05%. Although black liquor dry chemistries may vary widely depending on the particular process, a given process will typically produce a highly consistent L Factor (either $L'_{Fuel}$ or $L_{CO2}$). Use of $L'_{Fuel}$ as a System Effect Parameter is the Preferred Embodiment, that is when $L'_{Fuel}$ is computed using Eq.(272) or its equivalence. For black liquor fuels the methods taught in '563 and '879 require modification to address the fuel's inorganic compounds, although the principles taught in '563 and '879 remain and are applicable. Specifically the L Factor is computed based on theoretical combustion of dry fuel, thus: $\Phi_R=\alpha_{MAF\text{-}2}=\alpha_{DRY\text{-}2}=b_A=b_Z=b_T G_{Act}=e_{Act}=m_{Act}=k_{BL}=v=0.0$; and $\sigma_N=R_{Act}=1.0$; and $\phi_{Act}=\phi_{Ref}$.

$$L'_{Fuel} \equiv 10^6[x_{DRY-theor}N_{DRY-Fuel}+a_{DRY-theor}(1.0+\phi_{Ref})N_{Air}-(J_{theor}N_{H20}+x_{DRY-theor}\nu_{MAF\text{-}10}N_{Ash}+\sigma_N T_{NC}N_{NaCl}+\sigma_N(T_{NO}+k_{BL})N_{Na2CO3}+\sigma_N T_{NA}N_{Na2SO4}+\sigma_N T_{KO}N_{K2CO3})]/(x_{theor}N_{Fuel}HHV_{AF}) \quad (272)$$

In addition to $L'_{Fuel}$, the $L_{CO2}$ factor has shown promise when used as a System Effect Parameter as based exclusively on $CO_2$, given in common units of measure as (lbm dry $CO_2$ effluent)/million-$Btu_{Fuel}$. Note that $D_{theor}$ is the effluent $CO_2$ based on theoretical combustion of dried fuel (computed with the same philosophy as used to determine $J_{theor}$).

$$L_{CO2}\equiv 10^6[D_{theor}N_{CO2}]/(x_{DRY\text{-}theor}N_{DRY\text{-}Fuel}HHV_{DRY}) \quad (273)$$

The following identities have been found useful in determining the L Factor, and for reducing the solution problem associated with Eq.(19BL):

$$x_{MAF-theor}N_{MAF-Fuel}HHV_{MAF} = x_{theor}N_{Fuel}HHV_{AF} \quad (274)$$

$$= x_{DRY-theor}N_{DRY-Fuel}HHV_{DRY} \quad (275)$$

When black liquor is burned in a bomb calorimeter for determination of its heating value, ideal solid products—as assumed when using Eq.(272) or (273) based on Eq.(19BL), consist of the following inorganics: $Na_2CO_3$, $Na_2SO_4$, NaCl and $K_2CO_3$. However, other ideal products could be produced depending on the nature of the fuel, its mix of components, combustion conditions and the nature of its chemical equilibrium. Whether potassium forms $K_2CO_3$, $K_2SO_4$ and/or $K_2S$, or forms the same compounds as sodium in the same proportions, or whether fuel potassium is simply combined with fuel sodium as is a common chemistry assumption, does not affect the general scope and spirit of the present invention. Three tools may be used to determine such ideal compounds as would then be used to modify Eq.(272), the boiler efficiency computations, Eq.(19BL), and throughout this disclosure: 1) direct laboratory analysis of the bomb calorimeter's residue; 2) operational experience; and/or 3) modeling ideal combustion of black liquor using the software "HSC Chemistry 5" commercially available from Outokumpu Research Oy, Pori, Finland (www.HSC@Outokumpu.com).

Along with the L Factor, the system operator may also choose, in any combination, the plant's indicated fuel flow, the As-Fired heating value, the dry heating value, the MAF heating value, and/or the fuel's average water fraction as System Effect Parameters. Although the system operator has complete flexibility, with this flexibility must apply common engineering judgement. For example, optimizing effluent water against $HHV_{MAF}$ or $HHV_{DRY}$ (heating values without water) would make little sense given the lack of connectivity.

When selecting the system's indicated fuel flow ($m_{AF\text{-}PLT}$) as a Reference System Effect Parameter, the recovery boiler's operator should proceed with caution. The flow measurement of black liquor feeding a recovery boiler requires an assessment as to its consistency and whether the flow measurement encompasses the total feed of fuel. This invention teaches that the minimization techniques may be used to minimize the difference between a computed fuel flow ($m_{AF}$) and the system's indicated fuel flow ($m_{AF\text{-}PLT}$), with an off-set $\Delta m_{AF}$, through converged Choice Operating Parameters. Thus, the method of this invention allows use of the system's indicated fuel flow to aid in the determination of computed fuel chemistry, fuel heating value and system efficiency. Although not required, for many situations it is the Preferred Embodiment that use of the system's fuel flow be accompanied with either $L'_{Fuel}$ or $L_{CO2}$ of Eqs.(272) or (273), to assist with stability and reasonableness of solution. To further enhance stability and reasonableness of solution the recovery boiler's operator may option to limit the range of fuel concentrations determined by the methods of this invention. The operator may also limit the numerical range of the selected Choice Operating Parameters when using the Simulated Annealing technique. Further, to aid in addressing a possible error in $m_{AF\text{-}PLT}$, both an off-set ($\Delta m_{AF}$) in this parameter and a Dilution Factor ($M_W$) may be applied to the relationship between $m_{AF}$ and $m_{AF\text{-}PLT}$; see Eq.(202B) below.

In summary, the process involving the minimization of differences in System Effect Parameters, by optimizing Choice Operating Parameters, results in converged Choice Operating Parameters $\Lambda_{F\text{-}i}$; correction factors, $C_i$, are then determined as based on the ratio of the converged Choice Operating Parameter to their initial values ($\Lambda_{0\text{-}i}$). $\Lambda_{0\text{-}i}$ are based on the system's raw instrumentation signal, a previous converged solution, an estimate, a guess or as otherwise determined.

$$C_i\equiv\Lambda_{F\text{-}i}/\Lambda_{0\text{-}i} \quad (201)$$

Minimization Techniques, Formulations

This sub-section presents general discussions of the multidimensional minimization techniques and detailed formulations useful to the plant operator in minimizing errors in System Effect Parameters.

The BFGS technique represents a second generation of multidimensional minimization techniques. As such, it is considered one of the most robust of techniques for a well conditioned problem. The particular BFGS technique employed by The Input/Loss Method has a superior reputation for convergence. The only input parameters the user need be concerned with are the initial relative step-length and the change in the relative step-length. A well-chosen initial relative step-length will prevent long iterations (a value of 0.100 to 0.200 is recommended). The change in the relative step-length impacts resolution of the shallow valley problem, and may be varied until proper convergence patterns are established. A value between 0.010 to 0.040 for the change in the relative step-length has been found to be satisfactory when used in conjunction with the scaling techniques taught herein. The BFGS technique is the preferred method for use on a continuous bases after the problem has been properly conditioned with scaling factors, and selections of Choice Operating and System Effect Parameters have been established. These input parameters are also applicable to the generic Conjugate Gradient technique.

The generic Conjugate Gradient technique represents a first generation of multidimensional minimization techniques. For numerical processing reasons the BFGS technique has been demonstrated to be superior in to the generic Conjugate Gradient in convergence techniques and accuracy. However, there may be situations in which a generic Conjugate Gradient may be useful as an alternative once the problem has been conditioned.

The Newton-Raphson method is one of the oldest and simplest multidimensional minimization techniques. This method requires the objective function's compounded vector gradient, resulting in a Jacobian determinant. Generally it will yield an efficient means of convergence but requires reasonable initial Choice Operating Parameters ($\Lambda_{0-i}$); however, without such reasonableness it may fail wildly. Newton-Raphson is recommended for possible use only after the BFGS technique has failed to meet its convergence criteria It has applicability given its use of the Jacobian determinant, through which forming explicit inter-dependencies between System Effect Parameters and all Choice Operating Parameters are employed. This assures computed dependencies, if such dependencies exist. This intrinsic feature has been found to be of importance when resolving certain power plant problems. The Preferred Embodiment is to automatically default from BFGS, given failure to meet its convergence (typically due to a lack of established inter-dependencies of Choice Operating Parameters) to, first, the Newton-Raphson, and then in-turn, given its failure, to Simulated Annealing. Newton-Raphson may also be used for scoping initial installations of The Input/Loss Method given difficult combinations of System Effect and Choice Operating Parameters.

The Simulated Annealing technique, because it employs a global, constrained search methodology, is the Preferred Embodiment for initial study of a new Input/Loss installation and for determining tube leakage flow rate. It may also be used to assist in the selection of which Choice Operating Parameters are best for a particular thermal system. This procedure simulates the annealing process of metal, requiring the controlled reduction of a pseudo-temperature (herein termed "pseudo-T") to achieve a desired result (i.e., achieving a minimum potential energy of the metal's structure when slowly cooled, thus the minimizing of an objective function). This is a brute force approach involving random search; gradients are not used. As a global optimization procedure it may move both downhill and uphill (that is, it may move both towards and away from local optima), resulting in distinction between different local optima. Conventional optimization techniques (BFGS, generic Conjugate Gradient and Newton-Raphson) only move downhill when minimizing an objective function. Conventional techniques are blind to a global solution in the sense they immediately choose the downhill direction. When addressing fossil-fired combustion problems this may lead to optimizing on the most sensitive of a given selection of Choice Operating Parameters (most likely $CO_2$, thus $\Lambda_{1S}$ or $\Lambda_{1B}$). Distinction between different local optima is accomplished by first starting with initial $\Lambda_{0-i}$ values, then successively evaluating randomly acquired changes, $\vec{\Lambda}$, but which fall within user-defined step-lengths. Initially this results in coarse study of the objective function, employing large step-lengths, requiring repeated evaluations with seemingly little progress. In the process of choosing $\vec{\Lambda}$ values the algorithm generally attempts to move downhill, however it also moves uphill in a probabilistic manner to escape local optima Step-lengths are dynamically chosen such that half of all uphill moves are randomly accepted, again helping to ensure that the function escapes local optima. As the annealing process proceeds and the algorithm closes on the global optimum, step-lengths decrease as the pseudo-T decreases requiring even more objective function evaluations as the optimum is approached. By viewing objective functions in general terms and with its ability to move probabilistically uphill, Simulated Annealing solves functions that are otherwise difficult to resolve, including shallow valley problems associated with fossil combustion and tube leakages. However, with such flexibility comes numerous objective function evaluations necessitating long computing times. In addition, converged solutions should be re-tested periodically with different seeds (i.e., initializations of the random number generator) to assure a global optimum.

When applied to fossil-fired combustion, the more sensitive inputs to the Simulated Annealing technique include the following: starting point $\Lambda_{0-i}$ values; the number of cycle evaluations (5 is recommended); the minimum and maximum values associated with each $\Lambda_i$ (i.e., defining the region containing the optimum); an initial pseudo-T (0.100 is recommended); and the relative change in pseudo-T (i.e., the step-length, 0.010 to 0.020 is recommended). Each of these inputs may be established by sensitivity study to assure a robust solution, or as otherwise determined. Minimum and maximum $\Lambda_i$ values may also be established by review of historical system data or through the experience of the system operator. The smaller the range between minimum and maximum $\Lambda_i$ values, the tighter the search becomes with the final solution becoming narrowed. This feature is especially useful when As-Fired fuel flow or As-Fired fuel water fraction are selected as a System Effect Parameters (in combination with non-unity Dilution Factors, $M_W$ and $M_T$).

Objective Function and Choice Operating Parameters

The following paragraphs present the preferred objective functions and their solution methodologies and specify the Choice Operating Parameters which may be employed by minimization techniques. As explained, the Bessel function is used to define the objective function. The Bessel function's argument, as taught by this invention, has been chosen to aid in addressing the shallow valley problem and in convergence of the minimization techniques. The formulations presented produce quantities which may allow numerical inter-dependencies between Choice Operating Parameters ($\vec{\Lambda}$), or not, depending on which minimization technique is chosen. This is important for addressing problems in which initial Choice Operating Parameters lie far from the optimum. This is also important where more than one System Effect Parameter is chosen which may present unique numerical convergence problems.

For the BFGS, generic Conjugate Gradient, Newton-Raphson and Simulated Annealing techniques the objective function is given by the following. Note that $M_L$, $M_W$, $M_H$ and $M_T$ are real numbers; $M_L$ & $M_H$ are typically equal to one, while $M_W$ & $M_T$ are typically greater than one. Again, the System Effect Parameters, $L_{k1}$, $m_{AF}$, $HHV_{k3}$ and $WF_{H2O}$, are functions of a set of $\Lambda_i$.

$$\Lambda_L=[(L_{k1}-L_{k1\text{-}Ref})/L_{k1\text{-}Ref}]^{M_L} \tag{202A}$$

$$\Lambda_W=[(m_{AF}-m_{AF\text{-}PLT}-\Delta m_{AF})/(m_{AF\text{-}PLT}+\Delta m_{AF})]^{M_W} \tag{202B}$$

$$\Lambda_H=[(HHV_{k3}-HHV_{k3\text{-}Ref})/HHV_{k3\text{-}Ref}]^{M_H} \tag{202C}$$

$$\Lambda_T=[(WF_{H2O}-WF_{H2O\text{-}Ref})/WF_{H2O\text{-}Ref}]^{M_T} \tag{202D}$$

$$F(\vec{x})=\sum_{i\in I}\{S_i[1.0-J_0(\lambda_L)]+S_i[1.0-J_0(\lambda_W)]+S_i[1.0-J_0(\lambda_H)]+S_i[1.0-J_0(\lambda_T)]\} \tag{203}$$

In Eq.(202B) $\Delta m_{AF}$ is an off-set, or bias, observed in the indicated flow, $m_{AF\text{-}PLT}$. In Eq.(203) and as used elsewhere, the symbol $\Sigma_{i\in I}$ indicates a summation on the index i, where i variables are contained in the set I defined as the elements of $\vec{\Lambda}$. For example, assume the user has chosen the following: $\Lambda_{1S}$ is to be optimized to minimize the error in $L'_{Fuel}$ and $HHV_{MAF}$, $\Lambda_{2S}$ is optimized for $L'_{Fuel}$ and $m_{AF}$ ($M_W$=1.40, $\Delta m_{AF}$=0.0), $\Lambda_4$ is optimized for $L'_{Fuel}$, and $\Lambda_{7B}$ is optimized for $L'_{Fuel}$. Therefore: $\vec{\Lambda}=(\Lambda_{1S}, \Lambda_{2S}, \Lambda_4, \Lambda_{7B})$, $I=\{\Lambda_{1S}, \Lambda_{2S}, \Lambda_4, \Lambda_{7B}\}$, thus $\vec{x}=(x_1, x_2, x_3, x_4)$; $x_1=S_1\Lambda_{1S}$; $x_2=S_2\Lambda_{2S}$; $x_3=S_3\Lambda_4$; $x_4=S_4\Lambda_{7B}$; where Eq.(203) for this example than becomes:

$$F(\vec{x})=S_1\{[1.0-J_0(\lambda_L)]+[1.0-J_0(\lambda_H)]\}+S_2\{[1.0-J_0(\lambda_L)]+[1.0-J_0(\lambda_W)]\}+S_3[1.0-J_0(\lambda_L)]+S_4[1.0-J_0(\lambda_L)]$$

Derivatives $\partial F/\partial x_i$ for the BFGS and generic Conjugate Gradient techniques, based on Eq.(203), are given by the following:

$$\partial F/\partial x_i=\partial F/(S_i\partial\Lambda_i) \tag{204}$$
$$J_1(\bar{\lambda}_L)[\partial\lambda_L/\partial\Lambda_i]+J_1(\bar{\lambda}_W)[\partial\lambda_W/\partial\Lambda_i]+J_1(\bar{\lambda}_H)[\partial\lambda_H/\partial\Lambda_i]+J_1(\bar{\lambda}_T)[\partial\lambda_T/\partial\Lambda_i]$$

where, for example:

$$[\partial\lambda_W/\partial\Lambda_i]=M_W[(\overline{m}_{AF}-m_{AF\text{-}PLT}-\Delta m_{AF})/(m_{AF\text{-}PLT}+\Delta m_{AF})]^{M_W-1}(\partial m_{AF}/\partial\Lambda_i)/(m_{AF\text{-}PLT}+\Delta m_{AF});$$

and where $\bar{\lambda}_L$, $\bar{\lambda}_W$, $\bar{\lambda}_H$, $\bar{\lambda}_T$ and $\overline{m}_{AF}$ are taken as average values. Gradients, $\partial F_i/\partial x_j$, for the Newton-Raphson method, thus defining the Jacobian determinant, are given by the following:

$$\partial F_i/\partial x_j=\partial F_i/(S_j\partial\Lambda_j) \tag{205}$$
$$S_iJ_1(\bar{\lambda}_L)[\partial\lambda_L/(S_j\partial\Lambda_j)]+S_iJ_1(\bar{\lambda}_W)[\partial\lambda_W/(S_j\partial\Lambda_j)]+S_iJ_1(\bar{\lambda}_H)[\partial\lambda_H/(S_j\partial\Lambda_j)]+S_iJ_1(\bar{\lambda}_T)[\partial\lambda_T/(S_j\partial\Lambda_j)]$$

where, for example:

$$[\partial\lambda_W/\partial\Lambda_j]=M_W[(\overline{m}_{AF}-m_{AF\text{-}PLT})/m_{AF\text{-}PLT}]^{M_W-1}(\partial m_{AF}/\partial\Lambda_j)/(m_{AF\text{-}PLT}+\Delta m_{AF}).$$

In the Preferred Embodiment, selection of Choice Operating Parameters may be made by the system operator from any combination or all of the following:

$\Lambda_{1S}=D_{Act}$; Stack $CO_2$ (with effects from air pre-heater leakage) (211S)

$\Lambda_{1B}=D_{Act}R_{Act}$; Boiler $CO_2$ (without effects from air pre-heater leakage) (211B)

$\Lambda_{2S}=J_{Act}\equiv j+b_A\beta$; Stack $H_2O$ (with moisture from air pre-heater leakage) (212S)

$\Lambda_{2B}=jR_{Act}$; Boiler $H_2O$ (without moisture from air pre-heater leakage) (212B)

$\Lambda_3$=AF; Air/Fuel mass ratio (213)

$\Lambda_4=R_{Act}$; Air Pre-Heater Leakage Factor (214)

$\Lambda_5=A_{Act}$; Concentration of $O_2$ in the boundary air (215)

$\Lambda_6=m_{LS}$; Indicated limestone flow rate (216)

$\Lambda_{7S}=G_{Act}=(g+2\sigma_NT_{NS}+\sigma_Nk_{BL}/2)+a\beta$; Stack $O_2$ (with air pre-heater leakage) (217S)

$\Lambda_{7B}=R_{Act}(g+2\sigma_NT_{NS}+\sigma_Nk_{BL}/2)$; Boiler $O_2$ (without air pre-heater leakage) (217B)

$\Lambda_8=m_T$; Tube leakage flow rate (218)

$\Lambda_9=\Phi_N$; Sodium to Carbon Ratio in the fuel (219)

$\Lambda_{10}=\Phi_R$; Reduction Efficiency (220)

The selection of one or more of the Choice Operating Parameters must depend on common understanding of recovery boiler stoichiometrics and associated relationships to physical equipment. Specifically, The Input/Loss Method produces, by employing one or more of the minimization techniques (within the ERR-CALC computer program), converged Choice Operating Parameters and correction factors $C_i$ applied to the initial values $\Lambda_{0\text{-}i}$. The converged Choice Operating Parameters are then used within the Fuel Iterations to produce a computed fuel chemistry, discussed in conjunction with FIG. 2 and FIG. 3. A monitoring cycle, processing Fuel Iterations, may be scheduled as frequently as desired; each cycle employing correction factors produced by ERR-CALC at the same or slower frequency. For example, ERR-CALC could be processed (producing updated correction factors) once per day, while Fuel Iterations could be processed once every 2 minutes using 15 minute running averages of Operating Parameters.

In the above paragraph, the phase "common understanding of recovery boiler stoichiometrics and associated relationships to physical equipment" is meant the routine knowledge base a system operator should have concerning his/her thermal system. To thoroughly teach this invention, examples of such common understanding and their associated impacts on this invention follow: if limestone ($\Lambda_6$) is not used, the system operator would not select limestone flow as a Choice Operating Parameter as such a selection would result in an unity correction factor, non-convergence, warning messages, and/or a faulted condition produced from ERR-CALC; the selection of the Air Pre-Heater Leakage Factor ($\Lambda_4$) would not be made if the system uses a tubular exchanger which has no air leakage (as designed), and would result in a similar faulted condition; the selection of the air/fuel ratio ($\Lambda_3$) leading to determination of the fuel inert fraction, and also invoking a constant fuel inert assumption, would not be made as such a selection would result in a similar faulted condition; the selection of Boiler $CO_2$ ($\Lambda_{1B}$), an Air Pre-Heater Leakage Factor ($\Lambda_4$), and Boiler $O_2$ ($\Lambda_{7B}$), given that "correcting" the air pre-heater leakage would have no effect on the Boiler-side mix of $CO_2$ and $O_2$, would result in a similar faulted condition; the selection of the Sodium to Carbon Ratio in the fuel ($\Lambda_9$) would not be made if periodic fuel analyses indicates a constant ratio.

The use of the exponents $M_L$, $M_W$, $M_H$ and $M_T$ in Eqs.(202A), (202B), (202C) and (202D), termed Dilution Factors, allows a dilution or dampening of the functionality between Reference System Effect Parameters ($L_{k1\text{-}Ref}$, $m_{AF\text{-}PLT}$, $HHV_{k3\text{-}Ref}$ and $WF_{H2O\text{-}Ref}$) and selected Choice Operating Parameters ($\vec{\Lambda}$). As an important feature of this invention, Dilution Factors allow the numerical processes to recognize that Reference System Effect Parameters may themselves have bias. Examples of such bias include: Reference Fuel Characteristics having been chosen with an out-dated database, biasing the computed reference L Factor; the reference heating value having been determined incorrectly, analyzed incorrectly in the laboratory and/or having intrinsic uncertainties; and the indicated fuel flow having serious instrumentation error. However, engineering judgement and a valid database may be reasonably anticipated and applied in the cases of reference L Factors and reference heating values. Dilution Factors $M_L$ (influencing $L_{k1\text{-}Ref}$) and $M_H$ (influencing $HHV_{k3\text{-}Ref}$) may be assumed to be unity for most situations as is preferred; or they may be based on monitoring experience, sensitivity studies or as otherwise determined. Applying engineering judgement and/or a valid database is difficult in the case of the plant's indicated fuel flow; which could have bias, thus the use of $\Delta m_{AF}$ in Eq.(202B). Thus $M_W$ (influencing $m_{AF\text{-}PLT}$) should be determined based on results from The Input/Loss Method and the processes of this invention, when such results are generically compared to system data. Specifically, $M_W$ may be adjusted until Input/Loss computed total effluent flow reasonably agrees and/or tracks the measured, computed combustion air flow agrees and/or tracks the measured, computed fuel flow agrees and/or tracks the indicated fuel flow, and similar system-wide comparisons. In the context of the last sentence, "tracks" is defined as the computed value trending over time with the measured, having a constant off-set. In the case of fuel water fraction as used directly as a System Effect Parameter, $WF_{H2O}$ is driven towards a reference value by optimizing tube leakage flow ($\Lambda_8$); when so employed, System Effect Parameter $WF_{H2O}$ is considered a special case. Application of Dilution Factors require that the sense of the bracketed terms of Eqs.(202A), (202B), (202C) and (202D) be always positive requiring a reversal of the derivative's sign as appropriate. The Dilution Factors $M_L$, $M_W$, $M_H$ and $M_T$ are real numbers; $M_L$ & $M_H$ are typically assumed to be unity, while $M_W$ & $M_T$ are typically found through sensitivity studies to be non-unity (ranging between 0.90 and 1.20 for $M_W$, and 1.0 to 1.6 for $M_T$).

In these relationships each Choice Operating Parameter ($\Lambda_i$) is scaled with the parameter $S_i$, determined to be suitable for the BFGS, generic Conjugate Gradient and Newton-Raphson techniques. Scaling for these methods is important for proper application of this invention, as minimization techniques in general are sensitive to variations in the numerical size, and units of measure, of the $\Lambda_i$ terms (e.g., for fossil-fired applications, an un-scaled $\Lambda_{1S}$ may be 0.14 moles-$CO_2$/mole-Dry-Stack-Gas, while an un-scaled $\Lambda_6$ may be 22,000 lbm/hr). It has been found that a good initial estimate of $S_i$ may be developed as the inverse of $\Lambda_i$. Further, the influence of scaling may be improved by employing a pre-scaling factor, $s_i$; which may be determined as taught in '879, or as otherwise determined by the system operator through sensitivity studies. It has been found that $s_i$ for $\Lambda_8$ typically of 10,000 works well if $\Lambda_8$ units of measure are lbm/hr. However, it has also been found that the Newton-Raphson technique converges quickly when optimizing the combination of $\Lambda_{2S}$ or $\Lambda_{2B}$, and $\Lambda_8$, thus may be used to adjust $s_i$ for $\Lambda_8$ until appropriate sensitivity is reached between the Choice Operating Parameters of effluent water and tube failure flow rate (that is when one term does not predominate the other).

$$S_i \equiv s_i/\Lambda_{0\text{-}i} \tag{206}$$

$$x_i \equiv S_i \Lambda_i \tag{207}$$

When ERR-CALC is executed using either BFGS, generic Conjugate Gradient or Newton-Raphson techniques typically 5 to 50 iterations are required for convergence. However, when ERR-CALC is executed using Simulated Annealing typically over 1000 iterations are required for convergence. To address the problem of long computing times, associated with any minimization technique, this invention teaches to duplicate within the ERR-CALC program only those calculations which effect System Effect Parameters, and to therefore compute System Effect Parameters within ERR-CALC (which are then repeated within the Fuel Iterations). This results in a considerable reduction in computing time required to evaluate repeated objective function calculations. Specifically, these duplicated calculations include: principally HEATRATE stoichiometrics (which are also used by EX-FOSS); L Factor calculations; heating value calculations; and an approximation of the effects changing stoichiometrics and changing heating value has on boiler efficiency and thus the effects on computed fuel flow using Eq.(330A) or (330B). In summary, these duplicated calculations determine affects on the System Effect Parameters ($L_{k1}$, $m_{AF}$, $HHV_{k3}$ and $WF_{H2O}$) of a given set of Choice Operating Parameters ($\vec{\Lambda}$).

Applicable references for the preferred minimization techniques include the following sources. For the BFGS and the generic Conjugate Gradient techniques the references are: D. F. Shanno and K. H. Phua, "Algorithm 500, Minimization of Unconstrained Multivariate Functions", *ACM Transactions on Mathematical Software*, Vol. 2, No. 1, March 1976, pages 87–94; and D. F. Shanno and K. H. Phua, "Remark on Algorithm 500, Minimization of Unconstrained Multivariate Functions", *ACM Transactions on Mathematical Software*, Vol. 6, No. 2, December 1980, pages 618–622. For the Simulating Annealing technique the references are: W. L. Goffe, G. D. Ferrier and J. Rogers, "Global Optimization of Statistical Functions with Simulated Annealing", *Journal of Econometrics*, Vol. 60, No. 1/2, pp. 65–100, January/February 1994; for its base technology see: A. Corana, M. Marchesi, C. Martin and S. Ridella, "Minimizing Multimodal Functions of Continuous Variables with the 'Simulated Annealing' Algorithm", *ACM Transactions on Mathematical Software*, Vol. 13, No. 3, pp. 262–280, September 1987; for modifications to the random number generator RANMAR which is employed by Simulating Annealing see: F. James, "A Review of Pseudorandom Number Generators", *Computer Physics Communications*, Vol. 60, pp. 329–344, 1990. For the Newton-Raphson technique the reference is: W.H. Press, S. A. Teukolsky, W. T. Vettering & B. P. Flannery, *Numerical Recipes in FORTRAN 77, The Art of Scientific Computing*, Cambridge University Press, Cambridge and New York (1992), Chapter 9.6 on Newton-Raphson Method for Nonlinear Systems of Equations, and Chapter 9.7 on Globally Convergent Methods for Nonlinear Systems of Equations.

Additional minimization techniques and teachings of related mathematical procedures which may be applied to this invention, are presented in the following: J. Nocedal and S. J. Wright, *Numerical Optimization*, Springer-Verlag, New York (1999); G. N. Vanderplaats, *Numerical Optimization Techniques for Engineering Design*, McGraw-Hill Book Company, New York (1984); and W.H. Press, S. A. Teukolsky, W. T. Vettering & B. P. Flannery, *Numerical Recipes in FORTRAN 77, The Art of Scientific Computing*, Cambridge University Press, Cambridge and New York (1992). Other common minimization techniques involving constrained or unconstrained searches may also be alternatively applied. These include Sequential Linear Programming, Direction Set using Powell's method, Simplex method, Downhill Simplex method, Simplex method with product form inverse, Quasi-Newton method, and others. Commercial products are also available, such as from Lindo Systems, Inc. of Chicago, Ill.

A further technique applicable to the reduction of errors in Choice Operating Parameters lies with use of artificial neural network technology (herein termed ANN). As traditionally employed at power plants ANN technology learns through a database how to minimize defined parameters: a change in a coal mill's air registration produces an observed result in another parameter. Generically, the minimization of defined parameters means to drive such parameters in one, but constrained, direction: the lowest combustion air flow (via bias on FD Fans) for a given power; the highest boiler efficiency by minimizing $(1.0-\eta_B)$; etc. However, as used for this invention ANN technology is used to correct Choice Operating Parameters such that errors in System Effect Parameters are reduced. Explicit determination of fuel chemistry, computed heating value, computed boiler efficiency, consistent mass and energy balances, and, in general, explicit thermodynamics remain as taught in '994 and '429. ANN may be applied to recognize patterns in computed System Effect Parameters influenced by causal Choice Operating Parameters. Much like the aforementioned (and preferred) techniques, ANN technology may make corrections to initial Choice Operating Parameters to achieve a desired result [for example, to minimize the $\lambda_L$, $\lambda_W$, $\lambda_H$ and/or $\lambda_T$ terms of Eqs.(202A), (202B), (202C) and (202D)]. These corrections, $C_i$, may be based on choosing the highest probability a set of $\Lambda_i$ will produce the lowest errors in System Effect Parameters relative to Reference System Effect Parameters. An advantage to ANN is that such corrections are learned; that is, ANN improves its correlations with an ever increasing database. Typically such learning may be done without use of an objective function, but not always as in the case of object oriented ANN. Specifically, Choice Operating Parameters used to compute fuel chemistries and heating values (leading to boiler efficiency and system efficiency), may be analyzed for their influences on System Effect Parameters, patterns then recognized which would lead directly to $C_i$ corrections being applied via Eq.(201). Given such corrections, The Input/Loss Method would then proceed as described herein, and in '994 and '429 as applicable.

Numerous commercial ANN technology software packages are available, for example from: NeuralWare of Pittsburgh, Pa.; California Scientific Software of Nevada City, Calif.; The MathWorks, Inc. of Natick, Mass.; Pegasus Technology of Mentor, Ohio a subsidiary of KFx, Inc; NeuCo, Inc. of Boston, Mass.; those available from universities; and those to be found on the internet. A particularly applicable ANN technology is available from Computer Associates of Islandia, N.Y. comprising their Neugents technology. In addition, any ANN technology which allows for object oriented programming are directly applicable to this invention as such objects, as mathematical kernels, may explicitly correct a variety of Choice Operating Parameters employed by one of the Input/Loss methods.

However, ANN technology is not the Preferred Embodiment given that such technology is historically intended for large databases, databases representing processes too complex for explicit thermodynamics and/or databases those applicable objective functions are unknown or otherwise may not be readily discerned. The teachings of the Preferred Embodiment of this invention may be applied directly using ANN technologies which have application following the general scope and spirit of the present invention.

Tube Leakage Flow Rate Computations

To determine a tube leakage flow rate using the direct application of the aforementioned techniques, that is selecting the Choice Operating Parameter for tube leakage flow ($\Lambda_8$), in combination with others, as optimized for any or all System Effect Parameters $L_{k1}$, $m_{AF}$, $HHV_{k3}$, and/or $WF_{H2O}$ has been demonstrated at power plants burning fuels whose hydrocarbons and fuel water are similar to that of black liquor. However the strict application of such techniques is not preferred when determining both the flow rate and the location of the leaking tube. The preferred technique for determining a tube leakage flow rate is presented in three steps (termed "Passes") detailed below. The technique for determining the location of the failed tube within the steam generator is detailed by separate sub-section. In summary, for the Preferred Embodiment, once a possible Tube Failure Mechanism has been identified (via TABLE 1A or TABLE 1B): a tube leakage flow rate is determined by optimizing $\Lambda_8$, in combination with other Choice Operating Parameters except for $\Lambda_{1S}$, $\Lambda_{1B}$, $\Lambda_{2S}$ and $\Lambda_{2B}$. Nominal correction factors to effluent $CO_2$ and effluent water are obtained from historical evidence. This achieves stoichiometric balance, an initial fuel chemistry and heating value assuming the nominally corrected effluent $CO_2$ and effluent water are reasonably accurate. Next a final fuel chemistry and heating value are determined but this time as influenced by the determined tube leakage flow rate and all routine Choice Operating Parameters, except $\Lambda_{2S}$ or $\Lambda_{2B}$; that is, Choice Operating Parameters as would be routinely selected whose interdependencies are now effected by an established tube leakage. As defining a "separative analyses process", it was developed to address the situation where effluent water, based on either a measurement or an assumption, was being corrected without regard to how such a correction might influence other Choice Operating Parameters, especially tube leakage and the important effluent $CO_2$. For example, if in correcting a high effluent water signal (whose $\Lambda_{0\text{-}2S}$ value reflects an actual tube failure) to a lower nominal value, the resultant dry-based effluent $CO_2$ may become badly skewed effecting computed heating value. The preferred process first accepts the effluent water value using an historically based correction factor, $C_{2S\text{-}hist}$, i.e., not optimizing on $\Lambda_{1S}$, $\Lambda_{1B}$, $\Lambda_{2S}$ or $\Lambda_{2B}$, but optimizing on $\Lambda_8$ and all other Choice Operating Parameters. This optimization establishes a computed tube leakage flow rate, consistent fuel chemistry and a heating value given a tube leakage. The computed tube leakage could be essentially zero if determined to be stoichiometrically consistent. The process then repeats but including $\Lambda_{1S}$ or $\Lambda_{1B}$ and other Choice Operating Parameters, again except effluent water, and using the computed tube leakage flow rate. This final process then reflects nominal values given the constrained methodology used by Simulated Annealing; for example, computed fuel carbon established in-part from $\Lambda_{1S}$ will lie between $\alpha_{MAF\text{-}4/min}$ and $\alpha_{MAF\text{-}4/max}$; effluent water is nominally corrected and is consistent with the computed tube leakage.

The preferred technique, versus a straightforward application of '879, addresses several problem areas found during the demonstration of this invention: the marked insensitivity of small tube leakages on system stoichiometrics; correction factors being adversely influenced by an actual tube leakage, but the resulting effects of converged Choice Operating Parameters on stoichiometrics would mask detection of tube leakage; shallow valley problems aggravated by tube failures; and marked differences, and possible problems, associated with scaling Choice Operating Parameters especially with widely varying tube leakage flow rates (e.g., from 2,000 to 100,000 lbm/hr). Further, this separative analyses process lends itself to the determination of the tube leak's location within the steam generator.

Pass 0 of the Preferred Embodiment represents a typical monitoring cycle using The Input/Loss Method, but where the user has optioned for tube failure checking at each execution of the ERR-CALC program. A typical monitoring cycle involves minimizing errors in System Effect Parameters ($L_{k1}$, $m_{AF}$, $HHV_{k3}$ and/or $WF_{H2O}$) by optimizing a selection of routine Choice Operating Parameters applicable to the thermal system and its fuel, but not use of $\Lambda_8$. For such routine monitoring $m_T=b_T=0.0$ is assumed for the stoichiometrics of Eqs.(19BL) and (200). The optimization employs any multidimensional minimization technique, and/or ANN technology, appropriate to the thermal system and its fuel. This type of monitoring, using routine Choice Operating Parameters, is taught in '879 and herein, and typifies normal use of ERR-CALC. This process defines Pass 0 logic described in FIG. 3.

If tube failure checking (the option having been activated in Pass 0) has detected a Tube Failure Mechanism (see TABLE 1A and TABLE 1B), a Pass 1 process is then begun to determine a computed tube leakage flow rate. Within this Pass 1 routine Choice Operating Parameters used in Pass 0 are selected with $\Lambda_8$, but excluding effluent $CO_2$ and effluent water ($\Lambda_{1S}$, $\Lambda_{1B}$, $\Lambda_{2S}$ and $\Lambda_{2B}$). Choice Operating Parameter $\Lambda_8$ is optimized to drive the As-Fired fuel water fraction, $WF_{H2O}$, or the computed fuel flow, $m_{AF}$, to their respective reference values: $WF_{H2O\text{-}Ref}$ or $(m_{AF\text{-}PLT}+\Delta m_{AF})$ Corrections to effluent $CO_2$ and effluent water are set to historical values associated with established instrumentation experience (or an assumption) not reflective of tube failure. For example, effluent Stack water may be equated to $C_{2S\text{-}hist}\Lambda_{0\text{-}2S}$ where $C_{2S\text{-}hist}$ is a nominal correction factor and where $\Lambda_{0\text{-}2S}$ is based on plant data. Corrections to effluent $CO_2$ and effluent water are thus held constant for Pass 1. Other correction factors, $C_i$, established in Pass 0 are used with initial $\Lambda_{0\text{-}i}$ estimates. This process results in a computed tube leakage flow rate which satisfies stoichiometric balances of Eqs.(19BL) and (200), providing a solution in which fuel chemistry and heating value fall within numerical constraints (min/max limits). Note that other System Effect Parameters may be used, optimizing $\Lambda_8$, such as $HHV_{AF}$, however either $WF_{H2O}$ or $m_{AF}$ have proven to be appropriately sensitive to the stoichiometrics and represent the Preferred Embodiment. This process defines Pass 1 logic described in FIG. 3.

After convergence of Pass 1, Pass 2 then re-establishes System Effect Parameters with the previous selection of routine Choice Operating Parameters, but excluding effluent water (those effects are now replaced by the computed tube leakage flow rate). The Simulating Annealing algorithm is preferred; however for this Pass 2 BFGS has been observed to be adequate if properly scaled. Convergence results in converged Choice Operating Parameters, noting that all Choice Operating Parameters which were being used in Pass 0 are now influenced by a tube leakage flow rate ($m_T$), including a nominally corrected effluent water. Pass 1 and Pass 2 employ Simulated Annealing technique as the Preferred Embodiment given its ability to address: shallow valley problems; the possibility of considerably different scaling associated with small to large tube failure flows; its constrained search methodology in which the Choice Operating Parameters are numerically bound; and that a variety of Choice Operating Parameters which may have wide ranging numerical values. This process defines Pass 2 logic described in FIG. 3. Note that whenever $m_T$ is determined greater than zero, procedures as taught by this invention then incorporate the influence of such leakage into combustion stoichiometrics through the $b_T$ molar quantity determined as follows:

$$b_T=m_T(xN_{AF})/(N_{H2O}m_{AF}) \tag{321A}$$

$$m_T=b_T(N_{H2O}m_{AF})/(xN_{AF}) \tag{321B}$$

The $b_T$ quantity, through use in Eq.(19BL), then effects boiler efficiency, computed fuel flow and efficiency computations in the same manner as the $b_Z$ quantity as taught in '994 and '429; $b_Z$ in '994 and '429 being replaced by the quantity $(b_Z+b_T)$. Thus if the quantities: $N_{AF}$; the molecular weight of the working fluid ($N_{H2O}$, water is assumed); $m_{AF}$ (or $m_{AF\text{-}PLT}$ if the computed is not available); the tube leakage moles ($b_T$); and resolution of the stoichiometric model of the combustion process, then Eq.(321B) may be solved for $m_T$ without use of a minimization or ANN technique.

To further assist in teaching this invention, TABLE 2 presents a typical scenario of routine monitoring, the identification of a possible tube leak, and then the resolution of the tube leakage flow rate. In TABLE 2, the second column denotes the selection of Choice Operating and System Effect Parameters; for example, "$\Lambda_{1S}$ min $L'_{Fuel}$" means that Choice Operating Parameter $\Lambda_{1S}$, see Eq.(211S), is selected to minimize the error in System Effect Parameter $L'_{Fuel}$. The use of "$\Lambda_{1S}$ min $L'_{Fuel}$", "$\Lambda_{2S}$ min $L'_{Fuel}$", "$\Lambda_4$ min $L'_{Fuel}$", "$\Lambda_{7B}$ min $L'_{Fuel}$" and "$\Lambda_9$ min $L'_{Fuel}$" used in Pass 0 is typical for the assumed thermal system if burning black liquor fuel. However if measuring Stack $O_2$ instead of Boiler $O_2$ as used in TABLE 2, the selection would typically consist of only "$\Lambda_{1S}$ min $L'_{Fuel}$", "$\Lambda_{2S}$ min $L'_{Fuel}$", "$\Lambda_{7S}$ min $L'_{Fuel}$" and "$\Lambda_9$ min $L'_{Fuel}$".

TABLE 2

Example of Determining Tube Failure Flow Rate using the Preferred Embodiment

| The Thermal System and Computational Sequence | Optimizations | Comments |
|---|---|---|
| Routine monitoring of a black liquor-fired system having high water, low & constant inerts; multiple $O_2$ instruments are used at the Boiler having high accuracy; $CO_2$ & $H_2O$ Stack instruments; uncertain air leakage. Defines Pass 0. | $\Lambda_{1S}$ min $L'_{Fuel}$<br>$\Lambda_{2S}$ min $L'_{Fuel}$<br>$\Lambda_4$ min $L'_{Fuel}$<br>$\Lambda_9$ min $L'_{Fuel}$<br>$\Lambda_{7B}$ min $L'_{Fuel-}$ | Compute As-Fired fuel chemistry with constant fuel inerts every 3 minutes; optimization of Choice Operating Parameters every 30 minutes using BFGS technique with Tube Failure Model option invoked. Historically: $C_{1S}$ = 0.96, $C_{2S}$ = 1.02 and $C_4$ = 1.10. |
| A possible tube failure has been detected given Tube Failure Mechanism 51 (see TABLE 1A). Use historical values for $C_{1S}$ & $C_{2S}$; $\Lambda_{0-8}$ = 500 lb/hr. Defines Pass 1. | $\Lambda_4$ min $L'_{Fuel}$<br>$\Lambda_8$ min $WF_{H2O}$<br>$\Lambda_{7B}$ min $L'_{Fuel-}$<br>$\Lambda_9$ min $L'_{Fuel-}$ | Compute As-Fired fuel chemistry with constant fuel inerts; optimization using Simulated Annealing. Results in the computed tube leakage flow rate, $m_T$, which satisfies stoichiometrics. |
| Return to routine monitoring but including the computed tube leakage flow rate, $m_T$, but excluding effluent water ($C_{2S}$ = 1.02). Defines Pass 2. | $\Lambda_{1S}$ min $L'_{Fuel}$<br>$\Lambda_4$ min $L'_{Fuel}$<br>$\Lambda_{7B}$ min $L'_{Fuel-}$<br>$\Lambda_9$ min $L'_{Fuel-}$ | Compute As-Fired fuel chemistry as in Pass 0, resulting in converged Choice Operating Parameters associated with the computed tube leakage flow rate. |

Tube Leak Location

A important feature of this invention is its ability to assess the impact of a tube leak on the thermal performance of the system, and where within the steam generator the leak occurs. Once a tube leakage flow rate has been determined, its impact on the total energy flow to the working fluid and on boiler efficiency may be determined; thus its effects on fuel flow and system efficiency may be understood. If a thermal system's feedwater flow is held essentially constant, then a developing tube leak will result in less total energy flow required from the combustion gases; i.e., a reduction in the working fluid's energy flow required to meet the same working fluid boundary pressures and temperatures. If the working fluid energy flow without tube leakage is termed BBTC, then the actual energy flow, assuming a tube leak, is given by: $(BBTC-m_T\Delta h)$, where $\Delta h$ is the enthalpy difference between the outlet of the last heat exchanger effected by the leakage, $h_{Last}$, and the first exchanger so affected, $h_{SteamT}$ (i.e., the heat exchanger in which the leak occurs); $m_T\Delta h$ is the energy flow lost from the working fluid due to tube leakage. The enthalpy of the leaking fluid as it enters the combustion gas path, $h_{SteamT}$, is assumed, by choice, to be the same as the heat exchanger's inlet enthalpy (any location may be applied). When applied to The Input/Loss Method of computing boiler efficiency, the enthalpy of the leaking fluid entering the combustion gas path must be properly referenced as taught by Eq.(137) using $(h_{SteamT}-h_{f\text{-}Cal})$, and as taught by Eqs.(131) & (132) using $(h_{Stack}-h_{SteamT})$. Quantitative effects on boiler efficiency and system heat rate are not obvious and may not be off-setting, they are preferably described through use of The Input/Loss Method of '994 and '429; they may also be described through use of other Input/Loss methods, or may be described through use of any method which determines boiler efficiency and system heat rate (and therefore system efficiency) given knowledge of the fuel's heating value and other dependent quantities. Computed As-Fired fuel flow and system heat rate are then determined by the following, assuming a tube leak (versus no leak associated with Eq.(128)):

$$m_{AF} = (BBTC - m_T\Delta h)/[\eta_{B\text{-}HHV}(HHVP + HBC)] \quad (330A)$$

$$= (BBTC - m_T\Delta h)/[\eta_{B\text{-}LHV}(LHVP + HBC)] \quad (330B)$$

$$HR_{HHV} = m_{AF}(HHVP + HBC)/W_{output} \quad (331A)$$

$$= (BBTC - m_T\Delta h)/(\eta_{B\text{-}HHV}W_{output}) \quad (331B)$$

$$HR_{LHV} = m_{AF}(LHVP + HBC)/W_{output} \quad (332A)$$

$$= (BBTC - m_T\Delta h)/(\eta_{B\text{-}LHV}W_{output}) \quad (332B)$$

$$\eta_{SYS\text{-}HHV} = 3412.1416/HR_{HHV} \quad (333A)$$

$$\eta_{SYS\text{-}LHV} = 3412.1416/HR_{LHV} \quad (333B)$$

It is important to this invention to recognize that the location of the tube failure affects the working fluid's energy flow. The typical recovery boiler used in the paper processing industry routes the working fluid first through an economizer heat exchanger, then through a series of water wall heat exchangers and the boiler drum (if a sub-critical unit). It could happen that additional heat exchangers are also employed, routing the working fluid through a primary super-heater, through a final super-heater, and, lastly, through a reheat exchanger. Although the preceding is typical, numerous configurations of different heat exchanger names and types may be found, including, for example: lower economizers, upper economizers, primary secondary super-heaters, final secondary super-heaters, division walls, front reheaters, rear reheaters, etc. Such heat exchangers need to be identified by order. For example, if a tube leak occurs in an economizer, its loss is seen throughout the steam generator (having the greatest impact on working fluid energy flow, e.g., $\Delta h=(h_{Reheat\text{-}outlet}-h_{SteamT})$, where $h_{SteamT}$ may be less than 490 Btu/lbm. If a tube leak occurs in the final reheat exchanger, its loss only affects this last exchanger (having the least impact on working fluid energy flow and thus on computed fuel flow, $\Delta h=(h_{Reheat\text{-}outlet}-h_{SteamT})$, where $h_{SteamT}$ may be ≈1320 Btu/lbm with a $h_{Reheat\text{-}outlet}$ of 1520 Btu/lbm. This suggests that Eq.(330A) or (330B) has an unique solution dependent on the assigned (and actual) location of the tube leakage. When using one of the appropriate Input/Loss methods, such dependency on a location of the tube leak may be intrinsically a function of computed fuel chemistry and Firing Corrections, and thus, also a function of the resultant heating value and boiler efficiency.

Determination of the location of the tube leak is accomplished by recognizing that certain System Effect Parameters are a function of the working fluid energy flow (as affected by tube failure flow rate and its location). The System Effect Parameter of computed fuel flow, $m_{AF}$, is a function of ($BBTC-m_T\Delta h$) through Eq.(330A) or (330B). The System Effect Parameter of As-Fired fuel water fraction, $WF_{H2O}$, is a function of the ($BBTC-m_T\Delta h$) term through affects on boiler efficiency ($\eta_{B\text{-}HHV}$), heating value ($HHV_{AF}$) and Firing Corrections (HBC). Although not obvious, The Input/Loss Method, because it determines fuel chemistry, heating value, boiler efficiency and Firing Corrections independent of fuel flow, and with great consistency, must, never-theless, affect computed boiler efficiency consistently as taught herein and in '429; illustrating using higher heating value:

$$\eta_{B\text{-}HHV} = (BBTC - m_T\Delta h)/[m_{AF}(HHVP + HBC)] \quad (334)$$

$$= \left(-HPR_{Act\text{-}HHV} + HRX_{Act\text{-}HHV}\right)/(HHVP + HBC) \quad (335)$$

Eq.(335) must reflect a consistently computed boiler efficiency; just as Eq.(334) as composed of a term which directly reflects tube failure location ($BBTC-m_T\Delta h$), and therefore reflects a consistently computed boiler efficiency. The Enthalpy of Products and the Enthalpy of Reactants terms of Eq.(335), $HPR_{Act}$ and $HRX_{Act}$, are computed with terms influenced by both the tube leakage flow and its location via the $\Delta h$ term. $HPR_{Act}$ includes the enthalpy of all water exiting the system ($h_{Stack}$), relative to the enthalpy at associated entry points into the combustion gas path, including that for tube leaks at $h_{SteamT}$; thus: ($h_{Stack}-h_{SteamT}$) as found in Eqs.(131) & (132). $HRX_{Act}$ of Eqs.(135) & (136) includes the Firing Correction term which encompasses the entering enthalpy of all in-leakages of water, including tube leaks at $h_{SteamT}$, relative to a reference enthalpy taken as the saturated liquid enthalpy at the calorimetric temperature; thus: ($h_{SteamT}-h_{f\text{-}Cal}$) as found in Eq.(137).

Determination of which heat exchanger has a tube leak is accomplished by assigning the tube leak to successive heat exchangers, in repetitive computations involving ERR-CALC and Fuel Iterations, and then examining "key comparative parameters" produced from these computations for deviations from their "reference key comparative parameter". Reference key comparative parameters are determined from a Fuel Iteration without tube leakage, or as otherwise obtained. If using the System Effect Parameter of computed fuel flow, $m_{AF}$, such key comparative parameters include: the As-Fired fuel flow, the average fuel water fraction, heating value and the Fuel Consumption Index associated with that heat exchanger. The following weightings of these key comparative parameters has been found useful in determining the lowest deviation among the j heat exchangers when using System Effect Parameter of fuel flow:

$$\begin{aligned} Deviation_j = {} & 0.02\left|(m_{AF} - m_{AF\text{-}PLT} - \Delta m_{AF})/(m_{AF\text{-}PLT} + \Delta m_{AF})\right|_j + \\ & 0.08\left|(WF_{H2O\text{-}Ref} - WF_{H2O})/WF_{H2O\text{-}Ref}\right|_j + \\ & 0.05\left|(HHV_{Ref} - HHV_{AF})/HHV_{Ref}\right|_j + \\ & 0.85\left|(FCI_{Ref} - FCI)/FCI_{Ref}\right|_j \end{aligned} \quad (382)$$

If using the System Effect Parameter of As-Fired fuel water fraction, $WF_{H2O}$, such key comparative parameters include: the As-Fired fuel flow, the average fuel water fraction, heating value and the Fuel Consumption Index associated with that heat exchanger. The following weightings of these key comparative parameters has been found useful in determining the lowest deviation among the j heat exchangers when using System Effect Parameter of fuel water:

$$\begin{aligned} Deviation_j = {} & 0.08\left|(m_{AF} - m_{AF\text{-}PLT} - \Delta m_{AF})/(m_{AF\text{-}PLT} + \Delta m_{AF})\right|_j + \\ & 0.02\left|(WF_{H2O\text{-}Ref} - WF_{H2O})/WF_{H2O\text{-}Ref}\right|_j + \\ & 0.05\left|(HHV_{Ref} - HHV_{AF})/HHV_{Ref}\right|_j + \\ & 0.85\left|(FCI_{Ref} - FCI)/FCI_{Ref}\right|_j \end{aligned} \quad (383)$$

Other key comparative parameters have been studied and have been found as useful as those used in Eqs.(382) & (383), depending on the thermal system and its fuel, and the convergence criteria employed by the minimization techniques. These other key comparative parameters include those in the following list; however, this list is not meant to be exhaustive but representative of the scope and spirit of the present invention:

- Boiler efficiency;
- Dry heating value;
- Specific working fluid energy flow [($BBTC-m_T\Delta h$)/$m_{AF}$];
- Weight fraction of fuel carbon as computed by one of the Input/Loss methods;
- Weight fraction of fuel hydrogen as computed by one of the Input/Loss methods;
- Numerical convergence associated with Minimization Techniques including ANN;
- Computed overall heat transfer coefficient of the assumed leaking heat exchanger;
- Computed log-mean-temperature difference of the assumed leaking heat exchanger;
- Computed cleanliness factor of the assumed leaking heat exchanger; and/or
- Computed relative irreversible thermodynamic loss of the assumed leaking heat exchanger.

The Preferred Embodiment of this invention is to employ Eqs.(382) and (383). However, the weightings found in these equations are presented to demonstrate the general technique of determining a minimum deviation, and/or otherwise to determine the location of the failed tube. Such weightings may easily change depending on the nature of the fuel being burned, the design of the thermal system, the key comparative parameters employed, and the specific computational procedures employed from one of the various Input/Loss methods. These weightings and the development of a set of key comparative parameters may be determined through simulations of failed tubes, computationally locating the failures within different heat exchangers of the thermal system. The concept and development of Fuel Consumption Indices is described in the following reference: F D Lang, "Fuel Consumption Index for Proper Monitoring of Power Plants—Revisited", *Am. Society of Mech. Engrs.*, 2002 International Joint Power Generation Conference, Scottsdale, Ariz., IJPGC2002-26097.

The Preferred Embodiment used to resolve the location of the heat exchanger containing a failed tube is to first establish a set of "reference key comparative parameters" associated with no tube leakage, then to determine the net energy flow to the working fluid assuming the tube leakage is in a particular heat exchanger, repeating such determination until all heat exchangers have been so analyzed. Finally, deviations are formed, similar to Eqs.(382) or (383), from which the lowest deviation will indicate the heat exchanger with the failed tube. Note that if using the procedures taught in Paragraphs 0109 through 0114 to determine the tube failure flow rate, then these same computational methods are used at every evaluation of the net energy flow to the working fluid and associated assumption of where the tube leakage is located. In summary, this invention teaches: to identify a set of heat exchangers descriptive of the thermal system as employed to transfer net energy flow to the working fluid from the combustion gases resulting in a set of identified heat exchangers; to then obtain a set of Operating Parameters applicable to the set of identified heat exchangers; to then determine a set of net energy flows to the working fluid from the combustion gases based on the set of identified heat exchangers, the set of Operating Parameters and the tube leakage flow, each said set of net energy flows descriptive of the thermal system and wherein the tube leakage flow is assigned to a different heat exchanger in each said set; to then determine a reference key comparative parameter for the thermal system resulting in a type of key comparative parameter; to then obtain a set of key comparative parameters associated with each identified heat exchanger and based on the set of net energy flows and the type of key comparative parameter; to then determine a set of deviations between the set of key comparative parameters and the reference key comparative parameter; to then determine an identification of the leaking heat exchanger based on the set of deviations; and to then report to the operator of the thermal system the identification of the leaking heat exchanger such that corrective action may take place.

Conclusion

Although the present invention has been described in considerable detail with regard to certain Preferred Embodiments thereof, other embodiments within the scope and spirit of the present invention are possible without departing from the general industrial applicability of the invention. For example, the tube leakage flow rate may be computed by applying the techniques discussed in Paragraphs 0076 through 0108 (i.e., using a single computational pass). The tube leakage flow rate may be determined by use of any System Effect Parameter which indicates an appropriate sensitivity to system effects (with, or in addition to, $L_{k1}$, $m_{AF}$, $HHV_{k3}$ and $WF_{H2O}$). The separative analyses process described above may acquire numerous variations; for example: Pass 1 correction factors may be set to unity; or Pass 1 may only employ the Choice Operating Parameter of tube leakage flow rate. The method described is applicable to either higher heating value or lower heating value computations as supported by the teachings in '429. Further, aforementioned descriptions of this invention assume that a steam generator's working fluid is water, however the general procedures of this invention may be applied to any type of working fluid provided that the working fluid is definable at the boundary of the system. Examples of other working fluids are: mixtures of water and organic fluids, organic fluids, liquid metals and so forth. Further, the L Factor concept as used to optimize Choice Operating Parameters may take numerous forms, although two are demonstrated herein, others are discussed in '563, still others may be formed by one skilled in the art based on the teachings herein and in '879 and in '563. Further, the Reduction Efficiency parameter, the Sulfur to Smelt ratio and the Sodium to Carbon ratio in fuel are defined herein as molar ratios whereas they could be re-defined and incorporated within the teachings herein as mass ratios, and/or determined from laboratory analyses or from common industrial experience as mass ratios and then converted to molar ratios. Accordingly, the general theme and scope of the appended claims should not be limited to the descriptions of the Preferred Embodiment disclosed herein.

Although a Preferred Embodiment of the present invention has been illustrated in THE DRAWINGS and described in considerable detail the foregoing DESCRIPTION OF THE PREFERRED EMBODIMENT, it will be understood that the invention is not limited to the embodiments disclosed, but whose methods are capable of numerous rearrangements, modifications and substitutions without departing from the scope and spirit of the present invention as set forth and defined by the claims herein.

THE DRAWINGS

FIG. 1 is a schematic representation of a thermal system, particularly a recovery boiler system illustrating use of stoichiometric relationships important in applying this invention. It should be studied in conjunction with combustion stoichiometrics of Eq.(19BL). FIG. 1 depicts a recovery boiler system denoted as 20. In this system 20, a black liquor fuel feed 22 and combustion air 24 are all provided to the upstream side region 26 of the heat exchangers & combustion region 28. Note that this region 28 does not include the air pre-heater 36. In addition, in some types of recovery boilers 20 such as those using fluidized bed combustors, other materials may be injected into region 26, such as a flow of limestone 31 to minimize effluent $SO_2$ by chemically binding sulfur as $CaSO_4$. Other sorbents may be injected to control sulfur, to control other pollutants, and/or to control the combustion process. The black liquor fuel feed 22 contains, in general, combustible organic material, sodium-based inorganic material, water and mineral matter (commonly called inerts, or ash). Inerts are an unburnable component that passes through the system with little physical change, but which are heated and cooled. In the heat exchangers & combustion region 28, the black liquor fuel 22 is burned with the combustion air 24 to form hot products of combustion. Heat from the products of combustion is transferred to a working fluid that enters 23 heat exchangers 32 that are depicted as integral with the heat exchangers & combustion region 28. The heated working fluid 30 is used in a manner appropriate to a working fluid to generate a useful output 33 (for example, in a conventional power plant such useful output may be supplied to a turbine cycle for the production of electrical power). Heat exchangers 32 may consist of a series of heat exchangers as explained in Paragraph 0116. One heat exchanger of the collection of heat exchangers 32 may develop a leakage of its working fluid 27, which leakage mixes with the products of combustion 28. There may also be working fluid leakage 29 into the products of combustion 28 and into region 35, not associated with water in the fuel feed 22, or heat exchanger leakage 27, or moisture in the combustion air 24. Working fluid leakage 29 consists of known flows, or flows which may be otherwise reasonably assumed or determined; and may result from, for example, soot blowing associated with coal-fired systems, or working fluid used to atomize the black liquor fuel 22 before combustion, or used in pollutant control processes located at 35 or 42. The smelt 37 from the combustion of black liquor fuel is removed from region 28. After smelt removal, the remaining products of combustion leave the heat exchangers & combustion region 28 on its downstream region 34, the cooler products of combustion then commonly flow through ducts, region 35, which may contain fly ash removal equipment, passing then to an air pre-heater 36, where a further portion of the combustion gas energy is transferred to an incoming air stream 38, which air then becomes the combustion air 24. The total air delivered to 20 is the incoming air flow 25. In many cases, an air leakage flow 40 enters the flow of the products of combustion as it passes through the air pre-heater 36. The further cooled products of combustion leave the air pre-heater 36 and pass to the Stack 42, then being exhausted to the local environment. Within recovery boiler system 20 the combustion gas path is defined as that region encompassing the flow of products of combustion, said products also termed combustion gases, generally occupying regions 28, 35, the gas side of 36, and 42.

FIG. 1, given its general system description provided above, is applicable to a wide variety of fossil-fired systems, including recovery boilers, traditional power plants, oil-burning power plants, gas-fired power plants, biomass combustors, fluidized bed combustors, conventional electric power plants, steam generators, package boilers, combustion turbines, and combustion turbines with heat recovery boilers. This list is not meant to be exhaustive, however, and is presented to illustrate some of the areas of applicability of the present invention which encompass any thermal system burning a fossil fuel and which has at least one heat exchanger whose working fluid is being heated by the products of combustion. This invention is applicable to a wide variety of Input/Loss methods, especially its ability to identify the location of the failed tube. If a thermal system is to be characterized quantitatively using one of the Input/Loss methods, then relationships between Choice Operating Parameters to energy flow inputs and outputs as they are affected by tube leakage flow rate 27, may be understood with enhanced accuracy using this invention. This understanding, in turn, permits the operation of the fossil-fired system to be optimized for efficiency, reduction of polluting effluents, prevention of black liquor explosions and reduced down-time given a tube failure and knowledge of its location.

Within fossil-fired systems, some quantities are readily measured with adequate accuracy, and others may not be measured on-line (in real time) with accuracy sufficient to quantify the operation of the system 20 to the required accuracy to optimize efficiency and/or for the detection of a tube failure and its location. For example, working fluid flow rates, pressures and temperatures may be readily measured with good accuracy by conventional sensors located at defined boundaries such as 23, 30, 25, 33, 42, 22, 29, 31 and 37. Choice Operating Parameters all may, under idea conditions, be directly measured with high accuracy either in real-time or periodically. However, if they are not measured with high accuracy, the ability of Input/Loss methods to quantitatively improve system efficiency may then be compromised. In FIG. 1 quantities which may be (or are) Choice Operating Parameters include: the combustion gas concentrations in the regions 35 and 42 (including $CO_2$, $H_2O$, and $O_2$, termed $\Lambda_{1B}$, $\Lambda_{2B}$, $\Lambda_{7B}$ at region 35, and $\Lambda_{1S}$, $\Lambda_{2S}$, $\Lambda_{7S}$ at region 42); the indicated combustion air flow 24 (when combined with indicated fuel flow then allows the Air/Fuel ratio to be determined, $\Lambda_3$, which allows fuel inert fraction to be computed as taught in '994); the ratio of gas concentrations across the air pre-heater, regions 35 and 42 (either the $O_2$ or the $CO_2$ ratio across these regions, preferably the $CO_2$ ratio, thus allowing the Air Pre-Heater Leakage Factor $R_{Act}$ to be determined, $\Lambda_4$); the concentration of $O_2$ in the combustion air local to the system 25 (termed $A_{Act}$, or $\Lambda_5$, allowing $\phi_{Act}$ to be determined); the indicated limestone flow 31 ($\Lambda_6$); the Sodium to Carbon Ratio in the black liquor fuel 22 determined in real-time or periodically ($\Lambda_9$); and the Reduction Efficiency term determined in real-time or periodically through analysis of the smelt 37 and the black liquor fuel 22 ($\Lambda_{10}$). In addition to these nine, another Choice Operating Parameter is tube leakage flow rate 27 ($\Lambda_8$), which, in the Preferred Embodiment, is optimized using the fuel's average water content in the fuel ($WF_{H2O\text{-}Ref}$) or using the computed As-Fired fuel flow ($m_{AF}$); when optimized, the tube leakage flow rate becomes defined consistent with stoichiometrics of Eqs.(19BL) and (200), using in-part Eq. (321B). Refer to Eqs.(211S) through (220). This invention teaches how to correct such measurements or their assumptions if such measurements are not available; or, in the case of a recovery boiler system having a tube leakage, a measurement of such tube leakage flow rate being impossible to obtain in any reasonable manner without using the teachings of this invention.

FIG. 2 illustrates an important portion of this invention, specifically the general calculational sequences associated with optimizing Choice Operating Parameters and subsequent Fuel Iterations when monitoring a recovery boiler system on-line, i.e., in essentially real time. Box 250 represents general data initialization including establishing Reference Fuel Characteristics, data collection, data organization and routine set-ups of all programs. Box 255 depicts the use of the ERR-CALC program, detailed in FIG. 3, which produces converged Choice Operating Parameters and, given a heat exchanger leak, the tube leakage flow rate. If ERR-CALC is not to be exercised at the same frequency as the Fuel Iterations, Box 255 is bypassed; and, if bypassed, its previously computed correction factors are applied to $\Lambda_{0\text{-}i}$ then employed within the Fuel Iterations. ERR-CALC may be employed, as-needed, for updating correction factors. Box 260 depicts the FUEL program which reduces fuel data from identified multiple sources, prepares a composite fuel, and then prepares an input file for the system simulator EX-FOSS. Reduction of fuel data involves combining the primary (computed) fuel chemistry from a previous iteration, with secondary fuels which have constant and known chemistries, producing a composite fuel. Box 270 is system data supplied to the process as on-line (or real time) including at least the following Operating Parameters (refer to Paragraph 0031 for details): working fluid pressures, temperatures and flows, air psychrometrics, useful system output and other related data. Box 280 depicts the system simulator EX-FOSS which, given specification of a composite fuel from FUEL, inputs from Box 270, routine set-up data and converged Choice Operating Parameters from Box 255 (including possible tube leakage flow rate), produces the following: boiler efficiency using the methods of '429 as modified by the present invention, As-Fired fuel flow ($m_{AF}$) using Eq.(330A) or (330B), complete effluent concentrations, system heat rate using Eq.(331A), (331B), (332A) or (332B), effluent flow, emission rates of all effluents including the common pollutants, and other thermal performance parameters including, for example, energy flow to the working fluid given a tube leak (BBTC−$m_T\Delta h$), and the Firing Correction (HBC). The determination of many of these parameters is taught herein and in '994. Box 285 depicts the HEATRATE program within which, given the converged Choice Operating Parameters (including possible tube leakage flow rate), produces fuel chemistry, L Factors and fuel heating value for both the composite fuel (as either higher or lower heating values), and, given the known compositions of secondary fuels, the composition of the primary (unknown) fuel. Box 285 also depicts the computations within HEATRATE which lead to identification of which heat exchanger has the tube leakage; refer to Paragraphs 0115 through 0119. Designation 287 tests for convergence of the process based on composite fuel moles (x), certain effluents such as $CO_2$ and $H_2O$, heating value and computed fuel water fraction; if the convergence criteria is not met the process continues to iterate from Box 260. In general, convergences lie within $0.5\times10^{-4}$ percent of the computed As-Fired fuel moles. Note that the iterations encompassing 260, 270, 280, 285 and 287 define what is meant by the term "Fuel Iterations". In summary, fuel Iterations are the iterative calculations between EX-FOSS, as input with known fuel chemistry and heating value from a previous iteration but with unknown effluents (to be computed by EX-FOSS, except for effluent $O_2$ which is input), and HEATRATE as input with known effluents (i.e., the corrected Choice Operating Parameters) but with unknown fuel chemistry and heating value (to be computed by HEATRATE).

Designation 290 of FIG. 2 illustrates an important teaching of this invention as it represents a decision to either: 1) continue towards reporting results and quitting if either the Tube Failure Model (i.e., this invention) is not invoked, or is invoked and all computations and processes have been completed; or 2) if the Tube Failure Model is invoked and the location of the failure is desired, to then continue the computations, starting afresh with Box 255 but with every pass through Box 255 to assume the tube leakage occurs in a different heat exchanger. If the tube failure flow rate and its location are both desired, then summary analysis of these computations (leading to identification of the leakage's location) is performed within the HEATRATE program, Box 285, after all heat exchangers have been analyzed. Typically, monitoring cycles are scheduled for every 2 to 3 minutes using updated data based on 15 minute running averages. Once converged and all computations have been completed, Box 294 produces reportable results from the EX-FOSS and HEATRATE programs, including system heat rate, tube leakage flow and its location, and other thermal performance parameters which are influenced by the failed tube including: Second Law analysis of the thermal system (producing Fuel Consumption Indices), fuel flow, total effluent flow, emission rates, other output and reports to system operators as to what corrective actions may take place; said reports also being provided to regulatory authorities as requested or required. Box 298 of FIG. 2 is to quit.

Figure 3:
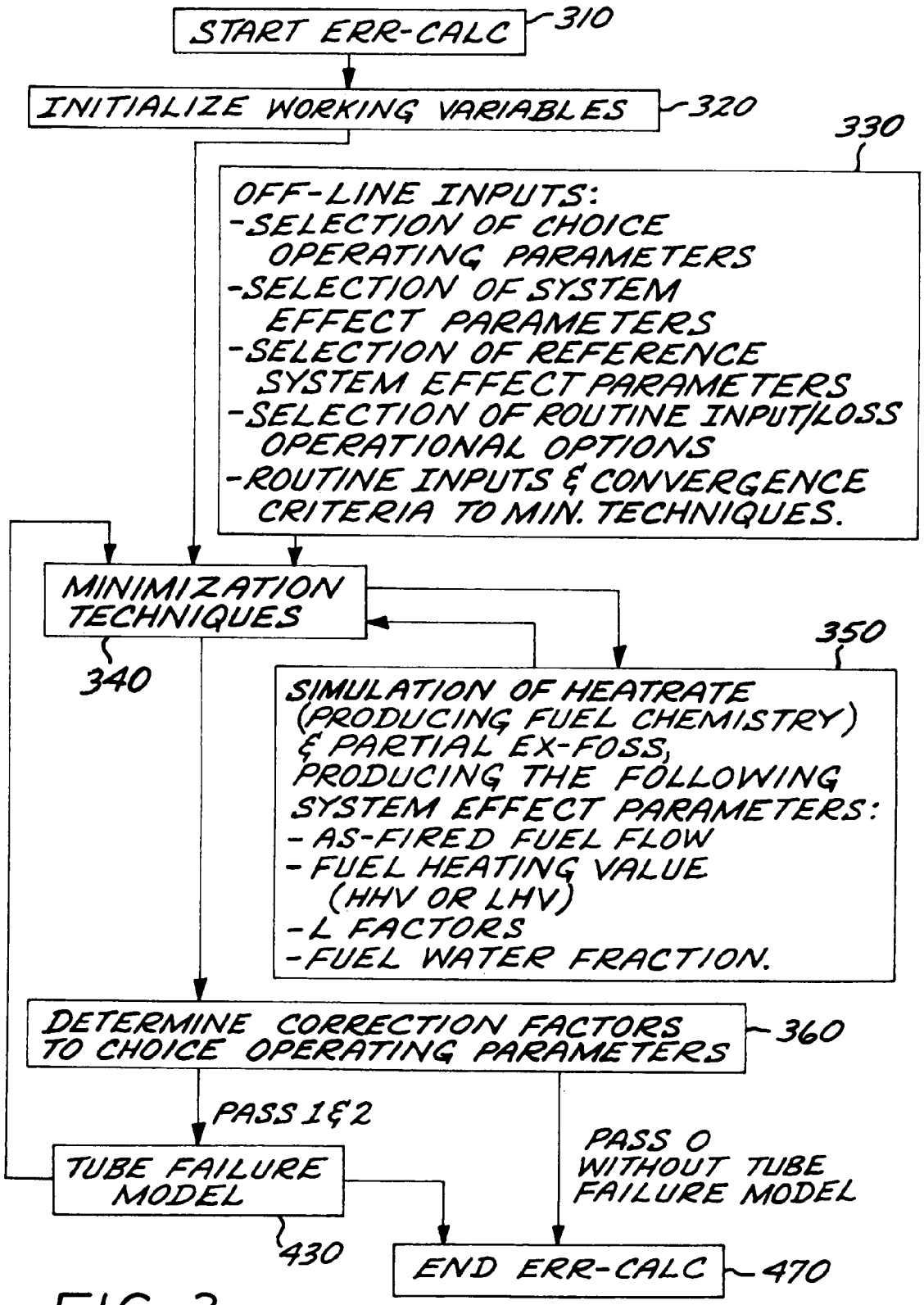
FIG. 3 is a block diagram of the principal functions of the error analysis computer program ERR-CALC which determines optimized Choice Operating Parameters, one of which is the tube failure flow rate incorporating the teachings herein.

FIG. 3 illustrates another important portion of this invention, specifically the organization of the ERR-CALC program used to determine correction factors to the initial Choice Operating Parameters, including the computation of tube leakage flow rate if warranted. In FIG. 3 Box 310 depicts the start of the program which invokes data collection and routine program set-up associated with ERR-CALC. Routine program set-up associated with ERR-CALC includes a user option as to whether the Tube Failure Model will be invoked, or not, for a given monitoring cycle (also see Box 250 of FIG. 2). Box 320 depicts initializations of data including organization of data arrays associated with selected Choice Operating and System Effect Parameters, and determination of scaling factors, $S_i$, and pre-scaling factors, $s_i$. Box 330 depicts the selection, collection and processing of general input data associated with the minimization techniques, principally the selection of Choice Operating Parameters, System Effects Parameters, Reference Systems Effects Parameters and routine inputs, options and convergence criteria to the minimization techniques as are known to those skilled in the art using these techniques (such inputs and criteria are presented in cited references in Paragraphs 0104, 0105, and 0107).

Within FIG. 3, if the Tube Failure Model is optioned, Boxes 340, 350 and 360 may be executed three times for the Preferred Embodiment; these are termed Passes 0, 1 and 2. The initial execution of Boxes 340, 350 and 360 as a series is termed Pass 0. Box 340 depicts application of the minimization techniques as herein discussed, including evaluation of an objective function resulting in optimizing the selected Choice Operating Parameters. Box 350 depicts the use of a simulation principally of the HEATRATE program within ERR-CALC by which the computing time required for the supporting computations required for Box 340 are greatly reduced; refer to Paragraph 0103 for details. For Simulated Annealing, ANN and other such exhaustive procedures, having importance in implementing the Preferred Embodiment of this invention given a tube failure, Box 350 is typically caused to be executed from Box 340 thousands of times for each Pass. Inputs to Box 350 are principally Choice Operating Parameters. Output from Box 350 to Box 340 being principally System Effect Parameters from which the objective function is then evaluated. After convergence of the minimization techniques of Box 340 and thus resolution of converged Choice Operating Parameters, Box 360 depicts the calculation of correction factors associated with the selected Choice Operating Parameters. Box 360 also includes the production of appropriate warning messages associated with the ERR-CALC computations; for example: non-convergence, computational failures, the automatic switching to alternative minimization techniques, and the like. If the monitoring cycle is processing Pass 0 and the Tube Failure Model is not optioned, the program quits via Box 470.

If the Tube Failure Model is optioned, logic flows as discussed above, from Box 340 through Box 360 resulting in a converged solution (but without an assigned tube leakage). However, within Box 360 logic is then invoked which initiates Pass 1 or Pass 2, either proceeding to Box 430. For Pass 1, Box 430 tests for a trip mechanism of TABLE 1A and TABLE 1B, and if found that a tube failure is possible, then: re-sets $\Lambda_{1S}$ or $\Lambda_{1B}$, and $\Lambda_{2S}$ or $\Lambda_{2B}$ correction factors to historically based factors (or to unity); selects the System Effect Parameter for fuel water ($WF_{H2O}$) or for fuel flow ($m_{AF}$) whose difference with reference values is reduced by optimizing Choice Operating Parameter for tube leakage flow ($\Lambda_8$); selects other Choice Operating Parameters and associated System Effect Parameters, excluding $\Lambda_{1S}$, $\Lambda_{1B}$, $\Lambda_{2S}$ and $\Lambda_{2B}$; selects Simulated Annealing as the minimization technique; employs the computed tube leakage flow ($m_T$); and passes control to Box 340. Convergence via Boxes 340 and 350 results in a stoichiometric consistency with the computed tube leakage flow rate. After Pass 1, Box 430 logic then initiates Pass 2 proceeding to Box 430. For Pass 2, Box 430 then: re-sets all correction factors to unity; selects the same System Effect Parameters and Choice Operating Parameters established in Box 330 (excluding $\Lambda_{2S}$ and $\Lambda_{2B}$), plus System Effect Parameter for fuel water or fuel flow whose differences with their reference values is reduced through optimization; selects the Simulated Annealing technique; employs the computed tube leakage flow rate of Pass 1; and passes control to Box 340. Convergence via Boxes 340 and 350 results in correction factors for all selected Choice Operating Parameters which, in combination with the determined tube leakage flow rate via Eq. (321B), achieves stoichiometric consistency as stated by Eqs.(19BL) and (200). Within Box 360, logic produces appropriate warning messages that a tube failure has occurred (assuming the tube leakage flow rate is greater than zero), its mass flow rate, the associated Tube Failure Mechanism, correction factors, and other routine messages. The execution of ERR-CALC is then terminated with Box 470.

Figure 4:
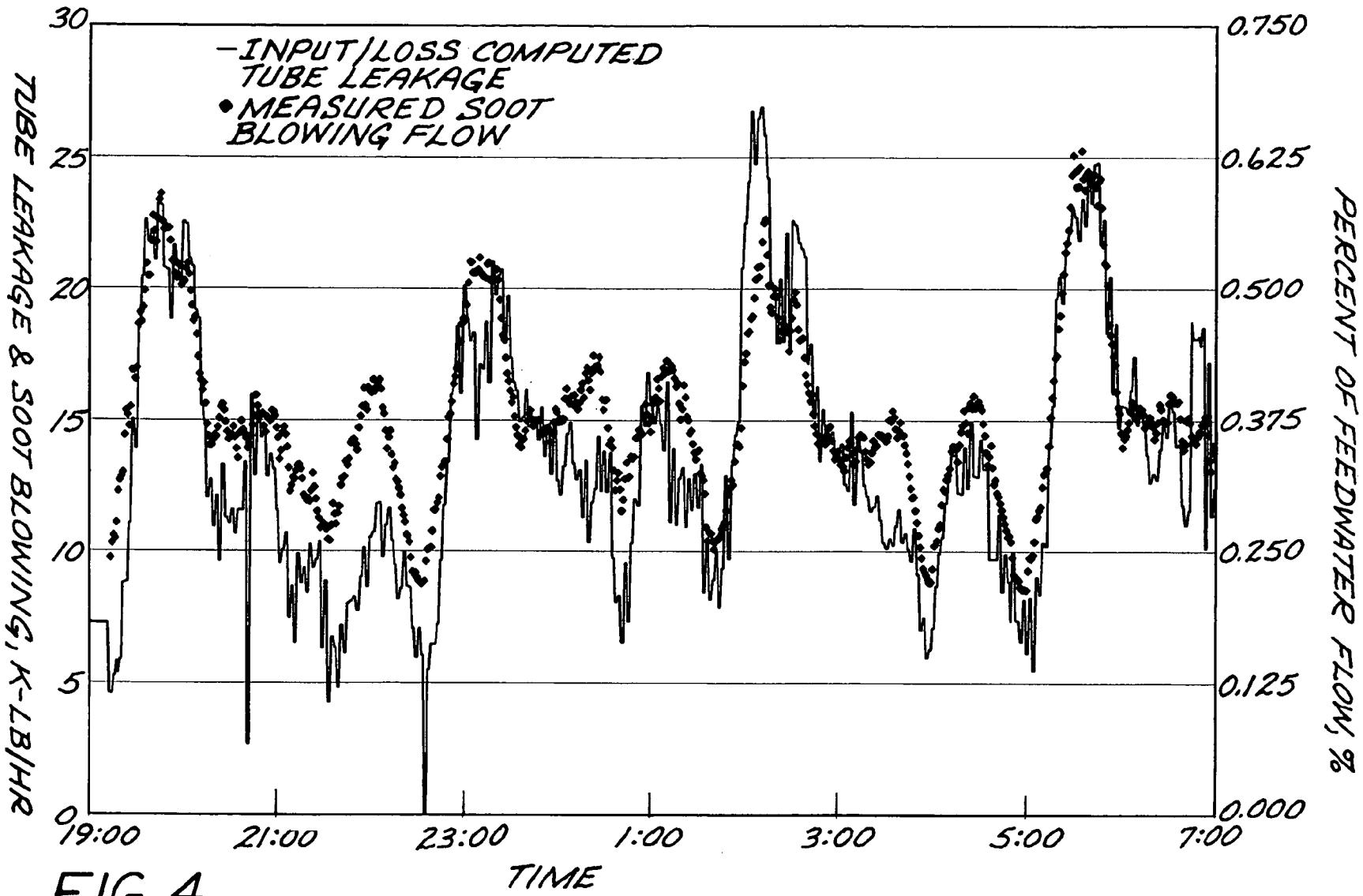
FIG. 4 is a plot of a sensitivity test of this invention. This test employed water soot blowing flow, entering the combustion space of a fossil-fired steam generator, to emulate a tube failure. The soot blowing flow, normally an input to the Calculational Engine, was left an unknown to be computed by the methods of this invention as a tube failure.

FIG. 4 illustrates a plot of both actual and computed water flow entering a combustion space of a large commercial steam generator under test conditions. The actual flow is measured soot blowing flow which was declared an unknown to the Calculational Engine operating The Input/Loss Method as disclosed herein ($b_Z$=0.0). This test emulated a tube failure. The observed sensitivity in FIG. 4 is less than 0.1% of feedwater flow thus demonstrating the practicality of this invention when applied to recovery boilers. FIG. 4 is an outstanding example of the sensitivity and accuracy of this invention, demonstrating many of this invention's objectives.

Symbols within equations may have been italicized pursuant to Patent Office publication practices. As used in FIG. 1, FIG. 2 and FIG. 3, and throughout the DESCRIPTION OF THE PREFERRED EMBODIMENT, mathematical symbols typed in italics and mathematical symbols typed in non-italics have the same meaning when taken in context. Understanding context is afforded through the use of subscripts and/or through the normal flow of mathematical development. Thus, for example, the symbols: $A_{Act}$, $R_{Act}$, $F(\vec{x})$, $f(\ )$, $C_i$, $C_P$, $h_j$, h, $J_0$, $J_1$, $J_{Mech}$, $L'_{Fuel}$, $L_{CO2}$, $m_{AF}$, x, $x_i$, $\vec{x}$, AF, HR defined in Paragraphs 0027 through 0030 and elsewhere herein, have the same meaning as, respectively: $A_{Act}$, $R_{Act}$, $F(\vec{x})$, $f(\ )$, $C_i$, $C_P$, $h_j$, h, $J_0$, $J_1$, $J_{Mech}$, $L'_{Fuel}$, $L_{CO2}$, $m_{AF}$, x, $x_i$, $\vec{x}$, AF, HR. The use of italic symbols is used for writing style. For example, the lower-case *f* (or f) describes a functional relationship, defined in Paragraph 0028, and as used in Paragraphs 0033, 0059, 0064, 0069, 0077 and 0085. For example, as defined in Paragraph 0027, the letter J (or J) with the subscript "Act" describes the "Total effluent water at the system's boundary ($j+b_A\beta$); moles/base"; as opposed to as the letter J (or J) with the subscript "0" or "1", defined in Paragraph 0028, describing the Bessel function of the first kind of order zero or one, and used in Paragraphs 0083, 0085 and 0098; as opposed to $J_{Mech}$ which is defined in Paragraph 0075 as the mechanical equivalent of heat. For example, the letter "x" (and related terms $x_{theor}$, $x_{DRY\text{-}theor}$ and $x_{MAF\text{-}theor}$) is used to describe the moles of fuel per base, defined in Paragraph 0027; whereas the terms $x_i$ and $\vec{x}$ are used to describe generic independent variables associated with multidimensional minimization techniques, defined in Paragraph 0028. The moles of fuel is used principally throughout Paragraphs 0044 through 0075; while the terms $x_i$ and $\vec{x}$ are exclusively used in Paragraphs 0081 through 0085, 0098 and 0102. For example, $C_i$ is used as a correction factor to Choice Operating Parameters (e.g., $C_{2S}$), defined in paragraph 0028 and used in paragraphs 0079, 0090, 0099, 0106, 0109, 0112 and 0114; whereas $C_P$ is heat capacity defined in paragraph 0029 and used in paragraphs 0071 and 0073. Note that correlation constants denoted, for example as $A_3$, $B_{15}$, $B_3$, $C_5$, etc. and used for the mathematical development of Eqs.(42), (43), (48), (49) and (50) are discussed in paragraphs 0056, 0057, 0058, 0077 and 0078. For example, the term "h" is the moles of effluent nitrogen without air leakage per base as defined in Eq.(19BL) and exclusively used in system stoichiometrics of paragraphs 0044 through 0062; whereas $h_j$ is a specific enthalpy term defined in paragraph 0029 used in energy equations following paragraph 0063.

What is claimed is:

1. A method for quantifying the operation of a recovery boiler burning black liquor fuel bearing sodium compounds through knowledge of when its heat exchanger leaks working fluid into the combustion gas path producing a tube leakage, the method for quantifying the operation comprising the steps of:

monitoring the recovery boiler burning black liquor fuel bearing sodium compounds by one of the Input/Loss methods, developing a mathematical model of the combustion process incorporating terms commonly associated with black liquor fuel combustion including sodium compounds and terms associated with sources of working fluid flows into the combustion gas path including tube leakage resulting in a stoichiometric model of the combustion process, and determining the tube leakage based on the stoichiometric model of the combustion process resulting in a stoichiometrically determined tube leakage.

2. The method according to claim 1 further comprising the steps, after determining, of:

obtaining a molecular weight of the fossil fuel, obtaining a molecular weight of the working fluid, obtaining a fuel flow rate of the recovery boiler, determining a tube leakage mass flow rate based on the stoichiometrically determined tube leakage, the molecular weight of the fossil fuel, the molecular weight of the working fluid, the fuel flow rate, and the stoichiometric model of the combustion process, and reporting the tube leakage mass flow rate such that corrective action may take place.

3. The method according to claim 2 further comprising the steps, after reporting, of:

identifying a set of heat exchangers descriptive of the recovery boiler as employed to transfer net energy flow to the working fluid from the combustion gases resulting in a set of identified heat exchangers, obtaining a set of Operating Parameters applicable to the set of identified heat exchangers, analyzing a set of net energy flows to the working fluid from the combustion gases based on the set of identified heat exchangers, the set of Operating Parameters and the tube leakage flow rate, each analyzed set descriptive of the recovery boiler and wherein each analyzed set the tube leakage flow rate is assigned to a different heat exchanger, resulting in an analyzed set of heat exchangers, determining a reference key comparative parameter for the recovery boiler, obtaining a set of key comparative parameters associated with each identified heat exchanger, applicable with the reference key comparative parameter, and based on the analyzed set of heat exchangers, determining a set of deviations between the set of key comparative parameters and the reference key comparative parameter, determining an identification of the leaking heat exchanger based on the set of deviations, and reporting to the operator of the recovery boiler the identification of the leaking heat exchanger such that corrective action may take place.

4. The method of claim 1, wherein the step of developing the mathematical model of the combustion process comprises:

forming a hydrogen stoichiometric balance based on the stoichiometric model of the combustion process using a molar base, and, wherein the step of determining the tube leakage comprises, solving the hydrogen stoichiometric balance for the tube leakage in moles.

5. A method for quantifying the operation of a recovery boiler burning black liquor fuel bearing sodium compounds when being monitored by one of the Input/Loss methods through knowledge of when its heat exchanger leaks working fluid into the combustion gas path producing a tube leakage, the method for quantifying the operation comprising the steps of:

developing a mathematical model of the combustion process incorporating terms commonly associated with the combustion of black liquor fuel including sodium compounds and terms associated with sources of working fluid flows into the combustion gas path including tube leakage resulting in a stoichiometric model of the combustion process, selecting a set of minimization techniques applicable to the recovery boiler burning black liquor fuel, and a set of routine inputs and convergence criteria to the minimization techniques, selecting a Choice Operating Parameter of tube leakage flow rate, selecting a set of routine Choice Operating Parameters, determining a set of System Effect Parameters applicable to the recovery boiler burning black liquor fuel whose functionalities are sensitive to tube leakage flow rate, determining a set of Reference System Effect Parameters applicable to the set of System Effect Parameters, determining an objective function which allows the minimization of differences between the set of System Effect Parameters and the set of Reference Systems Effect Parameters by optimizing the selection of Choice Operating Parameters, resulting in a mathematical model of the combustion process based on System Effect Parameters, and, wherein the step of determining the tube leakage comprises:

minimizing the objective function resulting in a set of optimized Choice Operating Parameters including the tube leakage flow rate, and reporting the tube leakage flow rate such that corrective action may take place.

6. The method according to claim 5 further comprising the steps, after reporting, of:

determining a set of Reference Fuel Characteristics, determining the fuel chemistry of the black liquor fuel being combusted in the recovery boiler using one of the Input/Loss methods, the mathematical model of the combustion process, the set of converged Choice Operating Parameters, and the set of Reference Fuel Characteristics, determining a fuel heating value of the system based on the fuel chemistry and the set of Reference Fuel Characteristics, obtaining a set of Operating Parameters, determining a Firing Correction base on the set of Operating Parameters, and determining a high accuracy boiler efficiency of the recovery boiler independent of fuel flow based on the set of converged Choice Operating Parameters including the tube leakage flow rate, the fuel chemistry, the fuel heating value, the Firing Correction and the set of Operating Parameters.

7. The method according to claim 6 further comprising the steps, after determining the high accuracy boiler efficiency, of:

determining an energy flow to the working fluid of the recovery boiler based on the set of Operating Parameters as influenced by the tube leakage flow rate, determining a fuel flow of the fossil fuel being combusted using the energy flow to the working fluid, the fuel heating value, the Firing Correction and the high accuracy boiler efficiency, and reporting the fuel flow as influenced by the tube leakage flow rate.

8. The method according to claim 7 further comprising the steps, after reporting, of:

determining a useful output from the recovery boiler, determining a system efficiency using the fuel flow, the fuel heating value, the Firing Correction and the useful output from the recovery boiler, and reporting the system efficiency as influenced by the tube leakage flow rate.

9. The method according to claim 7 further comprising the steps, after reporting, of:

determining a useful output from the recovery boiler, determining a system efficiency using the energy flow to the working fluid, the high accuracy boiler efficiency and the useful output from the recovery boiler, and reporting the system efficiency as influenced by the tube leakage flow rate.

10. The method of claim 5, wherein the step of selecting the set of minimization techniques applicable to the recovery boiler burning black liquor fuel comprises a step of:

incorporating a BFGS technique applicable to the recovery boiler and its fuel.

11. The method of claim 5, wherein the step of selecting the set of minimization techniques applicable to the recovery boiler burning black liquor fuel comprises a step of:

incorporating a Simulated Annealing technique applicable to the recovery boiler and its fuel.

12. The method of claim 5, wherein the step of selecting the set of minimization techniques applicable to the recovery boiler burning black liquor fuel comprises a step of:

incorporating a neural network technique applicable to the recovery boiler burning black liquor fuel.

13. The method of claim 5, wherein the step of selecting the set of minimization techniques applicable to the recovery boiler burning black liquor fuel comprises a step of:

incorporating a Neugents technology applicable to the recovery boiler burning black liquor fuel.

14. The method of claim 5, wherein the step of selecting the set of minimization techniques applicable to the recovery boiler burning black liquor fuel comprises a step of:

incorporating a Pegasus Technology applicable to the recovery boiler burning black liquor fuel.

15. The method of claim 5, wherein the step of selecting the set of minimization techniques applicable to the recovery boiler burning black liquor fuel comprises a step of:

incorporating a NeuCo, Inc. technology.

16. The method of claim 5, wherein the step of selecting the set of routine Choice Operating Parameters comprises a step of:

determining a set of scaling factors for the set of routine Choice Operating Parameters resulting in the set of routine Choice Operating Parameters whose values are scaled.

17. The method according to claim 5 further comprising the steps, after reporting, of:

identifying a set of heat exchangers descriptive of the recovery boiler as employed to transfer net energy flow to the working fluid from the combustion gases resulting in a set of identified heat exchangers, obtaining a set of Operating Parameters applicable to the set of identified heat exchangers, analyzing a set of net energy flows to the working fluid from the combustion gases based on the set of identified heat exchangers, the set of Operating Parameters and the tube leakage flow rate, each analyzed set descriptive of the recovery boiler and wherein each analyzed set the tube leakage flow rate is assigned to a different heat exchanger, resulting in an analyzed set of heat exchangers, determining a reference key comparative parameter for the recovery boiler, obtaining a set of key comparative parameters associated with each identified heat exchanger, applicable with the reference key comparative parameter, and based on the analyzed set of heat exchangers, determining a set of deviations between the set of key comparative parameters and the reference key comparative parameter, determining an identification of the leaking heat exchanger based on the set of deviations, and reporting to the operator of the recovery boiler the identification of the leaking heat exchanger such that corrective action may take place.

18. The method of claim 17, wherein the step of determining the reference key comparative parameter for the recovery boiler, comprises a step of:

selecting a fuel flow as the reference key comparative parameter for the recovery boiler.

19. The method of claim 17, wherein the step of determining the reference key comparative parameter for the recovery boiler, comprises a step of:

selecting a fuel water fraction as the reference key comparative parameter.

20. The method of claim 17, wherein the step of determining the reference key comparative parameter for the recovery boiler, comprises a step of:

selecting a heating value as the reference key comparative parameter.

21. The method of claim 17, wherein the step of determining the reference key comparative parameter for the recovery boiler, comprises a step of:

selecting a Fuel Consumption Index for each heat exchanger as the reference key comparative parameter for the recovery boiler.

22. A method for quantifying the operation of a thermal system burning a fossil fuel, including a recovery boiler, producing effluents from combustion when being monitored on-line by one of the Input/Loss methods, said effluents from combustion influenced by an air leakage, the method comprising the steps of:

selecting one of the Input/Loss methods resulting in a selected Input/Loss method, selecting a set of effluent concentrations associated with the thermal system based on available instrumentation resulting in a set of available plant effluent concentrations, obtaining a ratio of effluent concentrations based on an effluent concentration obtained before the air leakage and on an effluent concentration obtained after the air leakage, resulting in an obtained ratio across the air leakage, and establishing an air pre-heater leakage factor which describes the effects of the air leakage into the thermal system based on the obtained ratio across the air leakage.

23. The method of claim 22, wherein the step of obtaining the ratio of effluent concentrations includes the step of:

obtaining a ratio of an effluent $CO_2$ concentration obtained before and after the air leakage, resulting in the obtained ratio across the air leakage.

24. The method of claim 22, wherein the step of obtaining the ratio of effluent concentrations includes the step of:

obtaining a ratio of an effluent $O_2$ concentration obtained before and after the air leakage, resulting in the obtained ratio across the air leakage.

25. The method of claim 22, wherein the step of selecting the set of effluent concentrations associated with the thermal system, includes the step of:

selecting a $O_2$ concentration upstream of the air leakage and a $CO_2$ concentration downstream of the air leakage resulting in the set of available plant effluent concentrations.

26. The method of claim 22, wherein the step of establishing the air pre-heater leakage factor includes the step of establishing a unity value for the air pre-heater leakage factor.

27. The method of claim 22, including, after the step of establishing the air pre-heater leakage factor, the additional steps of:

obtaining a concentration of $O_2$ in the combustion air local to the thermal system, determining a ratio of air leakage to combustion air based on the air pre-heater leakage factor and the concentration of $O_2$ in the combustion air, resulting in an air pre-heater dilution factor.

28. The method of claim 27, including, after the step of determining the ratio of air leakage to combustion air, the additional steps of:

using a consistent set of effluent concentrations to be use by the selected Input/Loss method based on the air pre-heater leakage factor and the set of available plant effluent concentrations, using a combustion equation based on the consistent set of effluent concentrations and the air pre-heater dilution factor, and resolving the combustion equation through use of the selected Input/Loss method.

29. The method of claim 27, wherein the step of obtaining the concentration of $O_2$ in the combustion air includes the step of using a concentration of $O_2$ in the combustion air local to the thermal system of 20.948%.

30. The method of claim 27, wherein the step of obtaining the concentration of $O_2$ in the combustion air includes the step of using a concentration of $O_2$ in the combustion air local to the thermal system based on an average value at sea level determined by the National Aeronautics and Space Administration.

31. A method for quantifying the operation of a recovery boiler burning black liquor fuel when being monitored by one of the Input/Loss methods through knowledge of a stoichiometric mechanism of how a heat exchanger could be leaking a tube leakage flow rate into the combustion gas path, the method for quantifying the operation comprising the steps of:

developing a mathematical model of the combustion process incorporating terms commonly associated with fossil fuel combustion and terms associated with sources of working fluid flows into the combustion gas path including tube leakage, obtaining a set of Choice Operating Parameters, obtaining a set of Reference Fuel Characteristics, obtaining a fuel chemistry of the fuel being combusted by the recovery boiler using one of the Input/Loss methods, the mathematical model of the combustion process; the set of Choice Operating Parameters, and the set of Reference Fuel Characteristics, said fuel chemistry resulting in a set of fuel concentrations, establishing a set of concentration limits for each fuel constituent based on Reference Fuel Characteristics, testing the set of fuel concentrations against the set of concentration limits resulting in a trip mechanism indicating the stoichiometric reason how a heat exchanger leaks a tube leakage flow rate into the combustion gas path, and reporting the trip mechanism to the operator of the recovery boiler.

32. A method for quantifying the operation of a recovery boiler burning black liquor fuel when being monitored by one of the Input/Loss methods through knowledge of a stoichiometric mechanism of how a heat exchanger could be leaking a tube leakage flow rate into the combustion gas path, the method for quantifying the operation comprising the steps of:

developing a mathematical model of the combustion process incorporating terms commonly associated with fossil fuel combustion and terms associated with sources of working fluid flows into the combustion gas path including tube leakage, selecting a set of minimization techniques applicable to the recovery boiler burning black liquor fuel, processing a set of routine inputs and convergence criteria to the minimization techniques, assuming a tube leakage flow rate is zero, selecting a set of routine Choice Operating Parameters, determining a set of System Effect Parameters applicable to the recovery boiler burning black liquor fuel whose functionalities effect the determination of system efficiency, determining a set of Reference System Effect Parameters applicable to the set of System Effect Parameters, determining an objective function applicable to the recovery boiler, the set of routine Choice Operating Parameters, the set of System Effect Parameters and the set of Reference System Effect Parameters, optimizing the set of routine Choice Operating Parameters based on the mathematical model of the combustion process, the set of minimization techniques, and the objective function such that convergence is met resulting in a set of converged Choice Operating Parameters, determining a fuel chemistry of the fuel being combusted by the recovery boiler using one of the Input/Loss methods, the mathematical model of the combustion process, the set of converged Choice Operating Parameters, and Reference Fuel Characteristics resulting in a fuel elemental composition, a fuel ash fraction and a fuel water fraction said composition and fractions resulting in a set of fuel concentrations, establishing a set of concentration limits for the set of fuel concentrations based on Reference Fuel Characteristics, testing the set of fuel concentrations against the set of concentration limits resulting in a trip mechanism indicating the stoichiometric reason how a heat exchanger leaks a tube leakage flow rate into the combustion gas path, and reporting the trip mechanism to the operator of the recovery boiler.

33. The method of claim 32, wherein the step of establishing the set of concentration limits for the set of fuel concentrations based on Reference Fuel Characteristics and the step of testing the set of fuel concentrations against the concentration limits, comprises the steps of:

determining a set of correction factors to Choice Operating Parameters using their initial and converged values, and establishing a set of correction factor limits for the selected Choice Operating Parameters, and testing the set of correction factors against the set of correction factor limits resulting in a trip mechanism indicating the stoichiometric reason how a heat exchanger leaks a tube leakage flow rate into the combustion gas path.

34. A method for quantifying the operation of a recovery boiler burning black liquor fuel in a combustion process through knowledge of when one of its heat exchangers, whose tubes contain working fluid heated by products of combustion, has a tube leak of working fluid mixing with the products of combustion, the method for quantifying the operation comprising the steps of:

selecting a neural network technology applicable to the recovery boiler, selecting a set of routine inputs and database for the neural network technology, selecting a set of Choice Operating Parameters including tube leakage flow rate, and, wherein the step of determining the tube leakage comprises the step of:

optimizing the set of Choice Operating Parameters including tube leakage flow rate using the neural network technology, and the set of routine inputs and database such that convergence is met resulting in a set of converged Choice Operating Parameters including a tube leakage flow rate, and reporting the tube leakage flow rate such that corrective action may take place.

35. The method of claim 34, wherein the step of selecting the neural network technology applicable to the recovery boiler burning black liquor fuel, comprises a step of:

selecting a Neugents technology applicable to the recovery boiler burning black liquor fuel.

36. The method of claim 34, wherein the step of selecting the neural network technology applicable to the recovery boiler burning black liquor fuel, comprises a step of:

selecting a Pegasus Technology applicable to the recovery boiler burning black liquor fuel.

37. The method of claim 34, wherein the step of selecting the neural network technology applicable to the recovery boiler burning black liquor fuel, comprises a step of:

selecting a NeuCo, Inc. technology applicable to the recovery boiler burning black liquor fuel.

38. A method for quantifying the operation of a recovery boiler burning black liquor fuel when being monitored by one of the Input/Loss methods coincident with one of its heat exchangers leaking its working fluid into the combustion gas path producing a tube leakage flow, the method for quantifying the operation by identification of the leaking heat exchanger comprising the steps of:

identifying a set of heat exchangers descriptive of the recovery boiler as employed to transfer net energy flow to the working fluid from the combustion gases resulting in a set of identified heat exchangers, obtaining a set of Operating Parameters applicable to the set of identified heat exchangers, analyzing a set of net energy flows to the working fluid from the combustion gases based on the set of identified heat exchangers, the set of Operating Parameters and the tube leakage flow rate, each analyzed set descriptive of the recovery boiler and wherein each analyzed set the tube leakage flow rate is assigned to a different heat exchanger, resulting in an analyzed set of heat exchangers, determining a reference key comparative parameter for the recovery boiler, obtaining a set of key comparative parameters associated with each identified heat exchanger, applicable with the reference key comparative parameter, and based on the analyzed set of heat exchangers, determining a set of deviations between the set of key comparative parameters and the reference key comparative parameter, determining an identification of the leaking heat exchanger based on the set of deviations, and reporting to the operator of the recovery boiler the identification of the leaking heat exchanger such that corrective action may take place.

39. The method of claim 38, wherein the step of determining the reference key comparative parameter for the recovery boiler, comprises a step of:

selecting a fuel flow as the reference key comparative parameter for the recovery boiler.

40. The method of claim 38, wherein the step of determining the reference key comparative parameter for the recovery boiler, comprises a step of:

selecting a fuel water fraction as the reference key comparative parameter for the recovery boiler.

41. The method of claim 38, wherein the step of determining the reference key comparative parameter for the recovery boiler, comprises a step of:

selecting a heating value as the reference key comparative parameter for the recovery boiler.

42. The method of claim 38, wherein the step of determining the reference key comparative parameter for the recovery boiler, comprises a step of:

selecting a computed cleanliness factor for each heat exchanger as the reference key comparative parameter for the recovery boiler.

43. A method for quantifying the operation of a recovery boiler burning a fossil fuel in a combustion process through knowledge of when one of its heat exchangers, whose tubes contain working fluid heated by products of combustion, has a tube leak of working fluid mixing with the products of combustion, the method for quantifying the operation comprising the steps of:

monitoring the recovery boiler using one of the Input/Loss methods, developing a mathematical model of the combustion process incorporating terms commonly associated with the combustion process and terms associated with sources of working fluid mixing with the products of combustion including tube leakage, determining a tube leakage based on the mathematical model of the combustion process, and reporting the tube leakage such that corrective action may take place.

44. The method of claim 43, wherein the step of developing a mathematical model of the combustion process comprises the steps of:

forming a hydrogen stoichiometric balance of the combustion process including terms associated with sources of working fluid mixing with the combustion products including tube leakage, and solving the hydrogen stoichiometric balance for the tube leakage.

45. The method of claim 43, wherein the step of monitoring the recovery boiler using one of the Input/Loss methods, comprises the step of:

monitoring the recovery boiler using The Input/Loss Method.

46. The method of claim 43, wherein the step of monitoring the recovery boiler using one of the Input/Loss methods, comprises the step of:

determining a fuel chemistry based on one of the Input/Loss methods.

47. The method of claim 43, wherein the step of monitoring the recovery boiler using one of the Input/Loss methods, comprises the steps of:

determining a fuel heating value based on one of the Input/Loss methods.

48. The method of claim 43 further comprising the steps, after reporting, of:

identifying a set of heat exchangers descriptive of the recovery boiler resulting in a set of identified heat exchangers, obtaining a set of Operating Parameters applicable to the set of identified heat exchangers resulting in a set of heat exchanger data sufficient to determine net energy flow to the working fluid from the products of combustion for each heat exchanger in the set of identified heat exchangers, calculating a net energy flow to the working fluid of the recovery boiler as many times as there are heat exchangers in the set of identified heat exchangers, wherein each calculation of net energy flow includes all heat exchangers in the set of identified heat exchangers, wherein for each calculation of net energy flow the tube leakage is assigned to a different heat exchanger, resulting in a set of analyzed heat exchangers based on the set of heat exchanger data, determining a set of reference key comparative parameters, obtaining a set of key comparative parameters associated with the set of identified heat exchangers applicable with the set of reference key comparative parameters, and based on the set of analyzed heat exchangers, determining a set of deviations between the set of key comparative parameters and the set of reference key comparative parameters, identifying a location of the heat exchanger within the recovery boiler having the tube leak based on the set of deviations, and reporting to the operator of the recovery boiler the location of the heat exchanger within the recovery boiler having the tube leak such that corrective action may take place.

49. A method for quantifying the operation of a recovery boiler burning a black liquor fuel in a combustion process through knowledge of when one of its heat exchangers, whose tubes contain working fluid heated by products of combustion, has a tube leak of working fluid mixing with the products of combustion, the method for quantifying the operation comprising:

determining a location of the heat exchanger within the recovery boiler with the tube leak based on the working fluid's energy flow by assigning the tube leak to different heat exchangers.

50. The method of claim 49 further comprising:

obtaining a heating value of the black liquor fuel, obtaining a Firing Correction applicable to the recovery boiler, obtaining a high accuracy boiler efficiency, and determining a calculated fuel flow based on the working fluid's energy flow effected by the tube leak of working fluid, the location of the heat exchanger within the recovery boiler with the tube leak, the high accuracy boiler efficiency, the fossil fuel heating value, and the Firing Correction.

51. The method of claim 50, wherein the step of obtaining the high accuracy boiler efficiency comprises:

using the black liquor fuel's calorimetric temperature, established when determining the fuel's heating value, as the thermodynamic reference energy level for an Enthalpy of Products term, as the thermodynamic reference energy level for an Enthalpy of Reactants term, and also as the thermodynamic reference energy level for a Firing Correction term evaluated independent of a fuel flow and an effluent flow, said terms comprising the major terms of the high accuracy boiler efficiency.

52. The method of claim 50 wherein the step of obtaining the heating value of the black liquor fuel comprises:

obtaining a higher heating value of the fuel, obtaining a lower heating value of the fuel;

and wherein the step of obtaining the high accuracy boiler efficiency comprises:

obtaining a higher heating value high accuracy boiler efficiency based on the higher heating value of the fuel, obtaining a lower heating value high accuracy boiler efficiency based on the lower heating value of the fuel;

and wherein the step of determining the calculated fuel flow comprises:

demonstrating that a computed fuel flow based on the higher heating value high accuracy boiler efficiency and a computed fuel flow based on the lower heating value high accuracy boiler efficiency are comparable.

53. The method of claim 49 further comprising:

obtaining a high accuracy boiler efficiency, obtaining a useful output produced from the recovery boiler, determining a calculated system efficiency of the recovery boiler based on the working fluid's energy flow effected by the tube leak of working fluid, the location of the heat exchanger within the recovery boiler with the tube leak, the high accuracy boiler efficiency and the useful output produced from the recovery boiler.

54. The method of claim 53, wherein the step of obtaining the high accuracy boiler efficiency comprises:

using the black liquor fuel's calorimetric temperature, established when determining the fuel's heating value, as the thermodynamic reference energy level for an Enthalpy of Products term, as the thermodynamic reference energy level for an Enthalpy of Reactants term, and also as the thermodynamic reference energy level for a Firing Correction term evaluated independent of a fuel flow and an effluent flow, said terms comprising the major terms of the high accuracy boiler efficiency.

55. A method for quantifying the operation of a thermal system burning a fossil fuel, including a recovery boiler, having a heat exchangers/combustion region producing combustion products, the method comprising the steps of:

before on-line operation, installing an explicit mathematical model of the combustion process; and thereafter operating on-line while using the explicit mathematical model of the combustion process, the step of operating on-line comprising the steps of measuring a set of measurable operating parameters, including at least effluent concentrations of $O_2$ and $CO_2$, these measurements being made at a location downstream of the heat exchangers/combustion region of the thermal system, obtaining an effluent concentration of $H_2O$, if reference fuel characteristics indicate fuel water is not predictable, as an obtained effluent $H_2O$, obtaining an air pre-heater leakage factor, and computing a fuel chemistry as a function of the explicit mathematical model of the combustion process, the set of measurable operating parameters, the obtained effluent $H_2O$, and the air pre-heater leakage factor.

56. The method of claim 55, wherein the step of operating on-line includes the additional step after calculating the fuel chemistry, of using a fuel heating value computed as a function of the fuel chemistry.

57. The method of claim 56, including, after the step of calculating the fuel heating value, the additional steps of obtaining a System Effect Parameter associated with the thermal system and its fuel, obtaining a multidimensional minimization analysis employing the System Effect Parameter to minimize the error associated with at least one quantity selected from the group comprising the effluent concentration of $O_2$, the effluent concentration of $CO_2$, the obtained effluent $H_2O$ and the air pre-heater leakage factor, obtaining and applying for subsequent on-line analysis correction factors to at least one quantity selected from the group comprising the effluent concentration of $O_2$, the effluent concentration of $CO_2$, the obtained effluent $H_2O$ and the air pre-heater leakage factor.

58. The method of claim 55, wherein the step of calculating the fuel chemistry includes the step of calculating explicitly a moisture-ash-free fuel chemistry, as a function of the explicit mathematical model of the combustion process, the set of measurable operating parameters, the obtained effluent $H_2O$, and the air pre-heater leakage factor.

59. The method of claim 55, wherein the step of obtaining the air pre-heater leakage factor includes the step of using a value of unity for the air pre-heater leakage factor.

60. A method for quantifying the operation of a recovery boiler burning black liquor fuel in which a fossil fuel is supplied at a flow rate to a heat exchangers/combustion region and combusted to produce hot combustion gases, which heats a working fluid then exits through an exhaust stack, the method comprising the following steps:

performing an off-line operation comprising the steps of obtaining reference fuel characteristics, obtaining current measurements of the system's operating parameters, and performing an on-line operation comprising the steps of measuring the useful output of the system, obtaining fuel data and characteristics, the step of obtaining fuel data including the step of obtaining composite fuel concentrations and composite heating value, if multiple fuels are used, introducing fuel concentrations and heating values to a mathematical model of the recovery boiler, obtaining routine systems operational parameters, obtaining values of the effluents $O_2$, $CO_2$, $H_2O$ and $SO_2$, obtaining the ambient concentration of $O_2$, obtaining air pre-heater leakage and dilution factors, computing molar moisture-ash-free fractions of fuel carbon and fuel water as explicit stoichiometric solutions, dependent at least in part on the reference fuel characteristics, the effluents $O_2$, $CO_2$, $H_2O$ and $SO_2$, ambient concentration of $O_2$, and air pre-heater leakage and dilution factors, finding the molar moisture-ash-free fractions of fuel nitrogen, oxygen, hydrogen, sulfur, sodium, potassium and chloride, converting the molar moisture-ash-free fuel concentrations to a molar dry base, then to a molar As-Fired wet base, and finally to As-Fired wet weight fractions, to obtain a complete and consistent computed As-Fired fuel chemistry, computing a heating value based on a moisture-ash-free weight base, then converted to a dry base, and then to a weight-based As-Fired heating value, and executing the mathematical model of the recovery boiler using the fuel information and the concentration of effluent $O_2$ to produce consistent stoichiometric values of effluent $CO_2$, $SO_2$ and $H_2O$ values, the moles of fuel per basis moles of dry gaseous effluent, and at least the following self-consistent thermal performance parameters: As-Fired fuel flow, effluent flow, emission rates, boiler efficiency, and over-all system thermal efficiency.

61. The method of claim 60, including an additional step, after the step of executing, of performing analysis of instrumentation errors to obtain correction factors, and, if excessive, applying the correction factors to instrumentation signals such that subsequent on-line operation produces minimum errors in fuel chemistry and heating value determinations.

62. The method of claim 61, including an additional step, after the step of performing analysis of instrumentation errors, of adjusting operation of the system to improve its efficiency based upon the results.

63. A method for quantifying the operation of a recovery boiler burning black liquor fuel having a heat exchangers/combustion region producing combustion products, the method comprising the steps of:

before on-line operation, the steps of obtaining a set of reference fuel characteristics, and developing explicit mathematical models of the combustion process involving at least stoichiometric balances; and thereafter operating on-line, the step of operating on-line including the steps of measuring a set of measurable operating parameters, including at least effluent concentrations of $O_2$ and $CO_2$, these measurements being made at a location downstream of the heat exchangers/combustion region of the recovery boiler, obtaining an effluent concentration of $H_2O$ if the set of reference fuel characteristics indicates that fuel water is not predictable, as an obtained effluent $H_2O$, obtaining a concentration of $O_2$ in the ambient air entering the recovery boiler, obtaining an air pre-heater leakage factor, calculating a set of fuel chemistry concentrations including elemental fuel constituents, fuel water and fuel inerts, as a function of the set of reference fuel characteristics, explicit mathematical models of the combustion process, the set of measurable operating parameters, the obtained effluent $H_2O$, the concentration of $O_2$ in the ambient air entering the recovery boiler, and the air pre-heater leakage factor.

64. The method of claim 63, wherein the step of calculating the set of fuel chemistry concentrations including elemental fuel constituents, fuel water and fuel inerts, includes the step of calculating a set of moisture-ash-free fuel chemistry concentrations including elemental fuel constituents, fuel water and fuel inerts as a function of the set of reference fuel characteristics, explicit mathematical models of the combustion process, the set of measurable operating parameters, the obtained effluent $H_2O$, the concentration of $O_2$ in the ambient air entering the recovery boiler, and the air pre-heater leakage factor.

65. The method of claim 63, wherein the step of calculating the set of fuel chemistry concentrations including elemental fuel constituents, fuel water and fuel inerts, includes the step of calculating a set of dry-based fuel chemistry concentrations including elemental fuel constituents, fuel water and fuel inerts as a function of the set of reference fuel characteristics, explicit mathematical models of the combustion process, the set of measurable operating parameters, the obtained effluent $H_2O$, the concentration of $O_2$ in the ambient air entering the recovery boiler, and the air pre-heater leakage factor.

66. The method of claim 63, wherein the step of operating on-line includes the additional step after calculating the complete As-Fired fuel chemistry, of calculating an As-Fired fuel heating value as a function of the complete As-Fired fuel chemistry and the set of reference fuel characteristics.

67. The method of claim 66, including, after the step of calculating the As-Fired fuel heating value, the additional steps of obtaining a set of System Effect Parameters associated with the recovery boiler and its fuel, completing a multidimensional minimization analysis employing the set of System Effect Parameters to minimize the collective error associated with at least one of the measured effluent $CO_2$, the obtained effluent $H_2O$, the obtained fuel flow, the concentration of $O_2$ in the ambient air entering the recovery boiler, and the air pre-heater leakage factor, obtaining and applying for subsequent on-line analysis correction factors to the measured effluent $CO_2$, the obtained effluent $H_2O$, the obtained fuel flow, the concentration of $O_2$ in the ambient air entering the recovery boiler, and the air pre-heater leakage factor.

68. The method of claim 66, wherein the set of measurable operating parameters includes effluent temperature, and wherein the method includes an additional step, after the step of calculating the As-Fired fuel heating value, of obtaining a Firing Correction term, calculating a high accuracy boiler efficiency as a function of the complete As-Fired fuel chemistry, effluent temperature, the effluent concentrations, the As-Fired fuel heating value and the Firing Correction term.

69. The method of claim 63, wherein the step of operating on-line includes the additional step after calculating the complete As-Fired fuel chemistry, of calculating an As-Fired fuel heating value as a function of the complete As-Fired fuel chemistry and the set of reference fuel characteristics.

70. The method of claim 69, including, after the step of calculating the As-Fired fuel heating value, the additional steps of obtaining a set of System Effect Parameters associated with the recovery boiler and its fuel, completing a multidimensional minimization analysis employing the set of System Effect Parameters to minimize the collective error associated with at least one of the measured effluent $CO_2$, the obtained effluent $H_2O$, the obtained fuel flow, the concentration of $O_2$ in the ambient air entering the recovery boiler, and the air pre-heater leakage factor, obtaining and applying for subsequent on-line analysis correction factors to the measured effluent $CO_2$, the obtained effluent $H_2O$, the obtained fuel flow, the concentration of $O_2$ in the ambient air entering the recovery boiler, and the air pre-heater leakage factor.

71. The method of claim 63, wherein the step of calculating the set of fuel chemistry concentrations including elemental fuel constituents, fuel water and fuel inerts, includes the step of calculating explicitly a set of fuel chemistry concentrations including elemental fuel constituents, fuel water and fuel inerts as a function of the set of reference fuel characteristics, explicit mathematical models of the combustion process, the set of measurable operating parameters, the obtained effluent $H_2O$, the concentration of $O_2$ in the ambient air entering the recovery boiler, and the air pre-heater leakage factor.

72. The method of claim 63, wherein the step of obtaining the concentration of $O_2$ in the ambient air entering the recovery boiler includes the step of using a value of 20.948 percent for the concentration of $O_2$ in the ambient air entering the recovery boiler.

73. The method of claim 63, wherein the step of obtaining the concentration of $O_2$ in the ambient air entering the recovery boiler includes the step of using an average value at sea level determined by the National Aeronautics and Space Administration for the concentration of $O_2$ in the ambient air entering the recovery boiler.

74. The method of claim 63, wherein the step of obtaining the air pre-heater leakage factor includes the step of using a value of unity for the air pre-heater leakage factor.

* * * * *

UNITED STATES PATENT AND TRADEMARK OFFICE

CERTIFICATE OF CORRECTION

PATENT NO. : 7,039,555 B2
APPLICATION NO. : 10/715319
DATED : May 2, 2006
INVENTOR(S) : Fred D. Lang It is certified that error appears in the above-identified patent and that said Letters Patent is hereby corrected as shown below:

Claim 22 should read as follows:

"22. A method for quantifying the operation of a thermal system burning a fossil fuel, including a recovery boiler, producing effluents from combustion when being monitored on-line by one of the Input/Loss methods, said effluents from combustion influenced by an air leakage, the method comprising the steps of:

using one of the Input/Loss methods resulting in a selected Input/Loss method, selecting a set of effluent concentrations associated with the thermal system based on available instrumentation resulting in a set of available plant effluent concentrations, obtaining a ratio of effluent concentrations based on an effluent concentration obtained before the air leakage and on an effluent concentration obtained after the air leakage, resulting in an obtained ratio across the air leakage, and establishing an air pre-heater leakage factor which describes the effects of the air leakage into the thermal system based on the obtained ratio across the air leakage."

Claim 27 should read as follows:

"27. The method of claim 22, including, after the step of establishing the air pre-heater leakage factor, the additional steps of:

obtaining a concentration of $0_2$ in the combustion air local to the thermal system, and using a ratio of air leakage to combustion air based on the air pre-heater leakage factor and the concentration of $0_2$ in the combustion air, resulting in an air pre-heater dilution factor."

Claim 28 should read as follows:

"28. The method of claim 27, including, after the step of using the ratio of air leakage to combustion air, the additional steps of:

using a consistent set of effluent concentrations to be use by the selected Input/Loss method based on the air pre-heater leakage factor and the set of available plant effluent concentrations, using a combustion equation based on the consistent set of effluent concentrations and the air pre-heater dilution factor, and resolving the combustion equation through use of the selected Input/Loss method.

UNITED STATES PATENT AND TRADEMARK OFFICE

CERTIFICATE OF CORRECTION

PATENT NO. : 7,039,555 B2
APPLICATION NO. : 10/715319
DATED : May 2, 2006
INVENTOR(S) : Fred D. Lang It is certified that error appears in the above-identified patent and that said Letters Patent is hereby corrected as shown below:

Claim 58 should read as follows:

"58. The method of claim 55, wherein the step of computing the fuel chemistry includes the step of computing explicitly a moisture-ash-free fuel chemistry as a function of the explicit mathematical model of the combustion process, the set of measurable operating parameters, the obtained effluent $H_20$, and the air pre-heater leakage factor."

Signed and Sealed this

Eighth Day of August, 2006

JON W. DUDAS
*Director of the United States Patent and Trademark Office*